US009464361B2

(12) United States Patent
Mayer et al.

(10) Patent No.: US 9,464,361 B2
(45) Date of Patent: Oct. 11, 2016

(54) CONTROL OF ELECTROLYTE HYDRODYNAMICS FOR EFFICIENT MASS TRANSFER DURING ELECTROPLATING

(71) Applicant: Novellus Systems, Inc., Fremont, CA (US)

(72) Inventors: Steven T. Mayer, Lake Oswego, OR (US); David W. Porter, Sherwood, OR (US)

(73) Assignee: Novellus Systems, Inc., Fremont, CA (US)

( * ) Notice: Subject to any disclaimer, the term of this patent is extended or adjusted under 35 U.S.C. 154(b) by 104 days.

(21) Appl. No.: 14/309,723

(22) Filed: Jun. 19, 2014

(65) Prior Publication Data

US 2014/0299478 A1 Oct. 9, 2014

Related U.S. Application Data

(62) Division of application No. 13/172,642, filed on Jun. 29, 2011.

(60) Provisional application No. 61/361,333, filed on Jul. 2, 2010, provisional application No. 61/374,911, filed on Aug. 18, 2010, provisional application No. 61/405,608, filed on Oct. 21, 2010.

(51) Int. Cl.

| | |
|---|---|
| ***C25D 5/08*** | (2006.01) |
| ***C25D 17/00*** | (2006.01) |
| ***C25D 5/04*** | (2006.01) |
| ***C25D 17/02*** | (2006.01) |
| ***C25D 21/10*** | (2006.01) |

(52) U.S. Cl.

CPC . *C25D 5/04* (2013.01); *C25D 5/08* (2013.01); *C25D 17/001* (2013.01); *C25D 17/008* (2013.01); *C25D 17/02* (2013.01); *C25D 21/10* (2013.01)

(58) Field of Classification Search

CPC ..... C25D 5/08; C25D 7/12–7/126

See application file for complete search history.

(56) References Cited

U.S. PATENT DOCUMENTS

| | | | |
|---|---|---|---|
| 3,652,442 | A | 3/1972 | Powers et al. |
| 3,706,651 | A | 12/1972 | Leland |
| 3,862,891 | A | 1/1975 | Smith |
| 4,033,833 | A | 7/1977 | Bestel et al. |
| 4,082,638 | A | 4/1978 | Jumer |

(Continued)

FOREIGN PATENT DOCUMENTS

| | | | |
|---|---|---|---|
| CN | 101220500 | A | 7/2008 |
| CN | 101736376 | A | 6/2010 |

(Continued)

OTHER PUBLICATIONS

U.S. Appl. No. 14/924,124, filed Oct. 27, 2015, entitled "Edge Flow Element for Electroplating Apparatus,".

(Continued)

*Primary Examiner* — James Lin
*Assistant Examiner* — Ho-Sung Chung
(74) *Attorney, Agent, or Firm* — Weaver Austin Villeneuve & Sampson LLP

(57) ABSTRACT

Described are apparatus and methods for electroplating one or more metals onto a substrate. Embodiments include electroplating apparatus configured for plating highly uniform metal layers. In specific embodiments, the apparatus includes a flow-shaping element made of an ionically resistive material and having a plurality of channels made through the flow shaping element. The channels allow for transport of the electrolyte through the flow shaping element during electroplating. The channel openings are arranged in a spiral-like pattern on the substrate-facing surface of the flow shaping element such that the center of the spiral-like pattern is offset from the center of the flow shaping element.

15 Claims, 27 Drawing Sheets

(56) References Cited

U.S. PATENT DOCUMENTS 4,240,886 A 12/1980 Hodges et al.
4,272,335 A 6/1981 Combs
4,304,641 A 12/1981 Grandia et al.
4,469,564 A 9/1984 Okinaka et al.
4,545,877 A 10/1985 Hillis
4,604,177 A 8/1986 Sivilotti
4,604,178 A 8/1986 Fiegener et al.
4,605,482 A 8/1986 Shiragami et al.
4,633,893 A 1/1987 McConnell
4,696,729 A 9/1987 Santini
4,738,272 A 4/1988 McConnell
4,828,654 A 5/1989 Reed
4,856,544 A 8/1989 McConnell
4,906,346 A 3/1990 Hadersbeck et al.
4,931,149 A 6/1990 Stierman et al.
4,933,061 A 6/1990 Kulkarni et al.
5,039,381 A 8/1991 Mullarkey
5,078,852 A 1/1992 Yee et al.
5,096,550 A 3/1992 Mayer et al.
5,146,136 A 9/1992 Ogura et al.
5,156,730 A 10/1992 Bhatt et al.
5,162,079 A 11/1992 Brown
5,217,586 A 6/1993 Datta et al.
5,316,642 A 5/1994 Young, Jr. et al.
5,368,711 A 11/1994 Poris
5,391,285 A 2/1995 Lytle et al.
5,421,987 A 6/1995 Tzanavaras et al.
5,443,707 A 8/1995 Mori
5,472,592 A 12/1995 Lowery
5,476,578 A 12/1995 Forand et al.
5,498,325 A 3/1996 Nishimura et al.
5,516,412 A 5/1996 Andricacos et al.
5,567,300 A 10/1996 Datta et al.
5,660,699 A 8/1997 Saito et al.
5,723,028 A 3/1998 Poris
5,744,019 A 4/1998 Ang
5,935,402 A 8/1999 Fanti
6,004,440 A 12/1999 Hanson et al.
6,027,631 A 2/2000 Broadbent
6,080,291 A 6/2000 Woodruff et al.
6,106,687 A 8/2000 Edelstein
6,126,798 A 10/2000 Reid et al.
6,132,587 A 10/2000 Jorne et al.
6,132,805 A 10/2000 Moslehi
6,179,983 B1 1/2001 Reid et al.
6,193,860 B1 2/2001 Weling
6,228,231 B1 5/2001 Uzoh
6,251,255 B1 6/2001 Copping et al.
6,254,742 B1 7/2001 Hanson et al.
6,261,433 B1 7/2001 Landau
6,368,475 B1 4/2002 Hanson et al.
6,391,166 B1 5/2002 Wang
6,391,188 B1 5/2002 Goosey
6,395,152 B1 5/2002 Wang
6,398,926 B1 6/2002 Mahneke
6,402,923 B1 6/2002 Mayer et al.
6,431,908 B1 8/2002 Beck et al.
6,454,918 B1 9/2002 Sakaki
6,497,801 B1 12/2002 Woodruff et al.
6,521,102 B1 2/2003 Dordi
6,527,920 B1 3/2003 Jackson et al.
6,551,483 B1 4/2003 Mayer et al.
6,627,051 B2 9/2003 Berner et al.
6,632,335 B2 10/2003 Kumisawa et al.
6,755,954 B2 6/2004 Mayer et al.
6,773,571 B1 8/2004 Mayer et al.
6,800,187 B1 10/2004 Reid et al.
6,821,407 B1 11/2004 Reid et al.
6,843,855 B2 1/2005 Verhaverbeke
6,869,515 B2 3/2005 Cohen
6,890,416 B1 5/2005 Mayer et al.
6,919,010 B1 7/2005 Mayer et al.
6,921,468 B2 7/2005 Graham et al.
6,964,792 B1 11/2005 Mayer et al.
7,070,686 B2 7/2006 Contolini et al.
7,169,705 B2 1/2007 Ide et al.
D544,452 S 6/2007 Nakamura et al.
D548,705 S 8/2007 Hayashi
D552,565 S 10/2007 Nakamura et al.
D553,104 S 10/2007 Oohashi et al.
7,387,131 B2 6/2008 Kuroda et al.
D587,222 S 2/2009 Sasaki et al.
7,622,024 B1 11/2009 Mayer et al.
7,641,776 B2 1/2010 Nagar et al.
D609,652 S 2/2010 Nagasaka et al.
D609,655 S 2/2010 Sugimoto
7,670,465 B2 3/2010 Yang et al.
D614,593 S 4/2010 Lee et al.
7,837,841 B2 11/2010 Chen et al.
7,854,828 B2 12/2010 Reid et al.
7,935,240 B2 5/2011 Singh et al.
7,967,969 B2 6/2011 Mayer et al.
D648,289 S 11/2011 Mayer et al.
8,308,931 B2 11/2012 Reid et al.
8,795,480 B2 8/2014 Mayer et al.
2002/0017456 A1 2/2002 Graham et al.
2002/0062839 A1 5/2002 Verhaverbeke et al.
2002/0066464 A1 6/2002 Bergman
2002/0084189 A1* 7/2002 Wang ..... C25D 21/10 205/98
2002/0119671 A1 8/2002 Lee
2002/0125141 A1 9/2002 Wilson et al.
2002/0164840 A1* 11/2002 Lu ..... H01L 21/76885 438/129
2002/0166773 A1* 11/2002 Cohen ..... C25D 5/026 205/118
2003/0017647 A1* 1/2003 Kwon ..... H01L 21/568 438/109
2003/0019755 A1* 1/2003 Hey ..... C25D 7/123 205/87
2003/0029527 A1 2/2003 Yajima et al.
2003/0038035 A1 2/2003 Wilson et al.
2003/0102210 A1 6/2003 Woodruff et al.
2003/0201166 A1 10/2003 Zheng et al.
2004/0000487 A1 1/2004 Bonkass et al.
2004/0118694 A1* 6/2004 Yang ..... H01L 21/2885 205/157
2004/0149584 A1 8/2004 Nagai et al.
2004/0168926 A1 9/2004 Basol et al.
2004/0231989 A1 11/2004 Kobata et al.
2004/0256238 A1* 12/2004 Suzuki ..... H01L 21/2885 205/118
2005/0003737 A1 1/2005 Montierth et al.
2005/0045488 A1* 3/2005 Paneccasio, Jr. ..... C25D 3/38 205/291
2005/0145482 A1* 7/2005 Suzuki ..... C25D 17/06 204/199
2005/0145499 A1 7/2005 Kovarsky et al.
2005/0161336 A1 7/2005 Woodruff et al.
2005/0181252 A1 8/2005 Risen et al.
2006/0054181 A1 3/2006 Rayandayan et al.
2006/0243598 A1 11/2006 Singh et al.
2007/0015080 A1* 1/2007 Toukhy ..... G03F 7/022 430/270.1
2007/0029193 A1 2/2007 Brcka
2007/0068819 A1 3/2007 Singh et al.
2010/0032304 A1 2/2010 Mayer et al.
2010/0032310 A1* 2/2010 Reid ..... C25D 21/12 205/261
2010/0044236 A1 2/2010 Mayer et al.
2010/0116672 A1 5/2010 Mayer et al.
2011/0031112 A1 2/2011 Birang et al.
2012/0000786 A1 1/2012 Mayer et al.
2012/0261254 A1 10/2012 Reid et al.
2013/0313123 A1 11/2013 Abraham et al.
2014/0183049 A1 7/2014 Mayer et al.
2014/0299477 A1 10/2014 Mayer et al.
2014/0357089 A1 12/2014 Buckalew et al.

FOREIGN PATENT DOCUMENTS

CN 102330140 A 1/2012
CN 201130081716.6 4/2012
CN 102459717 A 5/2012

(56) References Cited

FOREIGN PATENT DOCUMENTS

| | | | |
|---|---|---|---|
| CN | 102732924 | A | 10/2012 |
| EP | 0 037 325 | | 3/1981 |
| EP | 0 233 184 | | 8/1987 |
| EP | 1 538 662 | | 6/2005 |
| GB | 2 176 908 | | 1/1987 |
| GB | 2 206 733 | | 1/1989 |
| JP | 59-162298 | | 9/1984 |
| JP | 09-53197 | | 2/1997 |
| JP | 2001-064795 | A | 3/2001 |
| JP | 2001-316887 | | 11/2001 |
| JP | 2002-289568 | | 10/2002 |
| JP | 2003-268591 | | 9/2003 |
| KR | 10-0707121 | | 4/2007 |
| KR | 0657600 | | 8/2012 |
| TW | 591122 | B | 6/2004 |
| TW | D148167 | | 7/2012 |
| WO | WO 87/00094 | | 1/1987 |
| WO | WO 99/41434 | | 8/1999 |
| WO | WO 02/01609 | | 1/2002 |
| WO | WO 2004/114372 | | 12/2004 |
| WO | WO 2007/128659 | | 11/2007 |
| WO | WO 2010/144330 | | 12/2010 |

OTHER PUBLICATIONS

US Office Action dated Nov. 2, 2015 issued in U.S. Appl. No. 13/893,242.
US Office Action dated Aug. 18, 2015 issued in U.S. Appl. No. 14/308,258.
US Notice of Allowance dated May 5, 2015 issued in U.S. Appl. No. 13/904,283.
TW Office Action dated Apr. 8, 2015 issued in Application No. 100123415.
U.S. Appl. No. 13/110,759, filed May 18, 2011, entitled "High Resistance Ionic Current Source", Mayer et al.
U.S. Appl. No. 14/308,258, filed Jun. 18, 2014, entitled "Control of Electrolyte Hydrodynamics for Efficient Mass Transfer During Electroplating".
US Office Action dated Oct. 26, 2007 issued in U.S. Appl. No. 11/040,359.
US Final Office Action dated Jul. 25, 2008 issued in U.S. Appl. No. 11/040,359.
US Office Action dated Jan. 8, 2009 issued in U.S. Appl. No. 11/040,359.
US Notice of Allowance dated Jul. 20, 2009 issued in U.S. Appl. No. 11/040,359.
US Office Action dated Oct. 6, 2010 issued in U.S. Appl. No. 12/578,310.
US Notice of Allowance dated Mar. 4, 2011 issued in U.S. Appl. No. 12/578,310.
US Office Action dated Oct. 5, 2012 issued in U.S. Appl. No. 13/110,759.
US Office Action dated Sep. 19, 2011 issued in U.S. Appl. No. 12/291,356.
US Final Office Action dated Feb. 27, 2012 issued in U.S. Appl. No. 12/291,356.
US Notice of Allowance dated Jul. 27, 2012 issued in U.S. Appl. No. 12/291,356.
US Office Action dated Jun. 24, 2011 issued in U.S. Appl. No. 12/481,503.
US Final Office Action dated Mar. 1, 2012 issued in U.S. Appl. No. 12/481,503.
US Office Action dated Jul. 9, 2012 issued in U.S. Appl. No. 12/481,503.
US Final Office Action dated Dec. 19, 2012 issued in U.S. Appl. No. 12/481,503.
US Office Action dated Jun. 24, 2011 issued in U.S. Appl. No. 12/606,030.
US Final Office Action dated Mar. 1, 2012 issued in U.S. Appl. No. 12/606,030.
US Office Action dated Jul. 13, 2012 issued in U.S. Appl. No. 12/606,030.
US Final Office Action dated Dec. 17, 2012 issued in U.S. Appl. No. 12/606,030.
US Notice of Allowance dated Aug. 10, 2011 issued in Design U.S. Appl. No. 29/377,521.
US Office Action dated Jun. 26, 2013 issued in U.S. Appl. No. 13/172,642.
US Final Office Action dated Jan. 15, 2014 issued in U.S. Appl. No. 13/172,642.
US Notice of Allowance dated Mar. 27, 2014 issued in U.S. Appl. No. 13/172,642.
PCT International Search Report and Written Opinion dated Jan. 12, 2011 issued in Application No. PCT/US2010/037520.
CN Office Action dated Jul. 19, 2011 issued in Application No. 201130081716.6.
TW Office Action dated Nov. 28, 2011 issued in Application No. 100301923.
KR Office Action dated Apr. 20, 2012 issued in Application No. 2011-0012881.
"Release of Sabre™ electrofill tool with HRVA by Novellus Systems, Inc." dated prior to the filed of the instant application (3 pages).
US Office Action dated Oct. 15, 2014 issued in U.S. Appl. No. 13/904,283.
CN First Office Action dated Jan. 20, 2015 issued in Application No. 201110192296.8.
US Notice of Allowance dated Jan. 12, 2016 issued in U.S. Appl. No. 14/308,258.
US Office Action dated Feb. 1, 2016 issued in U.S. Appl. No. 14/103,395.
US Notice of Allowance dated Feb. 1, 2016 issued in U.S. Appl. No. 13/904,283.
Chinese Third Office Action dated Jan. 15, 2016 issued in Application No. CN 201110192296.8.
Taiwan Office Action and Search Report dated Mar. 4, 2016 issued in Application No. TW 104127539.
Austrian Office Action dated Aug. 14, 2014 issued in A50817/2013.
Austrian Search Report dated Dec. 5, 2014 issued in A50817/2013.
Chinese First Office Action dated Nov. 26, 2015 issued in CN 201310683415.9.
Chinese Fourth Office Action dated May 5, 2016 issued in Application No. CN 201110192296.8.
US Office Action dated May 18, 2016 issued in U.S. Appl. No. 13/893,242.
U.S. Appl. No. 15/161,081, filed May 20, 2016, entitled Dynamic Modulation of Cross Flow Manifold During Electroplating, Graham et al.
"Release of Sabre™ electrofill tool with HRVA by Novellus Systems, Inc." dated prior to (3 pages), Jun. 2011.
*Electrochemical Methods: Fundamentals and Applications*, Bard & Faulkner eds. Chapter 8, Dec. 2000, pp. 280-292.
Fang et al. (2004) "Uniform Copper Electroplating on Resistive Substrates," Abs. 167, 205th Meeting, The Electrochemical Society, Inc., 1 page.
Lowenheim, (1978) "Electroplating," *Sponsored by the American Electroplaters' Society*, McGraw-Hill Book Company, New York, p. 139.
Malmstadt et al. (1994) "Microcomputers and Electronic Instrumentation: Making the Right Connections," American Chemical Society, p. 255.
Schwartz, Daniel T. et al., (1987) "Mass-Transfer Studies in a Plating Cell with a Reciprocating Paddle," *Journal of the Electrochemical Society*, 134(7):1639-1645.
Wilson, Gregory J. et al., (2005) "Unsteady Numerical Simulation of the Mass Transfer within a Reciprocating Paddle Electroplating Cell," *Journal of The Electrochemical Society*, 152(6):C356-C365.

* cited by examiner

CONTROL OF ELECTROLYTE HYDRODYNAMICS FOR EFFICIENT MASS TRANSFER DURING ELECTROPLATING

CROSS-REFERENCE TO RELATED APPLICATIONS

This application is a division of U.S. patent application Ser. No. 13/172,642, filed Jun. 29, 2011 (issued as U.S. Pat. No. 8,795,480 on Aug. 5, 2014), which claims benefit under 35 U.S.C. §119(e) of U.S. Provisional Patent Application No. 61/361,333, filed Jul. 2, 2010, U.S. Provisional Patent Application No. 61/374,911, filed Aug. 18, 2010, and U.S. Provisional Patent Application No. 61/405,608, filed Oct. 21, 2010, each of which is incorporated herein by reference in its entirety.

FIELD

The invention relates to methods and apparatus for controlling electrolyte hydrodynamics during electroplating. More particularly, methods and apparatus described herein are particularly useful for plating metals onto semiconductor wafer substrates.

BACKGROUND

Electrochemical deposition processes are well-established in modern integrated circuit fabrication. The movement from aluminum to copper metal lines in the early years of the twenty-first century drove a need for increasingly more sophisticated electrodeposition processes and plating tools. Much of the sophistication evolved in response to the need for ever smaller current carrying lines in device metallization layers. These copper lines are formed by electroplating the metal into very thin, high-aspect ratio trenches and vias in a methodology commonly referred to as "damascene" processing.

Electrochemical deposition is now poised to fill a commercial need for sophisticated packaging and multichip interconnection technologies known generally as wafer level packaging (WLP) and through silicon via (TSV) electrical connection technology. These technologies present their own very significant challenges.

The technologies require electroplating on a significantly larger size scale than damascene applications. Depending on the type and application of the packaging features (e.g. through chip connecting TSV, interconnection redistribution wiring, or chip to board or chip bonding, such as flip-chip pillars), plated features are usually, in current technology, greater than about 2 micrometers and typically 5-100 micrometers (for example, pillars may be about 50 micrometers). For some on-chip structures such as power busses, the feature to be plated may be larger than 100 micrometers. The aspect ratios of the WLP features are typically about 1:1 (height to width) or lower, while TSV structures can have very high aspect ratios (e.g., in the neighborhood of about 20:1).

Given the relatively large amount of material to be deposited, not only feature size, but also plating speed differentiates WLP and TSV applications from damascene applications. For many WLP applications, plating must fill features at a rate of at least about 2 micrometers/minute, and typically at least about 4 micrometers/minute, and for some applications at least about 7 micrometers/minute. At these higher plating rage regimes, efficient mass transfer of metal ions in the electrolyte to the plating surface is important.

Higher plating rates present challenges with respect to uniformity of the electrodeposited layer, that is, plating must be conducted in a highly uniform manner. For various WLP applications, plating must exhibit at most about 5% half range variation radially along the wafer surface (referred to as a within wafer non-uniformity, measured as a single feature type in a die at multiple locations across the wafer's diameter). A similar equally challenging requirement is the uniform deposition (thickness and shape) of various features of either different sizes (e.g. feature diameters) or feature density (e.g. an isolated or imbedded feature in the middle of an array). This performance specification is generally referred to as the within die non-uniformity. Within die non-uniformity is measured as the local variability (e.g. <5% half range) of the various features types as described above versus the average feature height or shape within a given wafer die at that particular die location on the wafer (e.g. at the mid radius, center or edge).

A final challenging requirement is the general control of the within feature shape. A line or pillar can be sloped in either a convex, flat or concave fashion, with a flat profile generally, though not always, preferred. While meeting these challenges, WLP applications must compete with conventional, inexpensive pick and place routing operations. Still further, electrochemical deposition for WLP applications may involve plating various non-copper metals such as lead, tin, silver, nickel, gold, and various alloys of these, some of which include copper.

SUMMARY

Described herein are apparatus and methods for electroplating one or more metals onto a substrate. Embodiments are described generally where the substrate is a semiconductor wafer; however the invention is not so limited. Embodiments include electroplating apparatus configured for, and methods including, control of electrolyte hydrodynamics for efficient mass transfer during plating so that highly uniform plating layers are obtained. In specific embodiments, the mass transfer is achieved using a combination of impinging flow and shear flow at the wafer surface.

One embodiment is an electroplating apparatus including: (a) a plating chamber configured to contain an electrolyte and an anode while electroplating metal onto a substantially planar substrate; (b) a substrate holder configured to hold the substantially planar substrate such that a plating face of the substrate is separated from the anode during electroplating; (c) a flow shaping element including a substrate-facing surface that is substantially parallel to and separated from a plating face of the substrate during electroplating, the flow shaping element including an ionically resistive material with a plurality of non-communicating channels made through the flow shaping element, where the non-communicating channels allow for transport of the electrolyte through the flow shaping element during electroplating; and (d) a flow diverter on the substrate-facing surface of the flow shaping element, the flow diverter including a wall structure partially following the circumference of the flow shaping element, and having one or more gaps, and defining a partial or "pseudo" chamber between the flow shaping element and the substantially planar substrate during electroplating.

In one embodiment, the flow shaping element is disk-shaped and the flow diverter includes a slotted annular spacer attached to, or integrated onto, the flow shaping element. In one embodiment, the wall structure of the flow diverter has a single gap and the single gap occupies an arc of between about 40 degrees and about 90 degrees. The wall structure of the flow diverter may be between about 1 mm and about 5 mm high. In certain embodiments, the flow diverter is configured such that a top surface of the wall structure is between about 0.1 and 0.5 mm from a bottom surface of the substrate holder during electroplating and the top surface of the flow shaping element is between about 1 and 5 mm from the bottom surface of the substrate holder during electroplating. The number and configuration of the through holes in the flow shaping element are discussed in more detail below. The holes may be in uniform and/or non-uniform patterns on the flow shaping element. In certain embodiments, a flow shaping element is termed a "flow shaping plate."

In certain embodiments, the apparatus is configured to flow electrolyte in the direction of the substrate plating face and under conditions that produce an average flow velocity of at least about 10 cm/s exiting the holes of the flow shaping element during electroplating. In certain embodiments, the apparatus is configured to operate under conditions that produce a transverse electrolyte velocity of about 3 cm/sec or greater across the center point of the plating face of the substrate.

In certain embodiments, the wall structure has an outer portion that is higher than an inner portion. Embodiments include features that restrict the flow of electrolyte out of the pseudo chamber except for the one or more gaps which form a vent region in the pseudo chamber.

One embodiment is an apparatus for electroplating metal onto a substrate, the apparatus including: (a) a plating chamber configured to contain an electrolyte and an anode while electroplating metal onto the substrate; (b) a substrate holder configured to hold the substrate such that a plating face of the substrate is separated from the anode during electroplating, the substrate holder having one or more electrical power contacts arranged to contact an edge of the substrate and provide electrical current to the substrate during electroplating; (c) a flow shaping element shaped and configured to be positioned between the substrate and the anode during electroplating, the flow shaping element having a flat surface that is substantially parallel to and separated from the plating face of the substrate by a gap of about 10 millimeters or less during electroplating, and the flow shaping element also having a plurality of holes to permit flow of the electrolyte toward the plating face of the substrate; (d) a mechanism for rotating the substrate and/or the flow shaping element while flowing electrolyte in the electroplating cell in the direction of the substrate plating face; and (e) a mechanism for applying a shearing force to the electrolyte flowing at the plating face of the substrate; where the apparatus is configured for flowing electrolyte in the direction of the substrate plating face under conditions that produce an average flow velocity of at least about 10 cm/s exiting the holes of the flow shaping element during electroplating and for flowing electrolyte in a direction parallel to the plating face of the substrate at an electrolyte velocity of at least about 3 cm/sec across the center point of the plating face of the substrate. Various shearing force mechanisms are described in more detail below.

One embodiment is a method of electroplating on a substrate including features having a width and/or depth of at least about 2 micrometers, the method including: (a) providing the substrate to a plating chamber configured to contain an electrolyte and an anode while electroplating metal onto the substrate, where the plating chamber includes: (i) a substrate holder holding the substrate such that a plating face of the substrate is separated from the anode during electroplating, and (ii) a flow shaping element shaped and configured to be positioned between the substrate and the anode during electroplating, the flow shaping element having a flat surface that is substantially parallel to and separated from the plating face of the substrate by a gap of about 10 millimeters or less during electroplating, where the flow shaping element has a plurality of holes; (b) electroplating a metal onto the substrate plating surface while rotating the substrate and/or the flow shaping element and while flowing the electrolyte in the electroplating cell in the direction of the substrate plating face and under conditions that produce an average flow velocity of at least about 10 cm/s exiting the holes of the flow shaping element.

In one embodiment, the electrolyte flows across the plating face of the substrate at a center point of the substrate at a rate of about 3 cm/second or greater and shearing force is applied to the electrolyte flowing at the plating face of the substrate. In one embodiment, the metal is electroplated in the features at a rate of at least about 5 micrometers/minute. In one embodiment, the thickness of the metal electroplated on the plating surface of the substrate has a uniformity of about 10% or better when plated to a thickness of at least 1 micrometer.

Methods described herein are particularly useful for electroplating Damascene features, TSV features and wafer level packaging (WLP) features, such as a redistribution layer, a bump for connecting to an external wire and an under-bump metallization feature.

Particular aspects of embodiments described herein are included below.

DETAILED DESCRIPTION

A. General Apparatus Context

Figure 1A:
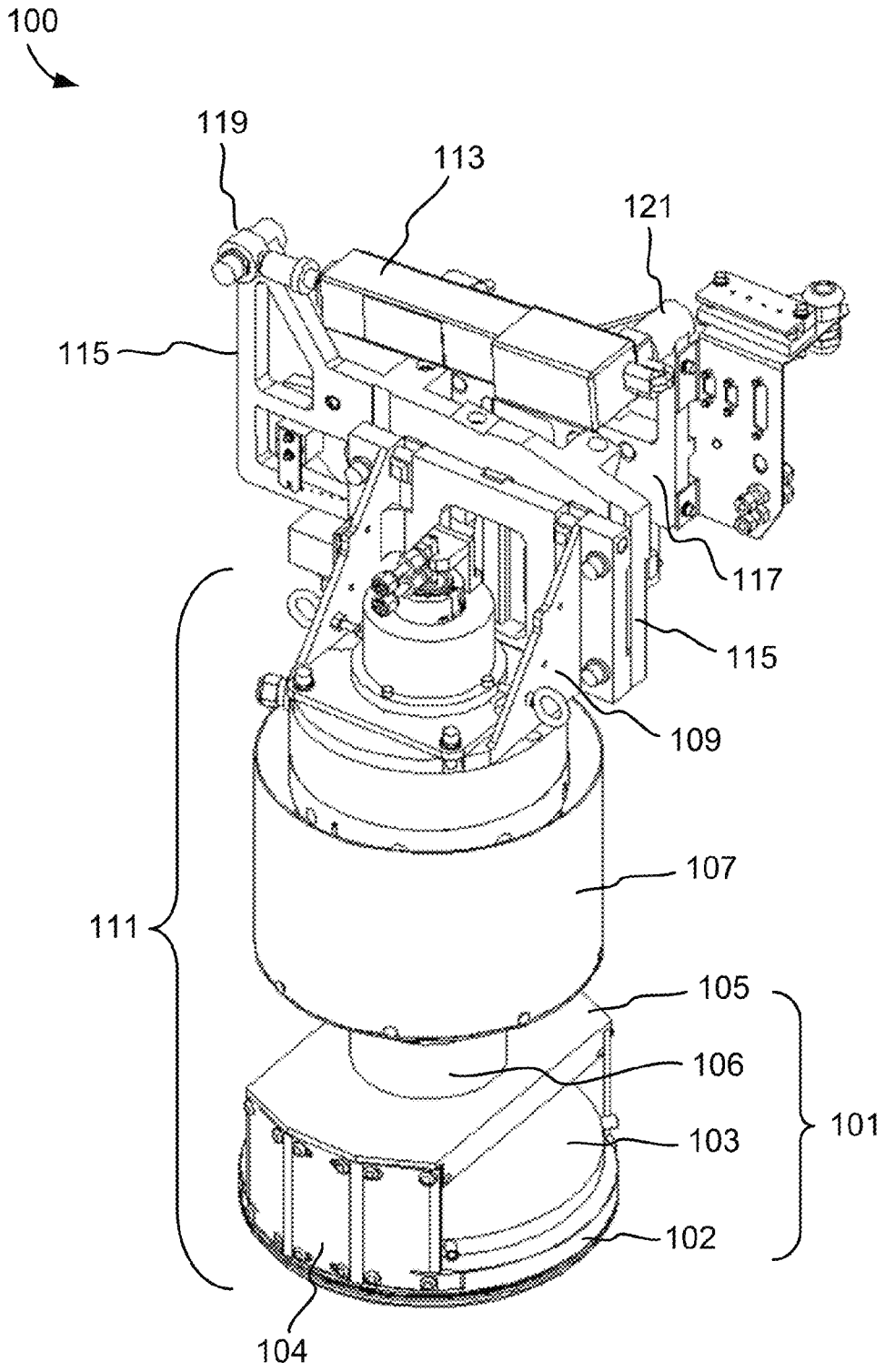
FIG. 1A is a perspective of a semiconductor wafer holder and positioning mechanism used for electroplating onto the wafer.
Figure 1B:
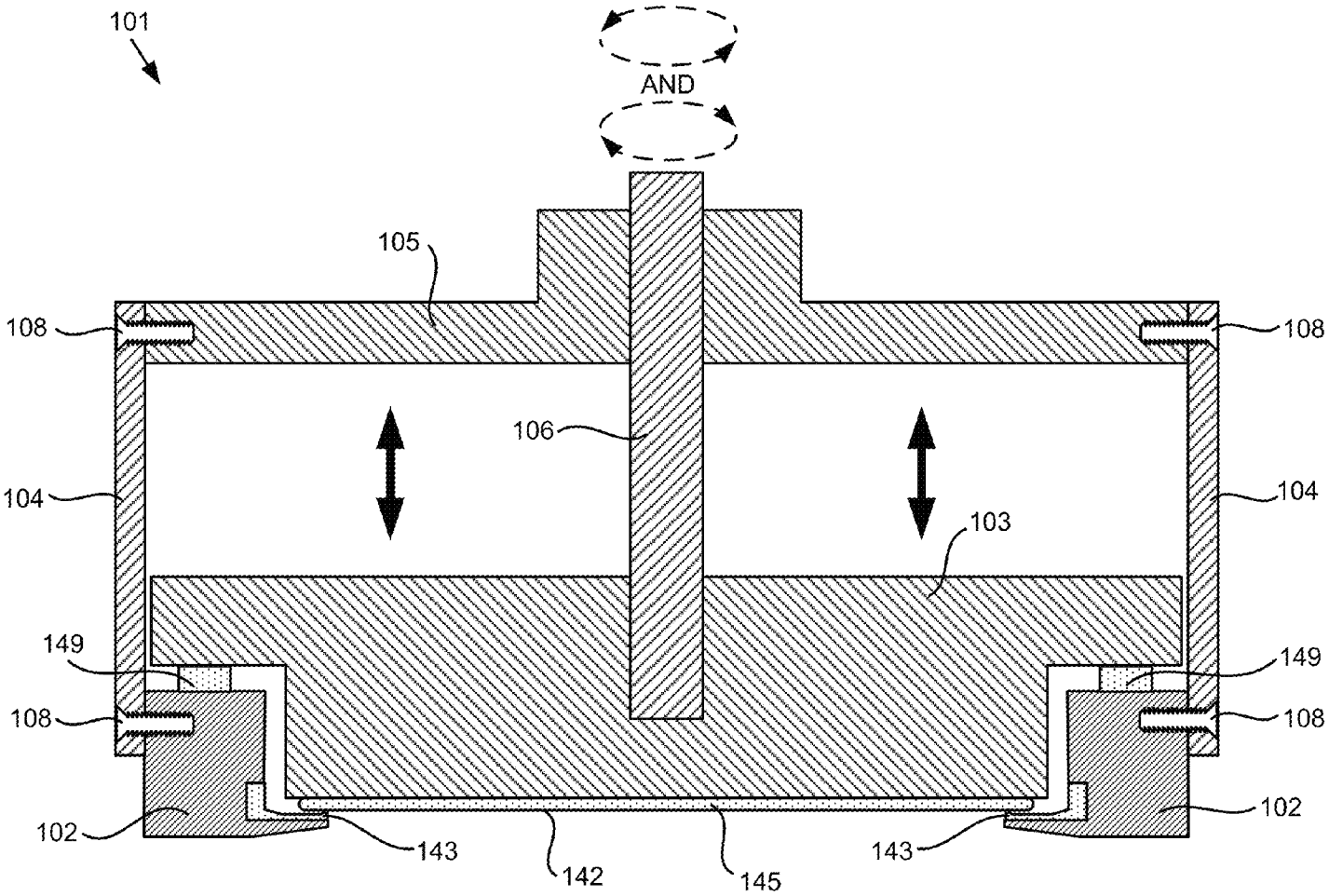
FIG. 1B is a cross-section of the wafer holder described in relation to FIG. 1A.

The following description of FIGS. 1A and 1B provides some general non-limiting context for the apparatus and methods described herein. Various features presented in the following discussion are also presented in one or more of the figures described above. The discussion of such features in the following is intended only to supplement description of embodiments included herein. Particular focus in later figures is toward a wafer holder assembly in relation to various flow shaping plates and flow diverters and thus an exemplary positioning mechanism, rotating mechanism and wafer holder is described.

FIG. 1A provides a perspective view of a wafer holding and positioning apparatus 100 for electrochemically treating semiconductor wafers. Apparatus 100 has various features shown and described in subsequent Figures. For example, it includes wafer engaging components (sometimes referred to herein as "clamshell" components). The actual clamshell includes a cup, 102, and a cone, 103 that clamps a wafer securely in the cup.

Cup 102 is supported by struts 104, which are connected to a top plate 105. This assembly (102-105), collectively assembly 101, is driven by a motor 107, via a spindle 106. Motor 107 is attached to a mounting bracket 109. Spindle 106 transmits torque to a wafer (not shown in this figure) to allow rotation during plating. An air cylinder (not shown) within spindle 106 also provides vertical force to clamp the wafer between the cup and cone 103. For the purposes of this discussion, the assembly including components 102-109 is collectively referred to as a wafer holder 111. Note however, that the concept of a "wafer holder" extends generally to various combinations and sub-combinations of components that engage a wafer and allow its movement and positioning.

A tilting assembly including a first plate, 115, that is slidably connected to a second plate, 117, is connected to mounting bracket 109. A drive cylinder 113 is connected both to plate 115 and plate 117 at pivot joints 119 and 121, respectively. Thus, drive cylinder 113 provides force for sliding plate 115 (and thus wafer holder 111) across plate 117. The distal end of wafer holder 111 (i.e. mounting bracket 109) is moved along an arced path (not shown) which defines the contact region between plates 115 and 117, and thus the proximal end of wafer holder 111 (i.e. cup and cone assembly) is tilted upon a virtual pivot. This allows for angled entry of a wafer into a plating bath.

The entire apparatus 100 is lifted vertically either up or down to immerse the proximal end of wafer holder 111 into a plating solution via another actuator (not shown). Thus, a two-component positioning mechanism provides both vertical movement along a trajectory perpendicular to an electrolyte and a tilting movement allowing deviation from a horizontal orientation (parallel to electrolyte surface) for the wafer (angled-wafer immersion capability). A more detailed description of the movement capabilities and associated hardware of apparatus 100 is described in U.S. Pat. No. 6,551,487 filed May 31, 2001 and issued Apr. 22, 2003, which is herein incorporated by reference in its entirety.

Note that apparatus 100 is typically used with a particular plating cell having a plating chamber which houses an anode (e.g., a copper anode) and electrolyte. The plating cell may also include plumbing or plumbing connections for circulating electrolyte through the plating cell—and against the work piece being plated. It may also include membranes or other separators designed to maintain different electrolyte chemistries in an anode compartment and a cathode compartment. In one embodiment, one membrane is employed to define an anode chamber, which contains electrolyte that is substantially free of suppressors, accelerators, or other organic plating additives.

The following description provides more detail of the cup and cone assembly of the clamshell. FIG. 1B depicts a portion, 101, of assembly 100, including cone 103 and cup 102 in cross-section format. Note that this figure is not meant to be an accurate depiction of the cup and cone assembly, but rather a stylized depiction for discussion purposes. Cup 102 is supported by top plate 105 via struts 104, which are attached via screws 108. Generally, cup 102 provides a support upon which wafer 145 rests. It includes an opening through which electrolyte from a plating cell can contact the wafer. Note that wafer 145 has a front side 142, which is where plating occurs. So, the periphery of wafer 145 rests on the cup. The cone 103 presses down on the back side of the wafer to hold it in place during plating.

To load a wafer into 101, cone 103 is lifted from its depicted position via spindle 106 until cone 103 touches top plate 105. From this position, a gap is created between the cup and the cone into which wafer 145 can be inserted, and thus loaded into the cup. Then cone 103 is lowered to engage the wafer against the periphery of cup 102 as depicted.

Spindle 106 transmits both vertical force for causing cone 103 to engage a wafer 145 and torque for rotating assembly 101. These transmitted forces are indicated by the arrows in FIG. 1B. Note that wafer plating typically occurs while the wafer is rotating (as indicated by the dashed arrows at the top of FIG. 1B).

Cup 102 has a compressible lip seal 143, which forms a fluid-tight seal when cone 103 engages wafer 145. The vertical force from the cone and wafer compresses lip seal 143 to form the fluid tight seal. The lip seal prevents electrolyte from contacting the backside of wafer 145 (where it could introduce contaminating atoms such copper directly into silicon) and from contacting sensitive components of apparatus 101. There may also be seals located between the interface of the cup and the wafer which form fluid-tight seals to further protect the backside of wafer 145 (not shown).

Cone 103 also includes a seal 149. As shown, seal 149 is located near the edge of cone 103 and an upper region of the cup when engaged. This also protects the backside of wafer 145 from any electrolyte that might enter the clamshell from above the cup. Seal 149 may be affixed to the cone or the cup, and may be a single seal or a multi-component seal.

Upon initiation of plating, wafer 145 is introduced to assembly 102 when cone 103 is raised above cup 102. When the wafer is initially introduced into cup 102—typically by a robot arm—its front side, 142, rests lightly on lip seal 143. During plating the assembly 101 rotates in order to aid in achieving uniform plating. In subsequent figures, assembly 101 is depicted in a more simplistic format and in relation to components for controlling the hydrodynamics of electrolyte at the wafer plating surface 142 during plating. Thus, an overview of mass transfer and fluid shear at the work piece follows.

B. Mass Transfer and Fluid Shear at the Work Piece Plating Surface

As indicated various WLP and TSV structures are relatively large and therefore require rapid, yet highly uniform, plating across the wafer surface. Although various methods and apparatus described hereinafter are suitable for these purposes, the invention is not limited in this way.

Certain embodiments described herein employ a rotating work piece, which in certain operating regimes approximates a classical rotating disk electrode. The rotation of the electrode results in flow of electrolyte upwards towards the wafer. The flow at the surface of the wafer may be laminar (as generally employed in a classical rotating disk electrode) or turbulent. As mentioned, electroplating cells employing horizontally oriented rotating wafers are conventionally employed in electroplating apparatus such as the Sabre® line of plating systems available from Novellus Systems, Inc. of San Jose, Calif.

Figure 1C:
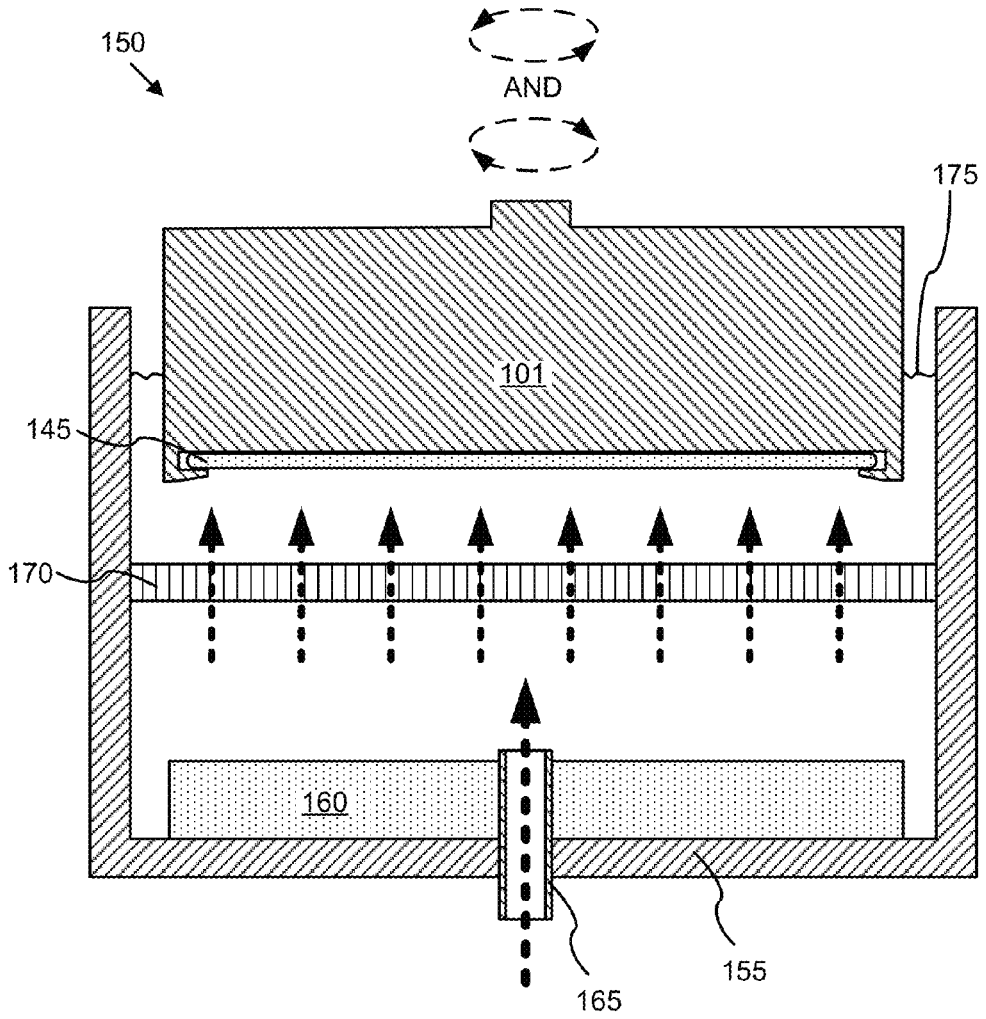
FIG. 1C is a cross-section of a wafer plating apparatus showing aspects of a flow shaping plate having multiple through holes for electrolyte flow.

In various embodiments, a flat flow shaping plate, having multiple through holes in a generally vertical orientation, is deployed within the electroplating apparatus a short distance from the plating surface, e.g., the flat surface of the flow shaping plate is about 1-10 mm from the plating surface. Examples of electroplating apparatus containing flow shaping elements are described in U.S. patent application Ser. No. 12/291,356, filed Nov. 7, 2008, which is incorporated herein by reference in its entirety. As depicted in FIG. 1C, plating apparatus 150 includes a plating cell, 155, which houses anode 160. In this example, electrolyte 175 is flowed into cell 155 through anode 160 and the electrolyte passes through a flow shaping element 170 having vertically oriented (non-intersecting) through holes through which electrolyte flows and then impinges on wafer 145 which is held in, positioned and moved by, wafer holder 101. Flow shaping elements such as 170 provide uniform impinging flow upon the wafer plating surface; however, it has been found (and as described in more detail below) that when plating in WLP and TSV plating rate regimes, where larger features are being filled at higher plating rates (for example relative to plating rates for certain Damascene processing), lower plating rates are observed in the central region of the wafer as compared to the outer regions. This result is typified in FIG. 1D which shows plating uniformity as a function of deposition rate vs. radial position on a 300 mm wafer. In accordance with certain embodiments described herein, apparatus utilizing such flow shaping elements are configured and/or operated in a manner that facilitates high rate and very uniform plating across the face of wafer including plating under high rate deposition regimes such as for WLP and TSV applications. Any or all of the various embodiments described can be implemented in the context of Damascene as well as TSV and WLP applications.

Assuming the rotating work piece is horizontally oriented, at a plane some distance below the wafer surface the bulk electrolyte flow is primarily in the vertical direction. When it approaches and contacts the wafer surface, the presence of the wafer (and its rotation) redirects and forces the fluid to flow outward toward the wafer periphery. This flow is normally laminar. In the ideal case, the current density at the electrode surface is described by the Levich equation, which indicates that the limiting current density is proportional to the square root of electrode's angular velocity. This limiting current density is uniform over the radial extent of the rotating electrode, primarily because the boundary layer thickness is of constant thickness and is independent of both the radial or azimuthal location.

In various embodiments, the apparatus provides very high rate vertical flow rates through the pores in a flow shaping plate. In various embodiments, those pores are holes in the flow shaping plate that are all independent (i.e., non-interconnecting—there is no fluidic communication between individual holes) and are oriented in a primarily vertical orientation to direct flow upwards at the wafer surface a short distance above the pore exit. Typically, there are many such pores in the flow shaping plate, often at least about 1000 such pores or at least about 5000 such pores. Electrolyte flowing out of these holes may produce a set of individual "microjets" of high velocity fluid that directly impinge on the wafer surface. In some cases, the flow at the work piece plating surface is not laminar, i.e., the local flow is turbulent or transitional between turbulent and laminar. In some cases, the local flow at the hydrodynamic boundary layer of the wafer surface is defined by a Reynolds number of about $10^5$ or greater at the wafer surface. In other cases, the flow at the work piece plating surface is laminar and/or characterized by a Reynolds number of about 2300 or lower. In accordance with specific embodiments described herein, the flow rate of fluid emanating from an individual hole or pore in the flow plate in the vertical direction, to the wafer surface (and through the through holes in the flow shaping plate), is on the order of about 10 cm/second or greater, more typically about 15 cm/second or greater. In some cases, it is about 20 cm/second or greater.

Additionally, the electroplating apparatus may be operated in a manner so that local shearing of the electrolyte between the flow shaping plate and the electrode occurs. Shearing of the fluid, particularly the combination of impinging and shearing flow may maximize convection within the reactor for features whose sizes are on the length scale of the typical boundary layer thickness. In many embodiments, this length scale is on the order of micrometers or even 10s of micrometers. Flow shearing can be established in at least two manners. In the first case, it is accomplished by the relative proximity of a generally stationary flow shaping plate to a high speed relative-moving wafer surface located a few millimeters away. This arrangement establishes relative motion, and consequently shearing flow, by linear, rotational and/or orbital motion. Taking a non-moving flow shaping plate as a point of reference, the fluid local shear will be given by the local point on the wafer's velocity divided by the plate-to-wafer gap (units (cm/sec)/(cm)=$sec^{-1}$), while the required shear stress to keep the wafer moving is simply this value times fluid's viscosity. Generally (for a Newtonian fluid) in this first mode of shearing, the velocity profile generally increases linearly between the two planar surfaces. A second approach to establishing local shearing involves introducing conditions within the flow plate/wafer gap that create or induce lateral fluid motion in the gap between the two flat surfaces (either in the absence of or in additional to any relative motion of the plate). A pressure difference and or entrance and exit port for fluid into and out of the gap moves fluid substantially parallel to the two surfaces, including across the center of rotation of the wafer. Assuming a stationary wafer, the maximum velocity associated with imposed flow is observed in the middle of the flow-plate/wafer gap, and the local shear is proportional to the local fluid flow density or average velocity ($cm^3$/sec/cm or cm/sec) divided by the wafer-to-flow-plate gap, with a maximum velocity at the center of the gap. While the first mode of shearing of a classical rotating disk/wafer does not create any shearing of fluid at the wafer center, the second mode, which may be implemented in various embodiments, does create fluid shearing at the wafer center. Therefore, in certain embodiments, the electroplating apparatus is operated under conditions that produce a transverse relative electrolyte velocity of about 3 cm/sec or greater (or about 5 cm/sec or greater) within a few mm from the wafer surface across the center point of the plating face of the substrate.

When operating at such high vertical flow rates through a flow shaping plate, high plating rates can be attained, typically on the order of about 5 micrometers/minutes or higher, particularly in feature being formed in a through resist layer of photoresist with a 1:1 aspect ratio 50 um deep. Further, while not wishing to be held to any particularly principle or theory, when operating under shearing conditions as described herein, advantageous convective patterns and associated enhanced transport of material within the recessed fluid-containing-portion of the structure being plated enhances both the deposition rate and uniformity, leading to very uniform shaped features both within individual dies and over the entire face of the plating work piece, frequently varying by no more than about 5% over the plating surface. Regardless of the mechanism of action, the recited operation leads to remarkably uniform and rapid plating.

As mentioned above, it is interesting to note that in the absence of an appropriate combination of both a flow impinging and shearing condition created by apparatus herein, such as high vertical impinging flow rates on the work piece surface, or flow shearing alone, will not easily yield highly uniform plating both within and over the wafer surface of large, WLP size features.

Consider first the situation of plating a substantially flat surface. Here, the term substantially flat means a surface whose feature or roughness are less than the calculated or measured mass transfer boundary layer thickness (generally a few tens of micrometers). Any surface having recessed features smaller than about 5 micrometers, such as 1 micrometer or less, such as typically used in copper damascene plating, are therefore substantially flat for this purpose. When using classical convection, an example being a rotating disk or fountain plating system, the plating is theoretically and practically very uniform across the work piece face. Because the depths of features are small compared to the mass transfer boundary thickness, the internal feature mass transfer resistance (associated with diffusion inside the feature) is small. Importantly, shearing the fluid, for example, by using a flow shearing plate, theoretically will not alter the mass transport to a flat surface, because the shearing velocities and associated convection are all in the direction normal to the surface. To aid mass transfer to the surface, convection must have a component of velocity toward the surface. In contrast, a high velocity fluid moving in the direction of the surface, such as that resulting from fluid passing through an anisotropic porous plated (e.g., a flow shaping plate as described herein), can create a large impinging flow with a component of velocity towards the surface, and therefore substantially decrease the mass transport boundary layer. Therefore, again for a substantially flat surface, impinging flow will improve transport, but shearing (as long as turbulence is not created) will not improve transport. In the presence of turbulence (chaotic motion of fluid), such as that created in the gap between the wafer and a shearing plate in close proximity to a rotating work piece, one can considerably reduce the mass transfer resistance and enhance uniform convective condition, creating condition for very thin boundary layer thicknesses, because some of the chaotic motion is directing fluid to the surface. The flow to the substantially flat surface may or may not be turbulent over the entire radial extent of the work piece, but can generally results in very uniform within feature and within wafer deposition.

It is important to understand the limitation of the concept of a boundary layer thickness, a highly simplified, conceptual region of space that lumps mass transfer resistance into an equivalent surface film. It is functionally limited to representing the distance over which reactants' concentration change as they diffuse to a generally flat surface, loosing some significance when applied to "rougher" surfaces. It is true that thin boundary layers are generally associated with high rates of transport. But it is also true that some conditions that do not lead to improved convection to a flat surface, can improve convection to a rough one. It is believed that for WLP scale "rough" surface, there is an added, hitherto unappreciated, characteristic of fluid shearing that can be used, in combination with impinging flow, to enhance convection to such rougher surface, such as patterned surfaces with features larger than the mass transfer boundary layer thickness. The perceived reason for this difference between substantially flat and substantially rough surface behavior is associated with an enhanced material replenishment that can be created to stir the matter held in the cavity as it passes over the mouth of the feature, mixing and transporting of fluid to and away from the relatively large recessed features. The creation of the intra-feature circulation condition is instrumental in achieving very high rate, global and microscopically uniform deposition in WLP type structures.

With large and relatively deep (1:0.5 width to depth or greater aspect ratio) features, using impinging flow alone may be only partially effective, because impinging fluid must diverge radially outwards from the feature cavity opening as it approaches the open pore. Fluid contained within the cavity is not effectively stirred or moved and may remain essentially stagnant, leaving transport with the feature to be primarily by diffusion alone. Therefore, it is believed that when plating WLP scale features under operating conditions of either primarily impinging or shearing flow alone, convection is inferior to that using the combination of the two. And the mass transfer boundary layer that is associated with an equivalent convection conditions to a flat surface (flat on the order of the boundary layer) will naturally be generally uniform, but in the situation encountered in WLP scale feature plating, the boundary layer thickness, generally comparable to the size of the features being plating and on the order of a few tens of micrometers, requires, for uniform plating, conditions which are quite different.

Finally, a combination and crossing a laminar impinging flow with a laminar shearing flow is believed to be able to create micro-flow vortices. These micro-vortices, which alone may be laminar in nature, can potentially become turbulent in nature, and in line with the discussion above, be useful in enhancing convection to both flat and rough surface plating. It should be appreciated that the above explanation is submitted only to aid in understanding the physical underpinnings of mass transfer and convection in wafers having WLP or WLP-like features. It is not a limiting explanation of the mechanisms of action or necessary plating conditions for the beneficial methods and apparatus described herein.

Figure 1D:
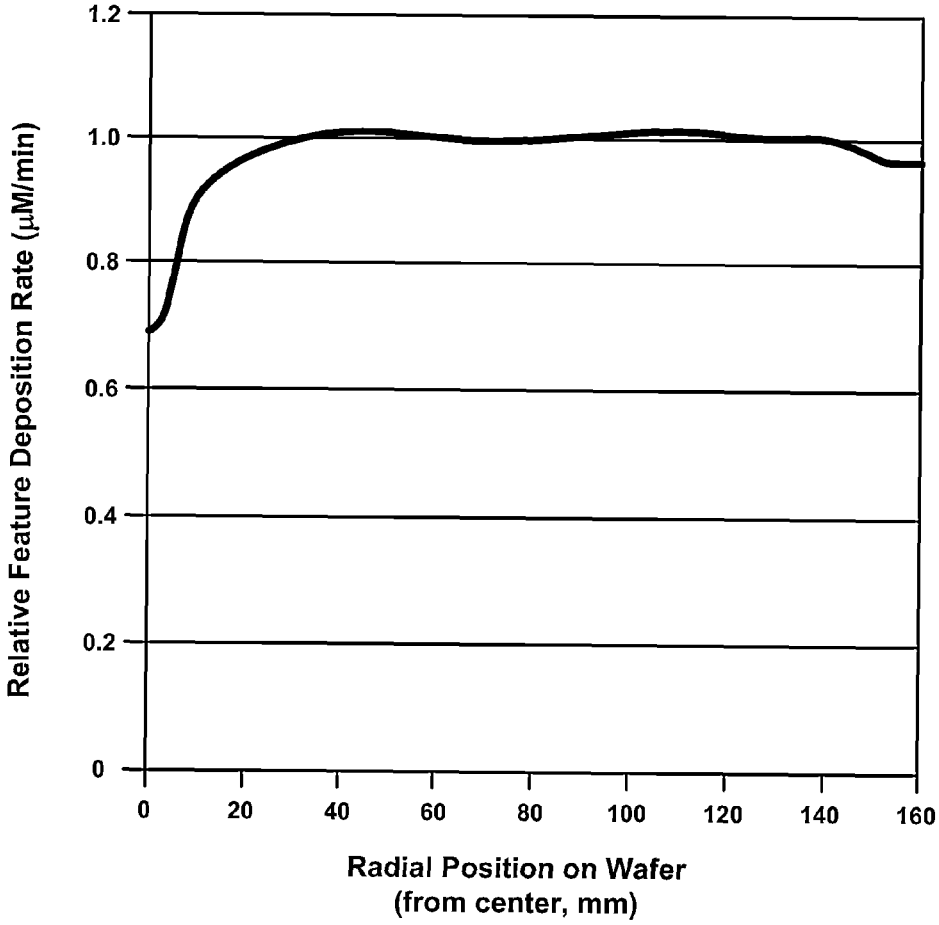
FIG. 1D is a graph showing a reduced deposition rate near the center of a wafer as compared to outer regions when using the flow shaping plate as described in relation to FIG. 1C at high deposition rate plating regimes.

It has been observed by the inventors that when rotating a patterned substrates—particularly those having features of similar size to the mass transfer boundary layer (e.g., recesses or protrusions on the order of micrometers or tens of micrometers such as commonly encountered on TSV and WLP substrates)—can produce a "singularity" or plating aberration at the center of the rotating substrate (see FIG. 1D). This plating non-uniformity occurs at the axis of rotation of the flat plating surface where the angular velocity is at or near zero. It has also been observed in some of the apparatus employing a flow shaping plate as described above, in the absence of some other center-aberration-mediating mechanisms. In such cases without these mechanisms, the plating rate is remarkably uniform and rapid with generally flat features across the patterned work piece surface everywhere, except at the center of the work piece, where the rate is significantly lower and the feature shapes are generally non-uniform (for example concave near the center). This is particularly interesting, given that plating under similar conditions on an unpatterned substrate produces an entirely uniform plating profile or sometimes even an inverse plating profile (i.e., the plating rate is remarkably uniform across the work piece surface everywhere except at the center where it is significantly higher, resulting a domed center region). In other tests, where the total impinging flow volume, and/or velocity is increased at the center, it is found that the rate of deposition can be increased there, but the general shape of the feature at the center remain largely unchanged (domed and irregular rather than flat).

This center non-uniformity may be mitigated or eliminated by providing a lateral moving fluid that will create a shearing force at the substrate center to the electrolyte flowing across the plating face of the substrate. This shearing force may be applied by any of a number of mechanisms, some of which will be described herein. Briefly, the mechanisms include (1) a flow shaping plate having variation from uniformity in number, orientation and distribution of holes at or near the center of the rotating substrate, such as a flow shaping plate in which at least some of the holes proximate to the center of the rotating work piece have an angle deviating from vertical (more generally, an angle that is not perpendicular to the plating face of the rotating substrate), (2) a lateral component of relative motion between the work piece surface and the flow shaping plate (e.g., a relative linear or orbital motion such as is sometimes applied in chemical mechanical polishing apparatus), (3) one or more reciprocating or rotating paddles (e.g., a paddlewheel or impeller) provided in the plating cell, (4) a rotating assembly attached to or proximate to the flow shaping plate and offset from the axis of rotation of the work piece, (5) an azimuthally non-uniform flow restrictor (sometimes termed a "flow diverter") attached to or proximate the circumference of the flow shaping plate and extending toward the rotating work piece, and (6) other mechanisms of introducing lateral flow across the general wafer surface including the center.

Each of these mechanisms will be described and exemplified in more detail below. Regarding the first listed mechanism, the non-uniformity in distribution of plate holes may be (a) an increased density of holes in the center region of the plate and/or (b) a randomness in the distribution of holes in the center region. Regarding, the fifth of the listed mechanisms, the flow diverter effectively provides a nearly closed chamber between the rotating substrate and the flow shaping plate. In some cases, as more fully described below, the flow diverter and associated hardware provides or enables creation of a very small gap (e.g., about 0.1 to 0.5 mm) over the majority of the region between a substrate holder periphery and the top of the edge element. In the remaining periphery region, there is a gap in the edge element that provides a larger gap with a relatively low resistance path for electrolyte to flow out of the nearly closed chamber. See e.g., FIGS. 2A-C.

C. Design and Operating Parameters

Various relevant parameters will be discussed in this section. These parameters are often interrelated. Nevertheless, they will be described separately to provide examples of a general operating space and a general apparatus design space. Those of skill in the art will fully appreciate that appropriate combinations of these parameters can be chosen, when considering the teachings of this disclosure, to effect particular results such as desired plating rates or uniform deposition profiles. Additionally, some of the parameters presented herein may scale with the size of the substrate and features being plated and/or the electroplating cell in which they apply. Unless otherwise specified, the recited parameters are appropriate for plating 300 mm wafers using an electroplating cell having an electrolyte chamber volume, below the flow shaping plate of greater than about 1 liter.

Electrolyte Flow Rate Exiting the Holes of Flow Shaping Plate and Impinging on Wafer As indicated, the flow rate through holes in the flow shaping plate may be relevant to the operation of the plating cell. Typically, it is desired to have a high rate of impinging flow passing through the flow shaping plate. In certain embodiments, this exiting flow rate from individual holes in the plate is at least about 10 cm/second and often as great as about 15 cm/second or even about 20 cm/second or greater. The distance from the plate hole and the wafer surface is generally less than 5 mm, thereby minimizing any potential dissipation of the above stated fluid velocity before striking the wafer surface. Essentially, each of the apertures of each through hole provides a microjet of impinging flow.

In flow shaping plates having relatively small openings (e.g., on the order of 0.03 inches in diameter or less), viscous wall forces typically dominate inertial hydrodynamic forces inside the openings. In such cases, the Reynolds number will be well below the turbulent value threshold (>2000) for flow in a pipe. Thus, the flow inside the holes themselves typically will be laminar. Nevertheless, the flow hits the plating surface hard and directly (e.g., at a right angle), after traveling at, e.g., 10-20 cm/sec. It is believed that this impinging flow is at least partially responsible for the observed beneficial results. For example, measurements of the limiting current plating rates of copper to a flat wafer were used to determine the boundary layer thickness with and without the use of high velocity impinging fluid microjets. The flow shaping plate was a ½ in thick plate with 6500 drilled 0.026 inch holes, evenly arranged over about a 300 mm diameter region. Despite the fact that the holes' area occupy only about 3% of the total area below the wafer plating surface, and the rotating wafer is directly above a hole for an equally small fraction of time, the limiting current was found to increase as much as 100% percent when changing the hole flow velocity from 3 cm/sec to 18.2 cm/sec while the rotation of the wafer remained at 30 RPM.

Volumetric Flow Rate through Flow Shaping Plate

The overall volumetric flow passing through the flow shaping plate is directly tied to the linear flow rate from the individual holes in the plate. For a typical flow shaping plate as described herein (e.g., one of about 300 mm diameter having a large number of equal diameter) a volumetric flow through the plate holes may be greater than about 5 liters/minute, or greater than about 10 liter/minute, or sometime as great as 40 liters/minute or higher. As an example, a volumetric flow rate of 24 liters/minute produces a linear flow velocity at the exit of each hole of a typical plate of about 18.2 cm/sec.

Flow Rate Laterally Across Center Axis of Rotation of Substrate Work Surface The flow immediately parallel to the surface of the rotating substrate should generally be non-zero at the axis of rotation for the substrate. This parallel flow is measured just outside the hydrodynamic boundary layer on the substrate surface. In some embodiments, the flow across the substrate center is greater than about 3 cm/sec, or more specifically greater than about 5 cm/sec. It is believed that such flows mitigate or eliminate the observed decrease in plating rate at the rotation axis of patterned wafers.

Pressure Drop of Electrolyte Flowing through Flow Shaping Plate

In certain embodiments, the pressure drop of electrolyte flowing through the holes of the flow shaping element is modest, e.g., about 0.5 to 3 torr (0.03 psi or 1.5 torr in a specific embodiment). In some designs such as those employing a flow diverter structure described with respect to, for example, FIGS. 2A-I, the pressure drop across the plate should be significantly larger than the pressure drop to the open gap in the shield or edge element to ensure that the impinging flow on the substrate surface is at least relatively uniform across the substrate surface.

Distance Between Wafer and Flow Shaping Plate

In certain embodiments, a wafer holder and associated positioning mechanism hold a rotating wafer very close to the parallel upper surface of the flow shaping element. In typical cases, the separation distance is about 1-10 millimeters, or about 2-8 millimeters. This small plate to wafer distance can create a plating pattern on the wafer associated with proximity "imaging" of individual holes of the pattern, particularly near the center of wafer rotation. To avoid this phenomenon, in some embodiments, the individual holes (particularly at and near the wafer center) should be constructed to have a small size, for example less than about $1/5^{th}$ the plate to wafer gap. When coupled with wafer rotation, the small pore size allows for time averaging of the flow velocity of impinging fluid coming up as a jet from the plate and reduces or avoids small scale non-uniformities (e.g., those on the order of micrometers). Despite the above precaution, and depending on the properties of the plating bath used (e.g. particular metal deposited, conductivities, and bath additives employed), in some cases deposition may be prone to occur in a micro-non-uniform pattern as the time average exposure and proximity-imaging-pattern of varying thickness (for example, in the shape of a "bulls eye" around the wafer center) and corresponding to the individual hole pattern used. This can occur if the finite hole pattern creates an impinging flow pattern that is non-uniform and influences the deposition. In this case, introducing lateral flow across the wafer center has been found to largely eliminate any micro-non-uniformities otherwise found there.

Porosity of Flow Shaping Plate

In various embodiments, the flow shaping plate has a sufficiently low porosity and pore size to provide a viscous backpressure and high vertical impinging flow rates at normal operating volumetric flow rate. In some cases, about 1-10% of the flow shaping plate is open area allowing fluid to reach the wafer surface. In particular embodiments, about 2-5% the plate is open area. In a specific example, the open area of the plate is about 3.2% and the effective total open cross sectional area is about 23 $cm^2$.

Hole Size of Flow Shaping Plate

The porosity of the flow shaping plate can be implemented in many different ways. In various embodiments, it is implemented with many vertical holes of small diameter. In some cases the plate does not consist of individual "drilled" holes, but is created by a sintered plate of continuously porous material. Examples of such sintered plates are described in U.S. Pat. No. 6,964,792, which is herein incorporated by reference in its entirety. In some embodiments, drilled non-communicating holes have a diameter of about 0.01 to 0.05 inches. In some cases, the holes have a diameter or about 0.02 to 0.03 inches. As mentioned above, in various embodiments the holes have a diameter that is at most about 0.2 times the gap distance between the flow shaping plate and the wafer. The holes are generally circular in cross section, but need not be. Further, to ease construction, all holes in the plate may have the same diameter. However this need not be the case, and so both the individual size and local density of holes may vary over the plate surface as specific requirements may dictate.

As an example, a solid plate made of a suitable ceramic or plastic (generally a dielectric insulating and mechanically robust material), having a large number of small holes provided therein, e.g. 6465 holes of 0.026 inches diameter has been found useful. The porosity of the plate is typically less than about 5 percent so that the total flow rate necessary to create a high impinging velocity is not too great. Using smaller holes helps to create a large pressure drop across the plate than larger holes, aiding in creating a more uniform upward velocity through the plate.

Generally, the distribution of holes over the flow shaping plate is of uniform density and non-random. In some cases, however, the density of holes may vary, particularly in the radial direction. In a specific embodiment, as described more fully below, there is a greater density and/or diameter of holes in the region of the plate that directs flow toward the center of the rotating substrate. Further, in some embodiments, the holes directing electrolyte at or near the center of the rotating wafer may induce flow at a non-right angle with respect to the wafer surface. Further the holes in this region may have a random or partially random distribution non-uniform plating "rings" due to any interaction between the limited number of hole and the wafer rotation. In some embodiments, the hole density proximate an open segment of a flow diverter is lower than on regions of the flow shaping plate that are further from the open segment of the attached flow diverter.

Rotation Rate of Substrate

The wafer's rate of rotation can vary substantially. In the absence of impinging flow and a flow shaping plate a small distance below the wafer, rotation rates above 90 rpm should be avoided because of turbulence generally forming at the wafer's outer edge (and laminar flow remaining further in), resulting in radial non-uniform convection conditions. However, in most of the embodiment disclosed herein, such as those with imposed flow turbulence and/or with the impinging flow shaping plate, much larger ranges of rotation rates, for example from 20 to 200 rpm or more, can be used. Higher rotation rates greatly increase the shearing of most of the wafer surface with the exception of the wafer center. Nevertheless, high rotation rates also tend to amplify, focus or otherwise modify the relative scale of the center singularity/aberration, so it is believed that introducing lateral flow across the center is sometimes necessary to eliminate the same, particularly when operating at higher rotation rates.

Rotation Direction of Substrate

In some embodiments, the wafer direction is changed periodically during the electroplating process. One benefit of this approach is that in an array of features or a portion of an individual feature that previously was at the leading edge of the fluid flow (in the angular direction) can become the features at the trailing edges of the flow when the rotational direction reverses. Of course, the opposite is also true. This reversal in angular fluid flow tends to even out the deposition rate over the features on the face of the work piece. In certain embodiments, the rotation reversal takes place a number of times of approximately equal durations throughout the entire plating process so that convection versus feature depth convolutions are minimized. In some cases, the rotation is reversed at least about 4 times during the course of plating a wafer. For example, a series of oscillating 5 clockwise and 5 counterclockwise plating rotation steps can be used. Generally, changing the direction of rotation can moderate upstream/downstream non-uniformities in the azimuthal direction, but have limited impact on radial non-uniformities unless superimposed with other randomizing influences, such as impinging flow and wafer cross flow.

Electrodeposition Uniformity Over Substrate Surface—Surface to Edge

As indicated, it is generally desirable to plate all features to a uniform thickness over the plating face of a wafer. In certain embodiments, the plating rate and therefore the thickness of the plated features has a within wafer half range (WIW R/2%) non uniformity of 10% or less. The WIW-R/2 is defined as the total thickness range of a particular feature type (i.e. a chosen feature of a given size and having the same relative location with each die on the wafer) collected at multiple die across the wafer radius, divided by twice that feature's average thickness over the entire wafer. In some cases, the plating process has a WIW-R/2 uniformity of about 5% or better. Apparatus and methods described in this invention are capable of achieving or exceeding this level of uniformity at high rates of deposition (e.g., 5 micrometers/minute or higher).

Electrodeposition Rate

Many WLP, TSV and other applications require a very high rate of electrofill. In some cases, an electroplating process as described herein fills micron scale features at a rate of at least about 1 micrometers/minute. In some cases, it fills such features at a rate of at least about 5 micrometers/minute (sometimes at least about 10 micrometers/minute). Embodiments described herein create efficient mass transfer so that such higher plating rates can be used while maintaining high plating uniformity.

Additional Characteristics of Flow Shaping Plate

As indicated, the flow shaping plate can have many different configurations. In some embodiments, it provides the following general (qualitative) characteristics: 1) a no slip boundary residing close to the rotating work piece to produce local shearing force of the electrolyte at the work piece surface, 2) a significant ionic resistance which may provide a more uniform potential and current distribution over the work piece radius when electroplating onto relatively thin metallized or otherwise highly resistive surfaces, and 3) a large number of fluid microjets that deliver very high velocity fluid directly onto the wafer surface. The significant ionic resistance is important, because in both WLP and TSV plating, there can be little or no metal deposition on the wafer as a whole, the cross wafer resistance and resistance from the wafer periphery to its center may remain high throughout the entire process. Having a significant ionic resistance throughout the entire plating process allow a useful means of maintaining a uniform plating process and enables the use of thinner seed layers than would be otherwise possible. This addresses the "terminal effect" as described in U.S. patent application Ser. No. 12/291,356, previously incorporated by reference.

In many embodiments, the pores or holes of the flow shaping element are not interconnected, but rather are non-communicating, i.e., they are isolated from each other and do not form interconnecting channels with the body of flow shaping element. Such a hole may be referred to as a 1-D through-hole because it extends in one dimension, in one example, normal to the plating surface of the wafer. That is, the channels are oriented at an angle of about 90° with respect to the substrate-facing surface of the flow shaping element. In one embodiment, the channels of the flow shaping element are oriented at an angle of about 20° to about 60° with respect to the substrate-facing surface of the flow shaping element, in another embodiment, about 30° to about 50° with respect to the substrate-facing surface of the flow shaping element. In one embodiment, the flow shaping element includes through-channels oriented at different angles. The hole pattern on the flow shaping element can include uniform, non-uniform, symmetric and asymmetric elements, i.e. the density and pattern of holes may vary across the flow shaping element. In certain embodiments, the channels are arranged to avoid long range linear paths parallel to the substrate-facing surface that do not encounter one of the channels. In one embodiment, the channels are arranged to avoid long range linear paths of about 10 mm or greater that are parallel to the substrate-facing surface that do not encounter one of the channels.

The flow shaping element may be constructed of an ionically resistive material including at least one of polyethylene, polypropylene, polyvinylidene difluoride (PVDF), polytetrafluoroethylene, polysulphone, and polycarbonate. In one embodiment, the flow shaping element is between about 5 mm and about 10 mm thick.

In certain embodiments, the plurality of channels are substantially parallel to one another, in another embodiment, at least some of the plurality of channels are not parallel to one another. In certain embodiments, the flow shaping element is a disk having between about 6,000-12,000 holes. In one embodiment, the flow shaping element has a non-uniform density of holes, with a greater density of holes being present in a region of the flow shaping element that faces a rotational axis of the substrate plating face. In one embodiment, the plurality of holes in the flow shaping element do not form communicating channels within the flow shaping element and substantially all of the plurality of holes have a principal dimension or a diameter of the opening on the surface of the element facing the surface of the substrate of no greater than about 5 millimeters.

It should be noted, that a flow shaping plate employed with this invention may have certain characteristics that deviate from those recited in U.S. patent application Ser. No. 12/291,356, previously incorporated by reference. These include (1) a lower ionic resistance (such as a resistance significantly smaller than that of the seeded wafer), (2) a larger number of holes, and (3) a thinner construction (e.g. the plate could be about one-quarter inch or less in thickness).

With the above-described parameters in mind, apparatus and methods are described in more detail below in conjunction with the Figures.

D. Apparatus for Addressing Center Plating Non-Uniformity

While some aspects of the invention described herein may be employed in various types of plating apparatus, for simplicity and clarity, most of the examples will concern wafer-face-down "fountain" plating apparatus. In such apparatus, the work piece to plated (typically a semiconductor wafer in the examples presented herein) that generally has a substantially horizontal orientation (which may in some cases vary by a few degrees from true horizontal) and rotates during plating with generally vertically upward electrolyte convection. One example of a member of the fountain plating class of cells/apparatus is the Sabre® Electroplating System produced by and available from Novellus Systems, Inc. of San Jose, Calif. Additionally, fountain electroplating systems are described in, e.g., U.S. Pat. No. 6,800,187 and US Patent Application Publication US 2010-0032310A1 filed Feb. 11, 2010, which are incorporated herein by reference in their entireties.

As mentioned, it has been observed that on patterned wafers the electroplating rate at the center of the wafer and over a small radial region near it is relatively slower and the plating feature shape inferior compared to that at the remainder of the wafer, where the rate is substantially uniform. FIG. 1D depicts results from an electroplating run of copper onto a 300 mm wafer when a conventional fountain-type plating configuration is employed. These results were obtained for a wafer plated with copper and having 50 micrometer wide features defined in 50 micrometer thick photoresist plated at 3.5 micrometers/min. Plating was conducted while the wafer was rotating at 90 rpm, with a flow plate as described above and a total system flow rate of 20 lpm, but without means of correcting for specifically introducing cross-center wafer flow shear. When plating at high deposition rates, for example in rates near of exceeding the upper limits of present WLP plating capabilities regimes, conventional diffusers and wafer rotation conditions are insufficient to prevent non-uniform deposition in a region at the center of the wafer. This is believed due to slower rotation, minimal impinging flow, and insufficient shearing of fluid at the center region of the wafer. At the actual central axis of rotation on the wafer surface, there is a "singularity" associated with zero angular velocity.

Having efficient mass transfer capabilities, the singularity can be compensated for and thus high rate uniform plating is achieved; thus apparatus described herein are configured to electroplate, for example, wafer level packaging features, TSV's and the like. Various metals can be plated using apparatus described herein, including metals that are traditionally difficult to plate due to mass transfer issues. In one embodiment, apparatus described herein are configured to electroplate one or more metals selected from the group consisting of copper, tin, a tin-lead composition, a tin silver composition, nickel, a tin-copper composition, a tin-silver-copper composition, gold, and alloys thereof.

Various mechanisms for addressing the observed non-uniformity were identified above. In certain embodiments, these mechanisms introduce fluid shearing at the surface of the rotating work piece. Each of the embodiments are described more fully below.

One embodiment is an electroplating apparatus including: (a) a plating chamber configured to contain an electrolyte and an anode while electroplating metal onto a substantially planar substrate; (b) a substrate holder configured to hold the substantially planar substrate such that a plating face of the substrate is separated from the anode during electroplating; (c) a flow shaping element including a substrate-facing surface that is substantially parallel to and separated from a plating face of the substrate during electroplating, the flow shaping element including an ionically resistive material with a plurality of non-communicating channels made through the flow shaping element, where the non-communicating channels allow for transport of the electrolyte through the flow shaping element during electroplating; and (d) a flow diverter on the substrate-facing surface of the flow shaping element, the flow diverter including a wall structure partially following the circumference of the flow shaping element, and having one or more gaps, and defining a partial or "pseudo" chamber between the flow shaping element and the substantially planar substrate during electroplating.

In one embodiment, the flow shaping element is disk-shaped and the flow diverter includes a slotted annular spacer attached to, or integrated onto, the flow shaping element. In one embodiment, the wall structure of the flow diverter has a single gap and the single gap occupies an arc of between about 40 and about 90 degrees. The wall structure of the flow diverter may be between about 1 mm and about 5 mm high. In certain embodiments, the flow diverter is configured such that a top surface of the wall structure is between about 0.1 and 0.5 mm from a bottom surface of the substrate holder during electroplating and the top surface of the flow shaping element is between about 1 and 5 mm from the bottom surface of the substrate holder during electroplating.

In certain embodiments, the apparatus is configured to flow electrolyte in the direction of the substrate plating face and under conditions that produce an average flow velocity of at least about 10 cm/s exiting the holes of the flow shaping element during electroplating. In certain embodiments, the apparatus is configured to operate under conditions that produce a transverse electrolyte velocity of about 3 cm/sec or greater across the center point of the plating face of the substrate.

In certain embodiments, the wall structure has an outer portion that is higher than an inner portion. Embodiments include features that restrict the flow of electrolyte out of the pseudo chamber except for the one or more gaps which form a vent region in the pseudo chamber.

One embodiment is an apparatus for electroplating metal onto a substrate, the apparatus including: (a) a plating chamber configured to contain an electrolyte and an anode while electroplating metal onto the substrate; (b) a substrate holder configured to hold the substrate such that a plating face of the substrate is separated from the anode during electroplating, the substrate holder having one or more electrical power contacts arranged to contact an edge of the substrate and provide electrical current to the substrate during electroplating; (c) a flow shaping element shaped and configured to be positioned between the substrate and the anode during electroplating, the flow shaping element having a flat surface that is substantially parallel to and separated from the plating face of the substrate by a gap of about 10 millimeters or less during electroplating, and the flow shaping element also having a plurality of holes to permit flow of the electrolyte toward the plating face of the substrate; (d) a mechanism for rotating the substrate and/or the flow shaping element while flowing electrolyte in the electroplating cell in the direction of the substrate plating face; and (e) a mechanism for applying a shearing force to the electrolyte flowing at the plating face of the substrate; where the apparatus is configured for flowing electrolyte in the direction of the substrate plating face under conditions that produce an average flow velocity of at least about 10 cm/s exiting the holes of the flow shaping element during electroplating and for flowing electrolyte in a direction parallel to the plating face of the substrate at an electrolyte velocity of at least about 3 cm/sec across the center point of the plating face of the substrate. Various shearing force mechanisms are described in more detail below.

Flow Diverter

Certain embodiments impart lateral shearing at the wafer's plating face, and particularly at the central axis of rotation on the plating face. This shearing is believed to reduce or eliminate the non-uniformity in deposition rate observed at the center of the wafer. In this section, the shearing is imparted by using an azimuthally non-uniform flow diverter attached to or proximate the circumference of the flow shaping plate and extending toward the rotating work piece. Generally a flow diverter will have a wall structure that at least partially restricts the flow of electrolyte from the pseudo chamber except at the vent portion of the pseudo chamber. The wall structure will have a top surface, which in some embodiments is flat and in others has vertical elements, slopes and/or curved portions. In some embodiments described herein, the top surface of an edge portion of the flow diverter provides a very small gap (e.g., about 0.1 to 0.5 mm) between the bottom of the wafer holder and flow diverter over the majority of the region between a substrate holder periphery and the top of the edge portion. Outside this region (between about 30 to 120 degrees arc), there is a gap in the flow diverter body (for example a segment removed from an annular body) that provides a relatively low resistance path for electrolyte to flow out of the nearly closed chamber formed between the wafer plating face, certain surfaces of the wafer holder, the flow shaping plate and the interior surfaces of the flow diverter.

Figure 2A:
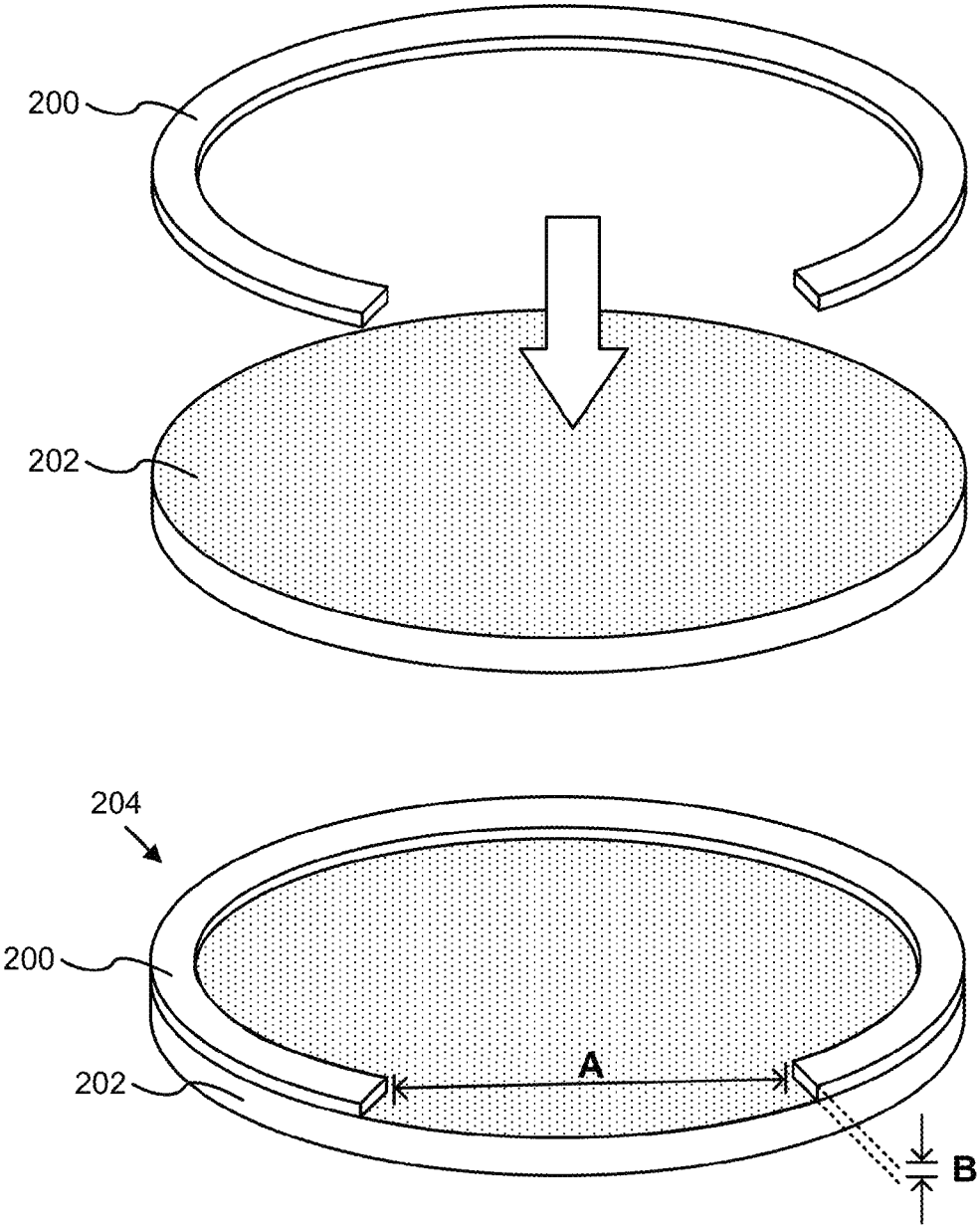
FIG. 2A is a perspective of an exemplary flow diverter and flow shaping plate assembly.

In one embodiment, the electroplating apparatus' mechanism for applying the shearing force includes a slotted spacer located on or proximate to the circumference of the flow shaping element and projecting toward the substrate holder to define a partial chamber between the flow shaping element and the substrate holder, where the slotted spacer includes a slot over an angular section to provide a low resistance path for electrolyte flow out of the partial chamber. FIGS. 2A-D and associated CAD FIGS. 2E-I depict an implementation where a slotted spacer, 200, is used in combination with a flow shaping plate 202 (5 in FIGS. 2E-K), in order to create a diverter assembly, 204, which when positioned in close proximity to a rotatable drive assembly 101 and when sufficient flow is provided through the through holes of plate 202, provides substantially uniform plating in high rate deposition regimes. FIG. 2A depicts how slotted spacer 200 (also referred to as an azimuthally asymmetric flow diverter) combines with flow shaping plate 202 to form assembly 204. Slotted spacer 200 can be attached, for example, using screws and the like (not shown). One of ordinary skill in the art would appreciate that, although embodiments are described as individual flow shaping plates and flow diverters combined in an assembly (e.g. slotted spacer 200 and plate 202, together assembly 204), rather than such assemblies, a unitary body milled from, for example, a block of material can serve the same purpose. Thus, one embodiment is a flow shaping element having a unitary body which is configured to serve the purpose of a flow diverter/flow shaping plate assembly described herein.

Figure 2B:
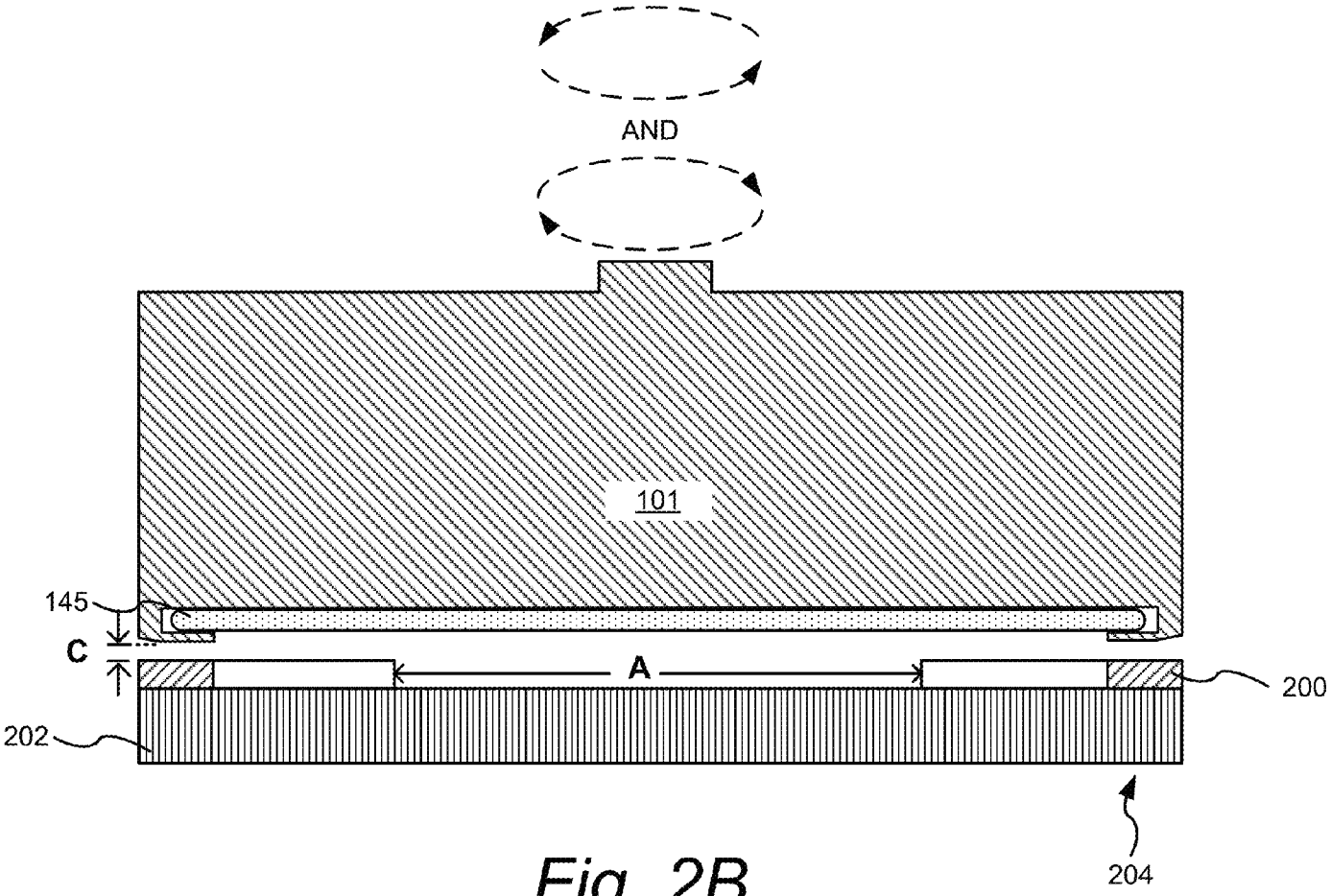
FIG. 2B is a cross-section of the flow diverter as described in relation to FIG. 2A in relation to a wafer holder.

Assembly 204 is positioned in close proximity to the substrate to be plated. For example, the closest part of assembly 101 (the base of cup 102 as described in relation to FIGS. 1A and 1B) is within less than about one millimeter from the top of azimuthally slotted spacer 200. In this way, a confined space or pseudo chamber is formed between the wafer and the flow shaping plate where the majority of the electrolyte impinging on the wafer surface exits through the slotted portion of 200. Dimension A, which may be defined as an angle or a linear dimension for a ring of defined radius, can be varied to allow more or less flow through the slot and dimension B can be varied to create a larger or smaller volume in the aforementioned pseudo chamber. FIG. 2B is a cross sectional depiction of assembly 206 positioned in close proximity to assembly 101. In certain embodiments, a dimension C, which is a gap between the top of spacer 200 and the bottom of assembly 101, is on the order of about 0.1 to 0.5 mm, in another embodiment about 0.2 to 0.4 mm.

Figure 2C:
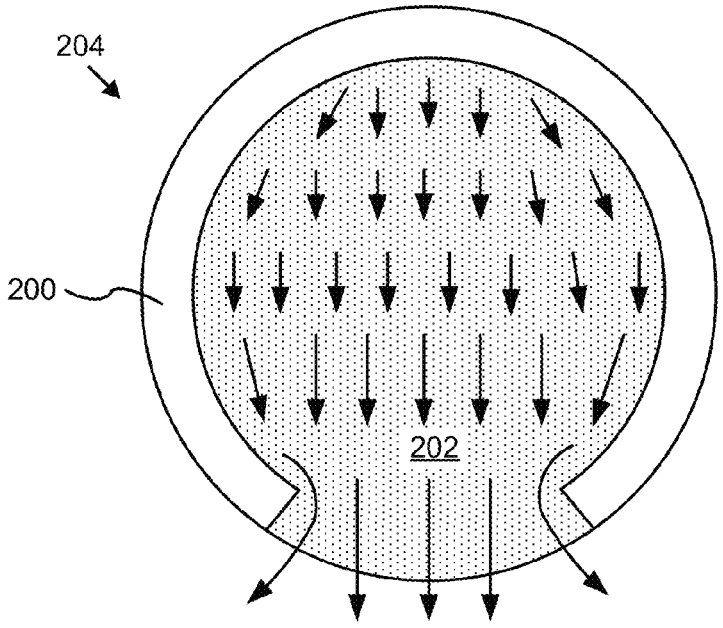
FIGS. 2C-D are top views of flow dynamics on the top of the flow shaping plate when a flow diverter as described in relation to FIG. 2A is used.

FIG. 2C depicts the electrolyte flow pattern within the pseudo chamber between the wafer and plate 202 when the wafer is not rotating. More specifically, the figure depicts representative vectors of a flow pattern immediately proximate the plating face of the wafer. The electrolyte impinges on the wafer normal to the plating surface, but then is deflected and flows parallel to the plating surface and out of the slot of 200. This flow pattern is produced by virtue of the resistance to flow through the narrow gap C (see FIG. 2B) relative to the region where the segment is removed from flow diverter 200 where a "vent" or larger opening in the pseudo chamber resides. Note that the magnitude of the flow vectors increases across the flow shaping plate from the area in the pseudo chamber furthest from the vent region and toward the vent region. This can be rationalized by considering the pressure differential, for example, from the area furthest from the gap (higher pressure) and the area proximate the gap (lower pressure). Also, the electrolyte flowing in the area of the pseudo chamber furthest from the vent does not enjoy the additive speed and momentum of combined flow from the additional micro jets in the shaping plate as is true in the region near the vent. In certain embodiments, described in more detail below, these flow vector magnitudes are made more uniform in order to further increase plating uniformity.

Figure 2D:
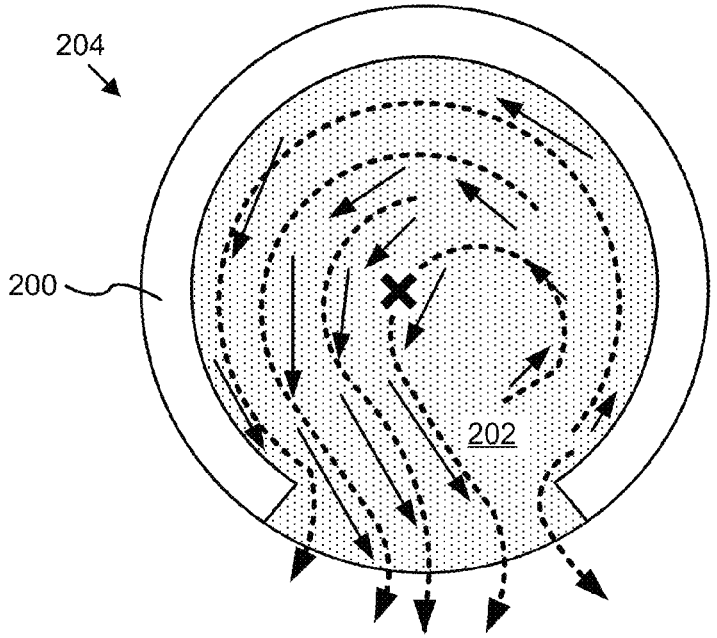

FIG. 2D depicts representative vectors of a flow pattern at the wafer face when the wafer is rotating in one direction. Note that the electrolyte flows laterally across the center (marked with a bold "X") or axis of rotation of the rotating wafer. Thus shear flow is established across the center of the wafer, mitigating or eliminating the center slow plating (e.g. as described in relation to FIG. 1D) observed when insufficient shearing flow exists.

In some embodiments, a substantially flow resistive but ionically conducting film, such as a layer of flow resistive micro-porous filter material or cationic conducting membrane (e.g., Nafion™—a sulfonated tetrafluoroethylene based fluoropolymer-copolymer available from E.I. du Pont de Nemours and Company) is placed just below the flow plate in region of the plate proximate the open flow slot of the flow diverter. In one embodiment, the portion is about one-half of the area of the plate. In another embodiment, the portion is about one-third the area of the plate, in another embodiment, about one-quarter and in yet another embodiment, the portion is less than one-quarter of the area of the plate. This construction allows ionic current to pass largely uninhibited through the holes there, but prevent flow immerging upwards in that region, increasing the cross flow across the wafer center for the same total flow rate, while normalizing the flow vectors across the wafer plating surface. For example, when the portion is half of the area of the plate, this results in doubling the flow velocity in the holes located at the opposite side of the slot and eliminating flow through holes on the half of the plate proximate the slot. Skilled artisans would appreciate that the shape and placement of the membrane can be optimized to normalize the transverse flow vectors, depending on the particular plating apparatus' configuration including the flow diverter/flow shaping plate configuration. In lieu of such a membrane, the through hole pattern of the flow shaping plate can be adjusted so that the density of holes is lower proximate the gap in the flow diverter; analogously the pattern of the holes proximate the gap will depend on the particular system's configuration and operating parameters. A more flexible approach is to use a flow shaping plate with some fixed hole pattern and use the aforementioned membrane and/or hole blocking to create the desired transverse flow characteristics across the wafer plating surface. Further discussion of improving transverse flow characteristics is included in the discussion of subsequent Figures. For example methods and apparatus for normalizing the transverse flow vectors across the wafer plating surface are further described in relation to FIGS. 7A-C.

Figure 2E:
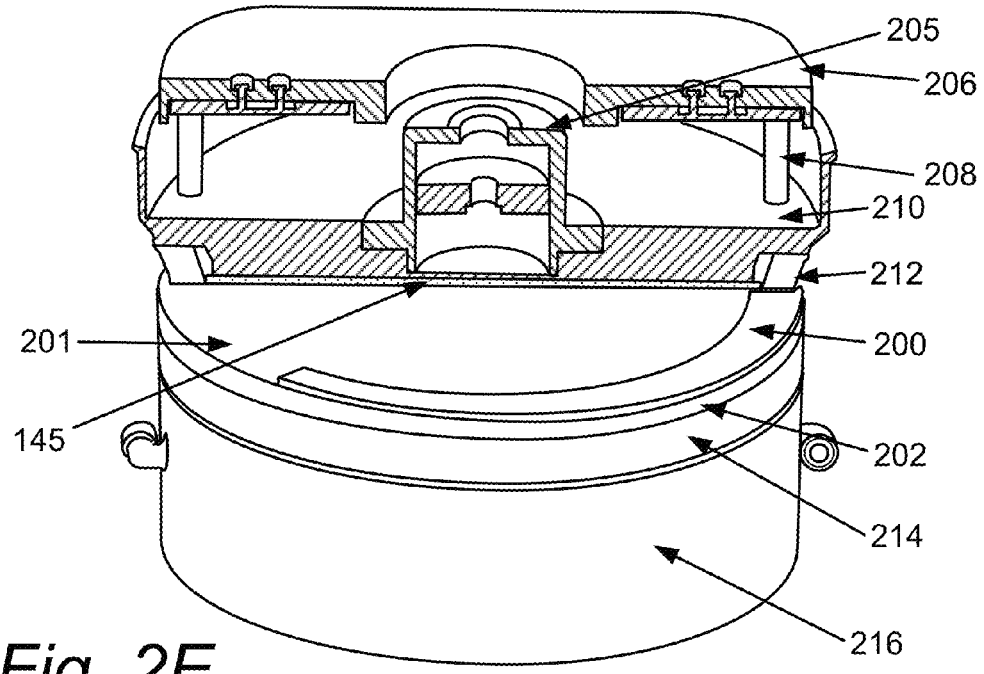
FIGS. 2E-I depict various aspects of the assembly as described in relation to FIG. 2A along with wafer holder and electrolyte chamber hardware.
Figure 2F:
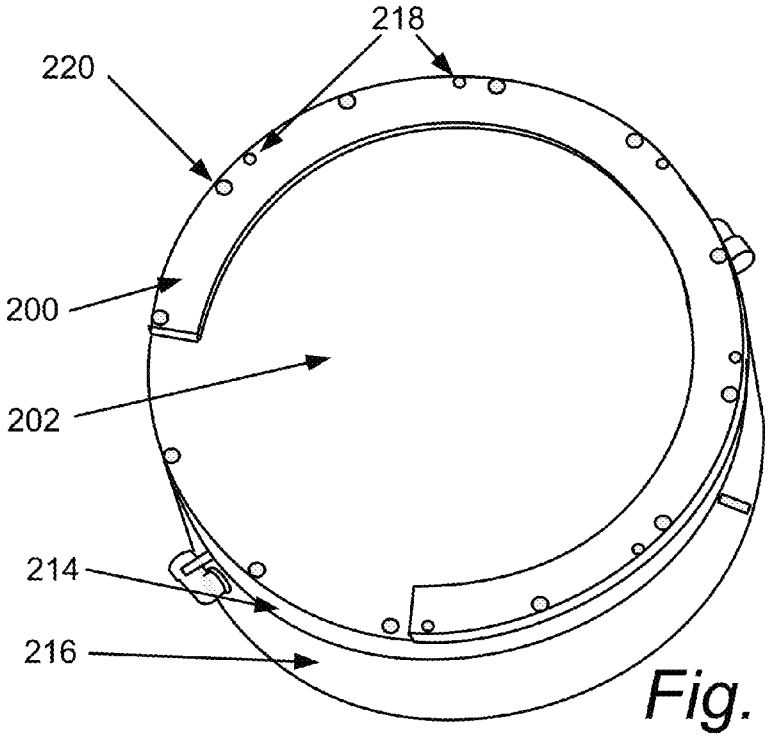
Figure 2G:
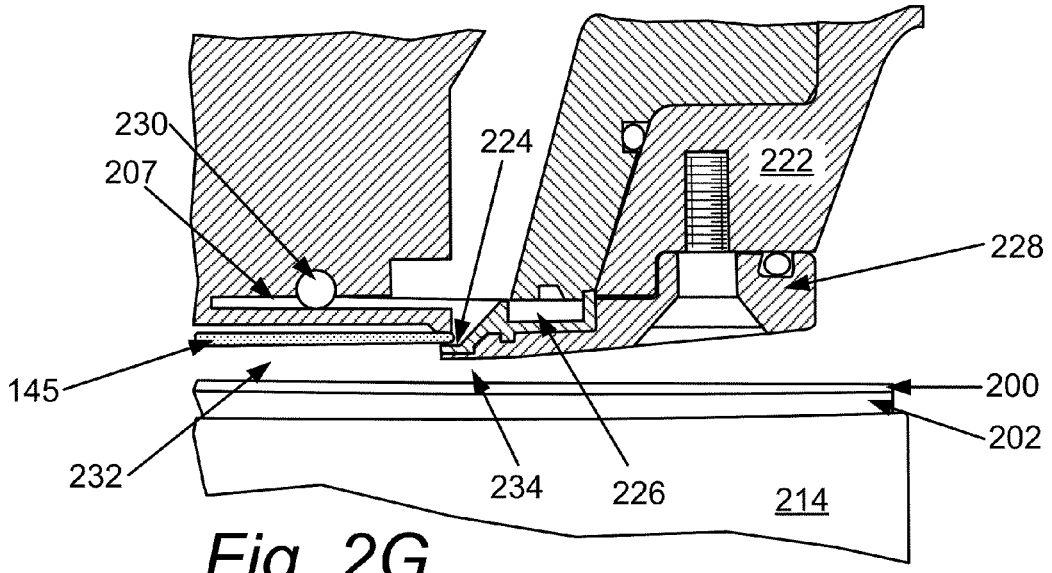

In FIGS. 2E-I, which are derived from CAD drawings of actual plating apparatus components, show additional features of the apparatus and particularly the diverter assembly. Where possible, the numbering of some components in FIGS. 2E-I matches that for previous figures, for example, wafer 145, flow diverter 200 and flow shaping plate 202. Other features in FIGS. 2E-I are identified by the following reference numbers. FIG. 2E shows assembly 204 in perspective attached to a plating cell assembly, and wafer holder 101 as a cross-section. Reference number 206 identifies a "top plate" for connecting to a "cup" 212 and allowing the cup to move up and down to hold the wafer in position against a "cone" 210. Struts 208 connect cup 212 to top plate 206. Mounted to cone 210 is a housing 205 that holds various connections such as pneumatic and electrical connections. The cone also includes a cut out 207 to produce a flexible cantilever structure in the cone, and a sealing O-ring 230. The cup 212 includes a main cup body or structure 222, electrical contacts 224 for connecting with wafer 145, a bus plate 226 for delivering electricity to the contacts 224, and a cup bottom 228, which defines a lower surface of the assembly 101 (FIGS. 2A-D, also note that FIGS. 1A and 1B and associated description provide context on an exemplary wafer holding and positioning assembly, 100, and a cross section of assembly 101.)

Slotted spacer 200 (also see FIGS. 2A-D) contacts flow shaping plate 202 (also see FIGS. 2A-D). A cutout or slot 201 exists in the slotted spacer and, as explained, provides a low resistance path for electrolyte to escape during electroplating. In this example, mounting screws connect slotted spacer 200 to flow shaping plate 202. Fixing members 220 connect plate 202 to a main cell body 216. A circular wall 214 defines the outer region of a cathode chamber which holds catholyte separated from an anode chamber that holds anolyte.

A gap, 232 (see also dimension C of FIG. 2B), between the plating surface of wafer 145 and the upper surface of flow shaping plate 202. This gap may be about 2-4 millimeters in the interior regions of the flow diverter. However, at the circumferential points where the slotted spacer resides there is a gap 234 that is only about 0.1 to 0.5 millimeters in some embodiments. This smaller gap 234 is characterized by the distance between the upper surface of slotted spacer 200 and the lower surface of cup bottom 228. Of course, this small gap 234 does not exist at the opening 201 in the spacer 200. At this opening, the gap between cup bottom and plate 202 is the same as gap 232. In certain embodiments, the difference gap size between gaps 232 and 234 is approximately a multiple of 10.

As an alternative set of embodiments, liquid flow is used as a barrier to create the shear flow as described herein. In these embodiments, the edge gap is not necessarily quite as small as described above, for example 2 mm, but the effect of creating cross flow still results. In one example, where the cell is generally as described as in relation to FIGS. 2A-I, in the region slotted spacer 200 would typically occupy, there is a mechanism (e.g., one or more fluid jets) for creating an upward flowing stream of fluid directed substantially upwards towards the wafer holder, thereby creating a liquid "wall" in the region where fluid would otherwise try "leak" through the gap. In another embodiment, the spacer extends outwards beyond the periphery of the wafer holder and then laterally upward in the direction of the wafer itself a distances of from about 1 to 10 cm, thereby creating a "leaky" cup in which the wafer and its holder fits. Like the flow diverter, the leaky cup has a section of its wall missing, through which the liquid that enters the flow plate exits the gap between it and wafer must exit. While the above embodiments may reduce the need for an extremely small gap between the wafer and the insert, the total cross flow across the wafer center is in part determined by the flow shaping plate to wafer distances, and this parameter typically remains largely the same as described above.

Figure 2H:
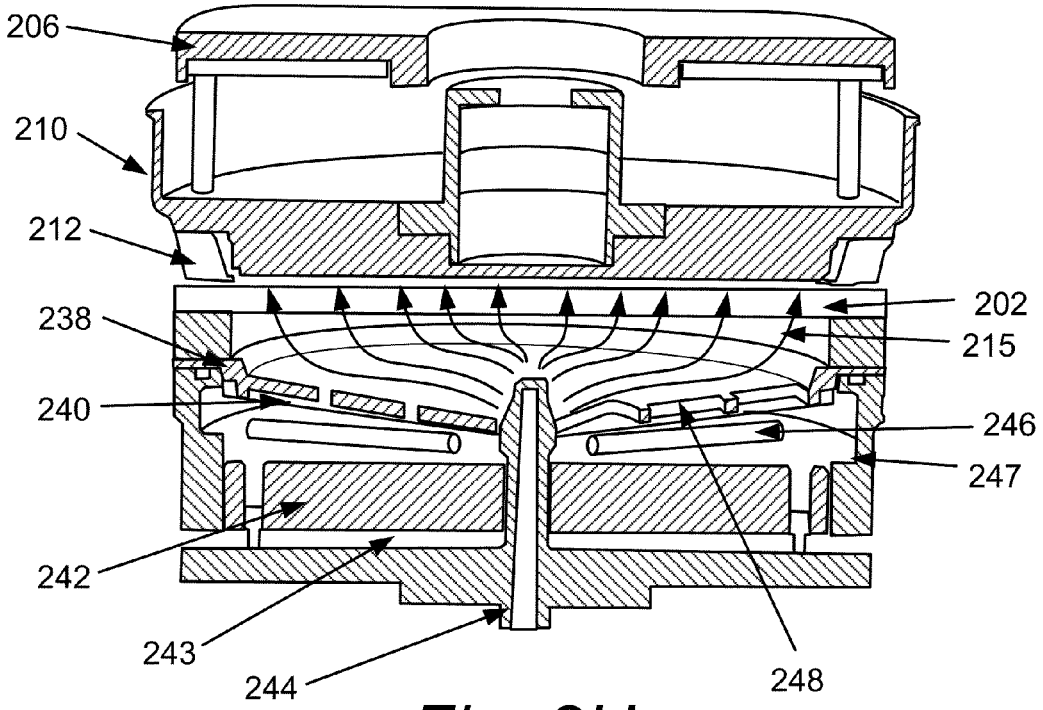
Figure 2I:
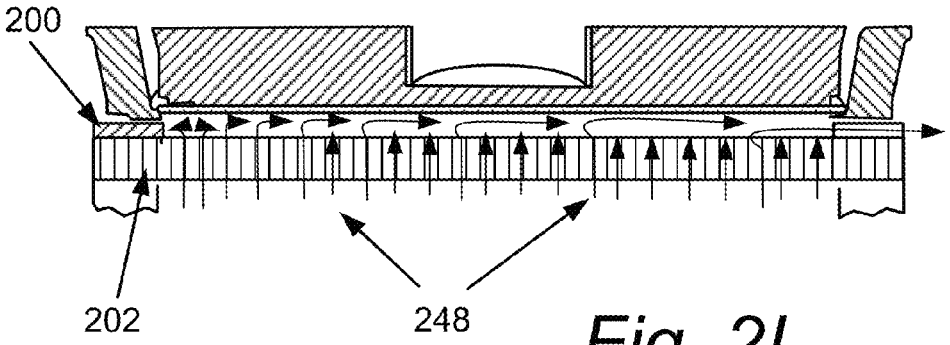

FIG. 2H shows a more complete depiction (as a cross section) of the electroplating cell. As shown, the electroplating cell includes an upper or cathode chamber 215 defined in part by circular wall 214. The upper catholyte chamber and lower anode chamber of the cell are separated by an ionic transfer membrane 240 (e.g., Nafion™) and an inverted conically shaped support structure 238. The number 248 indicates the flow path lines of the electrolyte up to and through flow shaping plate 202. The anode chamber includes a copper anode 242 and a charge plate 243 for delivering power to the anode. It also includes an inlet manifold 247 and a series of flutes 246 for delivering electrolyte to the anode surface in a manner that irrigates the top surface of the anode. Passing through the center of the anode 242 and the anode chamber is a catholyte flow inlet 244. This structure delivers catholyte to upper chamber 215 along streamlines 248 as shown by the radial/vertical arrows in FIG. 2H. FIG. 2I depicts flow streamlines 248 for electrolyte flowing through holes in shaping plate 202 and into gap 232, adjacent the plating surface of the wafer.

Figure 3A:
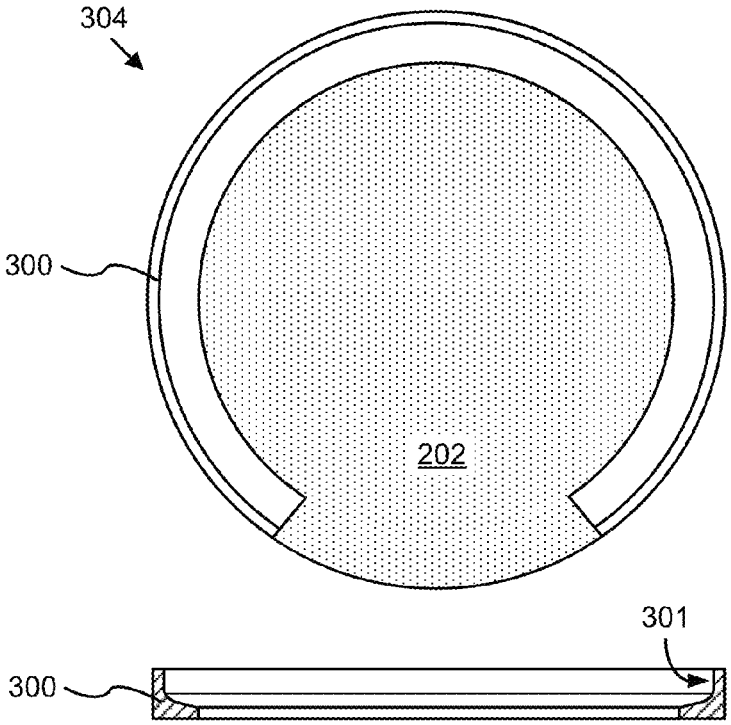
FIG. 3A shows a top view and cross-section of a flow diverter/flow shaping plate assembly where the flow diverter has a vertical surface element for aiding in transverse fluid flow across a wafer during plating.
Figure 3B:
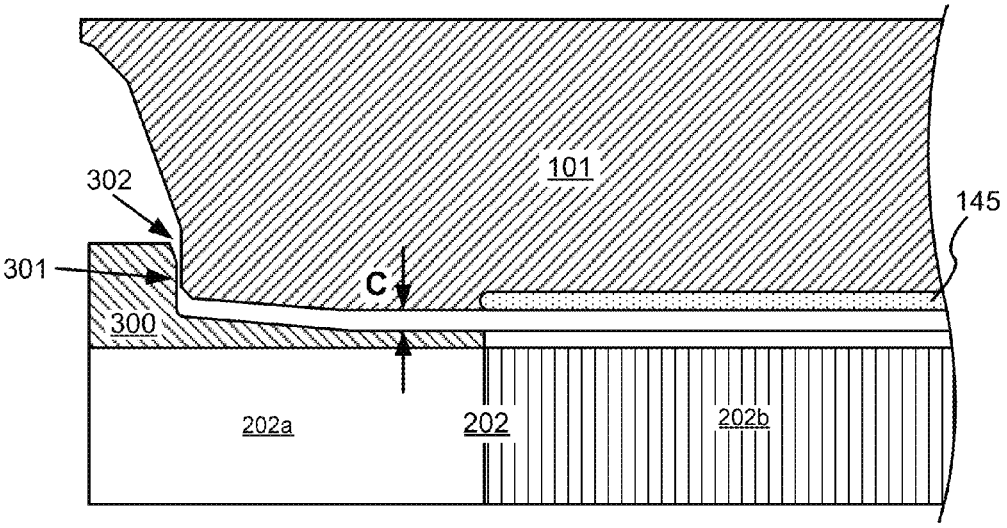
FIG. 3B is a cross-section showing the relationship between the flow diverter as described in relation to FIG. 3A and a wafer holder assembly.

Some of the cell features shown in FIGS. 2E-I are also shown in FIGS. 1A, 1B and 3B described below. The apparatus will include one or more controllers for controlling, inter alia, the positioning of the wafer in the cup and cone, the positioning of the wafer with respect to the flow shaping plate, the rotation of the wafer and the delivery of current to the anode and wafer.

Some general but non-limiting features of flow diverter embodiment are set forth below in Roman numerals I-XII below.

I. A structure for creating a small gap region and nearly closed wafer to flow shaping plate "chamber."

II. In more specific embodiments, the nearly closed wafer to flow shaping plate chamber is created by forming a very small gap (e.g., about 0.1 to 0.5 mm) between the majority of the space between a wafer holder periphery and a peripheral edge element (slotted spacer), located either on, or as part of, the flow shaping plate.

III. The apparatus rotates the wafer at a relatively high angular velocities (e.g., at least about 30 rpm) above the flow shaping plate, thereby creating a high degrees of fluidic-shearing. This fluidic shearing is caused by the large velocity difference between the moving wafer and the (stationary) upper surface of the shaping plate which is in close proximity to the wafer.

IV. A region of the cell that acts as a fluidic outlet "vent." This vent is an opening, or in some cases, an outlet gap (e.g., the gap in the slotted spacer described above). It creates an opening in the "chamber" between flow shaping plate and the rotating wafer. The vent directs fluid that moves upward through the flow shaping plate to change directions by 90 degrees and move at a high velocity parallel to the wafer surface, at an angle toward the vent location. This outlet vent or gap encompasses an angular portion of the outer circumference of the "chamber" (outer edge of the wafer/cup and/or the flow shaping plate) to introduce azimuthal asymmetry in the chamber. In some cases, the angle subtended by the vent or gap is about 20 to 120 degrees or about 40 to 90 degrees. It is through this gap that the vast majority of the fluid that enters the cell chamber and subsequently passes through the holes in the shaping plate, eventually exits the cell (and is recaptured for recirculation to the bath).

V. The (fluid) flow shaping plate typically has a low porosity and pore size that introduces a substantial viscous backpressure at operating flow rates. As an example, a solid plate having a large number of very small holes provided therein, e.g., 6465×0.026 inches in diameter, has been shown useful. The porosity of the plate is typically less than about 5 percent.

VII. In certain embodiments employing a flow shaping plate of about 300 mm diameter (and having a large number of holes), a volumetric flow of about 5 liters/minute or greater is employed. In some cases, the volumetric flow is at least about 10 liter/minute, and sometime as great as 40 liters/minute.

VIII. In various embodiments, the magnitude of the pressure drop across the flow shaping plate is approximately equal to or larger than, the pressure drop between the outlet gap and a position within the "chamber" opposite the outlet gap and below the wafer, and therefore acts as a flow manifold.

IX. The flow shaping plate delivers a substantially uniform flow directly at and largely upwards toward the wafer. This avoids the situation where the majority of the flow might otherwise enter the chamber from the flow shaping plate but be preferentially routed (short circuited) by a path that is primarily outward near and through the outlet gap.

X. Unlike the case with a large gap (greater than a millimeter) between the edge of wafer and the shaping plate and without a flow diverter, as flow accumulates in the region below the wafer, the path of least resistance is altered from that of a radially outwards trajectory to one that must now primarily pass parallel to the wafer and in the direction of the outlet gap. Therefore, fluid is directed to traverse in a lateral direction parallel to the wafer surface, and of particular note, traverses and passes across the center of wafer (or axis of wafer rotation). It is no longer directed radially outwards in all directions from the center.

XI. The velocity of the transverse flow at the center and other locations depends on a number of design and operating parameters, including the size of the various gaps (flow shaping plate to wafer, outlet gap, slotted spacer to wafer holder peripheral bottom), the total flow, wafer rotation rate. However, in various embodiments, the flow across the wafer center is at least about 3 cm/sec, or at least about 5 cm/sec.

XII. A mechanism to tilt the wafer and holder to allow for "angled entry" may be used. The tilt may be toward the gap or vent in the upper chamber.

Other embodiments include flow diverters that include a vertical surface that further inhibits flow out of the pseudo chamber except for at the vent or gap. The vertical surface can be described as a FIG. 3A depicts a flow diverter/flow shaping plate assembly, 304, that includes flow shaping plate 202 (as described previously) and a flow diverter 300. Flow diverter 300 is much like flow diverter 200 as described in relation to FIG. 2A, as it has a generally annular shape with a segment removed; however, flow diverter 300 is shaped and configured to have a vertical element. The bottom portion of FIG. 3A shows a cross-section of flow diverter 300. Rather than a flat top surface that is below the lowest surface of the wafer holder, as in flow diverter 200, the top surface of flow diverter 300 is shaped to have, starting from the inner circumference and moving radially outward, an upwardly sloping surface that eventually becomes a vertical surface, terminating at a top (in this example flat) surface that is above the lowest surface of the wafer holder. Thus, in this example, the wall structure has an outer portion that is higher than an inner portion. In certain embodiments, the outer portion is between about 5 mm and about 20 mm in height and the inner portion is between about 1 mm and about 5 mm in height.

In the example of FIG. 3A, the flow diverter has a vertical interior surface, 301. The surface need not be perfectly vertical, as for example, a sloped surface will suffice. The important feature in this embodiment is that the narrow gap between the top surface of the flow diverter and the bottom surface of the wafer holder, distance C in FIG. 2B, is extended to include some sloped and/or vertical component of the wafer holder surface. In theory, this "narrow gap extension" need not include any sloped or vertical surface, rather it could include expanding the area where the upper surface of the flow diverter and the lower surface of the wafer holder are registered in order to create the narrow gap and/or narrowing further the narrow gap to inhibit fluid escape from the pseudo chamber. However, with the import of reducing an apparatus' overall footprint, it is oftentimes more desirable to simply extend the narrow gap to sloped and/or vertical surfaces to obtain the same result of less fluid loss through the narrow gap.

Figure 3C:
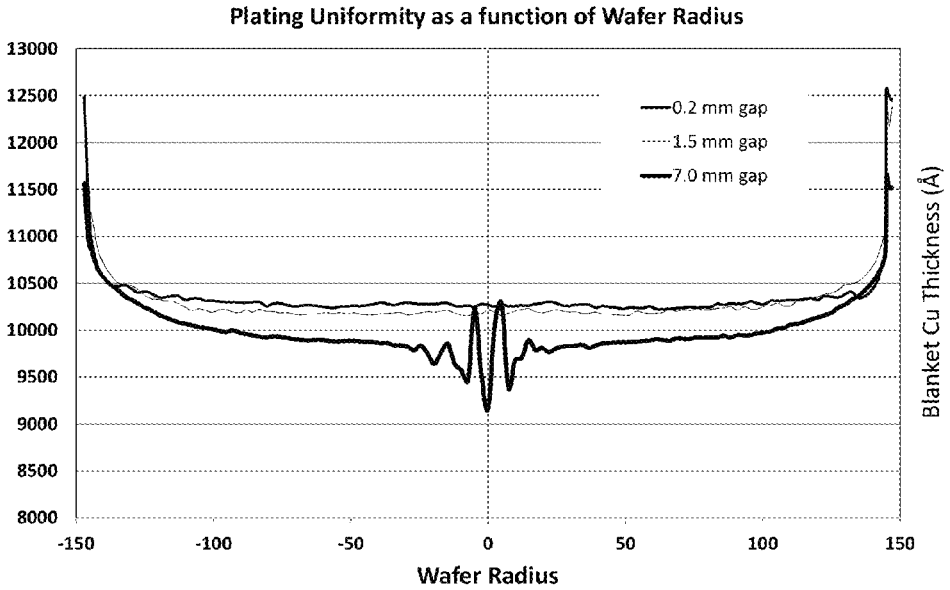
FIG. 3C is a graph showing plating uniformity results obtained using a flow diverter/flow shaping plate assembly as described in relation to FIGS. 3A and 3B.

Referring to FIG. 3B, which depicts a partial cross-section of assembly 304 registered with wafer holder 101, a vertical surface, 301, in this example along with a vertical portion of the wafer holder 101, extends the aforementioned narrow gap (for example refer to "C" in FIG. 2B) between the flow diverter top surface and the wafer holder. Typically, but not necessarily, as depicted in FIG. 3B, the distance, as indicated by 302, between these vertical and/or sloped surfaces is smaller than the distance C between the horizontal surface of the flow diverter and the wafer holder. In this rendition, the portion, 202*a*, of flow shaping plate 202 having no through holes and the portion, 202*b*, having the through holes, are depicted. In one embodiment, the flow diverter is configured such that an inner surface of the wall structure is between about 0.1 and about 2 mm from an outer surface of the substrate holder during electroplating. In this example, gap 302 represents this distance. This further narrowing of the gap creates more fluid pressure in the pseudo chamber and increases shear flow across the wafer plating surface and out the vent (where segmented portion of flow diverter 300 opposes wafer holder 101. FIG. 3C is a graph showing uniformity of plated copper on a 300 mm wafer as a function of varying the described vertical gap. As indicated, at various gap distances, highly uniform plating can be achieved.

Figure 3D:
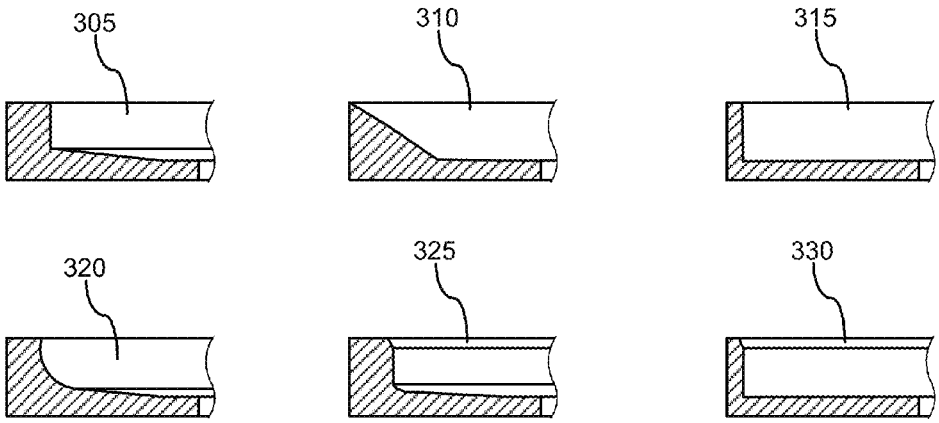
FIG. 3D shows cross-sections of a number of flow diverters having vertical surface elements.

FIG. 3D depicts a number of variations of the cross-section of flow diverters, 305-330, having a vertical element. As depicted, the vertical surface need not be precisely normal to the plating surface and there need not be a sloping portion of the top surface of the flow diverter (see e.g. cross-section 315). As depicted in cross-section 320, the inner surface of the flow diverter may be entirely a curved surface. Cross-section 310 shows that there may only be a slanted surface that extends the gap. One of ordinary skill in the art would appreciate that the shape of the flow diverter may depend on the wafer holder to which it registers in order to create the gap extension. In one embodiment, the surface that deviates from the horizontal (as compared to, for example, the top surface of the flow shaping plate) has at least one portion that deviates from between about 30 degrees to about 90 degrees (normal to) from horizontal.

Figure 3E:
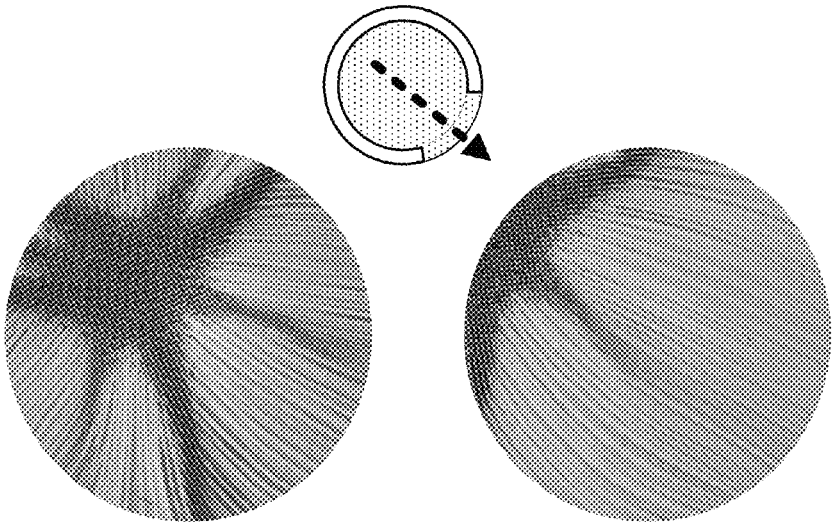
FIG. 3E shows flow patterns resulting from using flow diverters as described herein with flow shaping plate's having square pattern through hole placement.

The flow diverters as described in relation to FIGS. 3A-D aid in creating more uniform transverse flow between the wafer plating surface and the flow shaping plate. FIG. 3E shows top view Surf Image Haze Maps of the transverse flow patterns created when a flow diverter as described in relation to FIGS. 2A-I (left portion of FIG. 3E) is used as compared to when a flow diverter as described in relation to FIGS. 3A-D is used (right portion of FIG. 3E). These haze maps are a result of flowing plating solution onto/across the wafer having a seed layer without applying a plating current. The sulfuric acid in the plating solution etches the seeded wafer surface and thus creates a pattern that reflects the flow pattern, when analyzed with a laser-based particle/defect detector. In each test, a flow shaping plate such as 202 was used, where the hole patterns were a regular and uniform square pattern of holes across the entire area of the plate inside the flow diverter inner circumference (and where the segment removed from the diverter would reside were it not removed). The drawing in the upper middle of FIG. 3E indicates the orientation of the flow diverter and flow direction from the upper left to the lower right and out the gap. The darker portions of the haze maps indicate vertical impinging flow, while the lighter areas indicate transverse flow. As seen in the left hand map, there are many branches of the dark areas indicating confluence of vertical flows across the wafer. That is, presumably due to the regular distribution of the through holes on the flow shaping plate surface, there are long-range pathways for fluid where the transverse component of flow is less than the impinging component of flow. These long-range pathways can negatively affect plating uniformity across the wafer plating surface, and it is desirable to minimize the long-range pathways. As indicated by the haze map on the right side of FIG. 3E, when using a flow diverter as described in relation to FIGS. 3A-D (having a gap extending element), for example a vertical interior surface, there is an increased amount and more uniform transverse flow across the wafer.

Non-Uniform Hole Distribution on Flow Shaping Plate

In certain embodiments, flow shaping plates have non-uniform distribution of through holes in order to, alone or in combination with flow diverters, create increased and/or more highly uniform transverse flow across the wafer surface during plating.

Figure 4A:
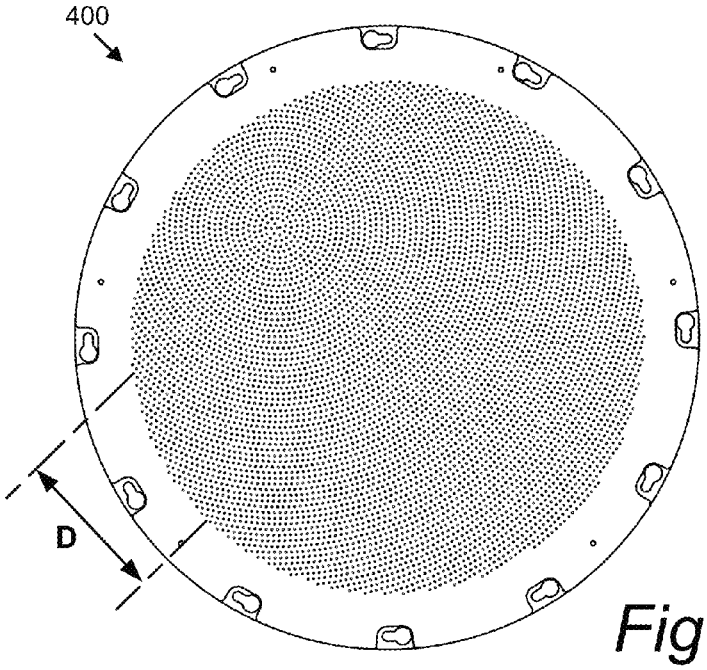
FIGS. 4A-B show top view of flow shaping plate's with spiral through hole patterns, where the origin of the spiral pattern is in different locations on the flow shaping plate.
Figure 4B:
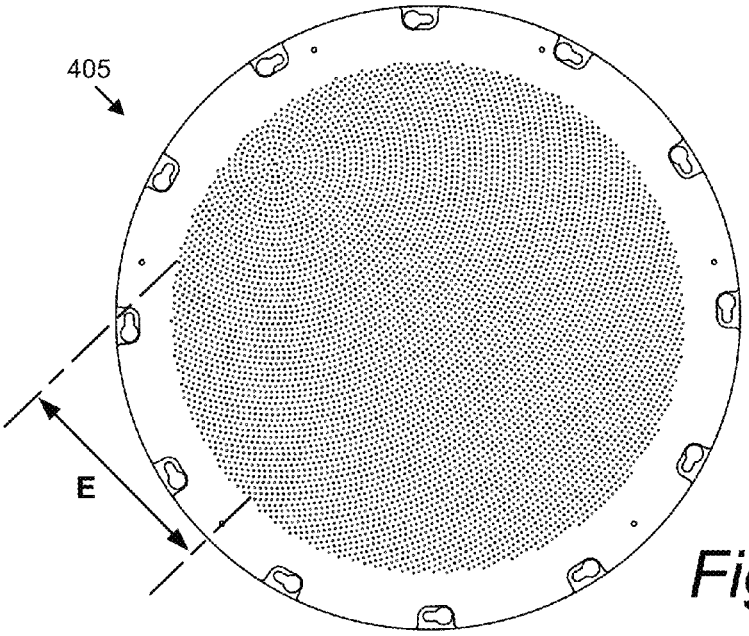
Figure 4C:
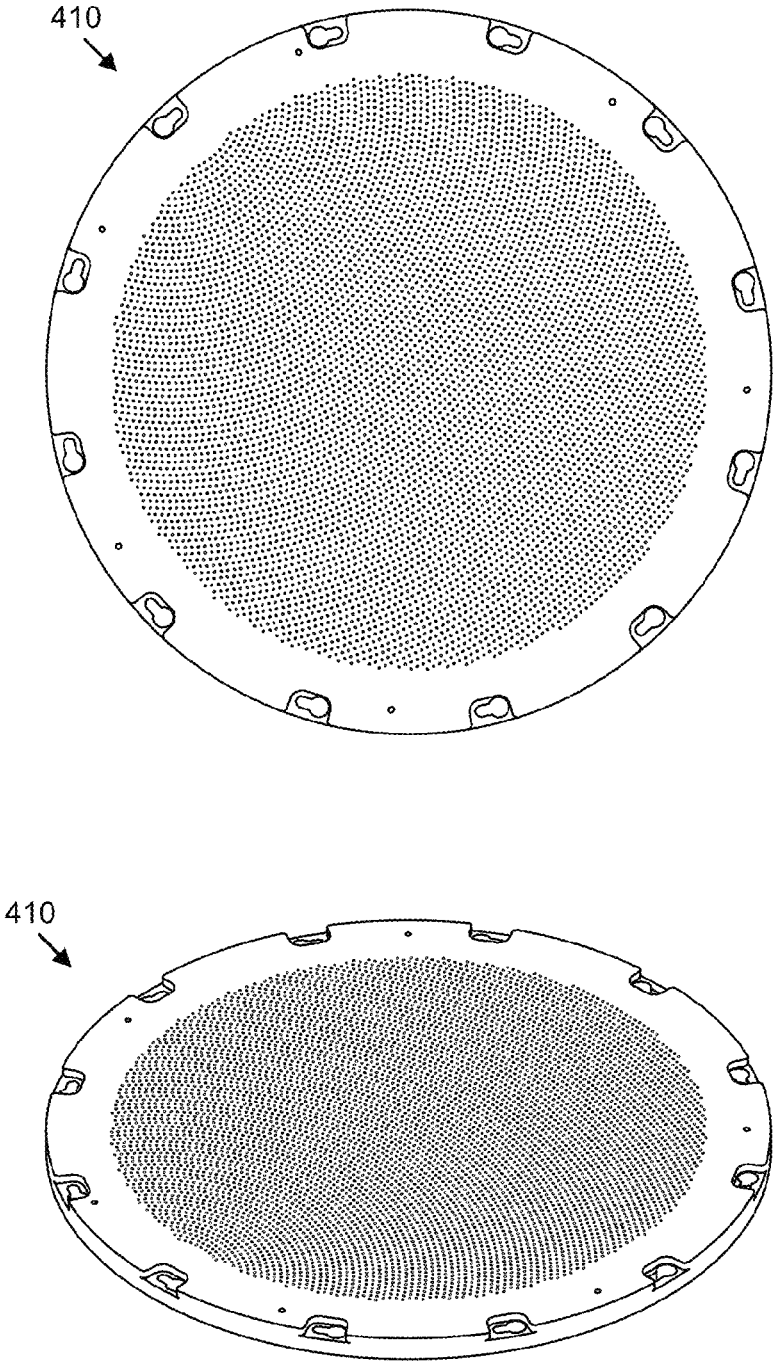
FIG. 4C shows a top view and perspective of a flow shaping plate with a spiral through hole pattern, where the spiral pattern is offset from the center of the flow shaping plate face such that what would be the origin of the spiral pattern is not included in the through hole pattern.

In some embodiments the non-uniform hole distribution is a spiral pattern. FIG. 4A shows a top view of one such flow shaping plate, 400. Note that the center of the spiral pattern of through holes is offset from the center of the circular area of the holes at a distance D. FIG. 4B shows a similar flow shaping plate, 405, where the offset is greater, a distance E. FIG. 4C depicts another similar flow shaping plate, 410, (top and perspective views, respectively) where the center of the spiral pattern of holes is not included in the circular area occupied by the holes, rather the offset is such that what would be the center of the spiral pattern of holes is not included in the circular area that includes the through holes. Using such offset spiral patterns provides for improved transverse flow across the wafer surface during plating. Such flow shaping plates are described in more detail in U.S. provisional patent application Ser. No. 61/405,608, as incorporated by reference above.

Figure 5A:
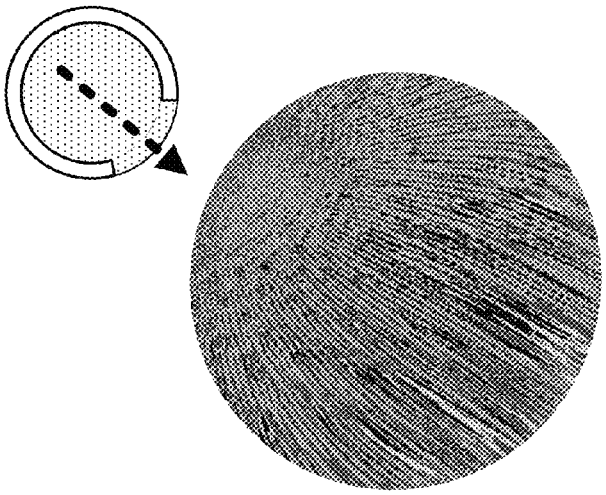
FIG. 5A shows flow patterns resulting from using a flow diverter as described in relation to FIG. 3A is used in conjunction with a flow shaping plate as described in relation to FIG. 4C during plating.
Figure 5B:
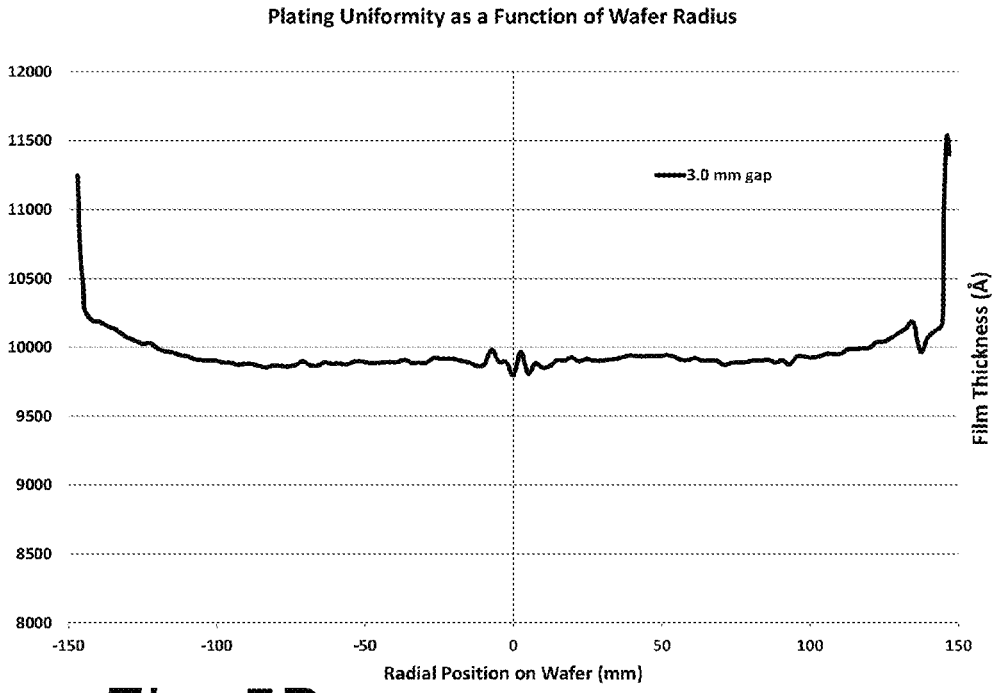
FIG. 5B shows plating uniformity results when using the flow diverter/flow shaping plate combination as described in relation to FIG. 5A.

FIG. 5A depicts a haze map showing flow patterns resulting from using a flow diverter as described in relation to FIG. 3A is used in conjunction with a flow shaping plate as described in relation to FIG. 4C (without wafer rotation). The haze map indicates, due to the non-uniform through hole patterns, in this example a spiral pattern, there is nearly complete transverse flow, with minimal if any long-range pathways for fluid flow where impinging components of flow dominate. FIG. 5B shows plating uniformity results when using the flow diverter/flow shaping plate combination as described in relation to FIG. 5A at a specified gap (3 mm) between the diverter and wafer holder. The plating uniformity on a 300 mm wafer is quite high.

Figure 6:
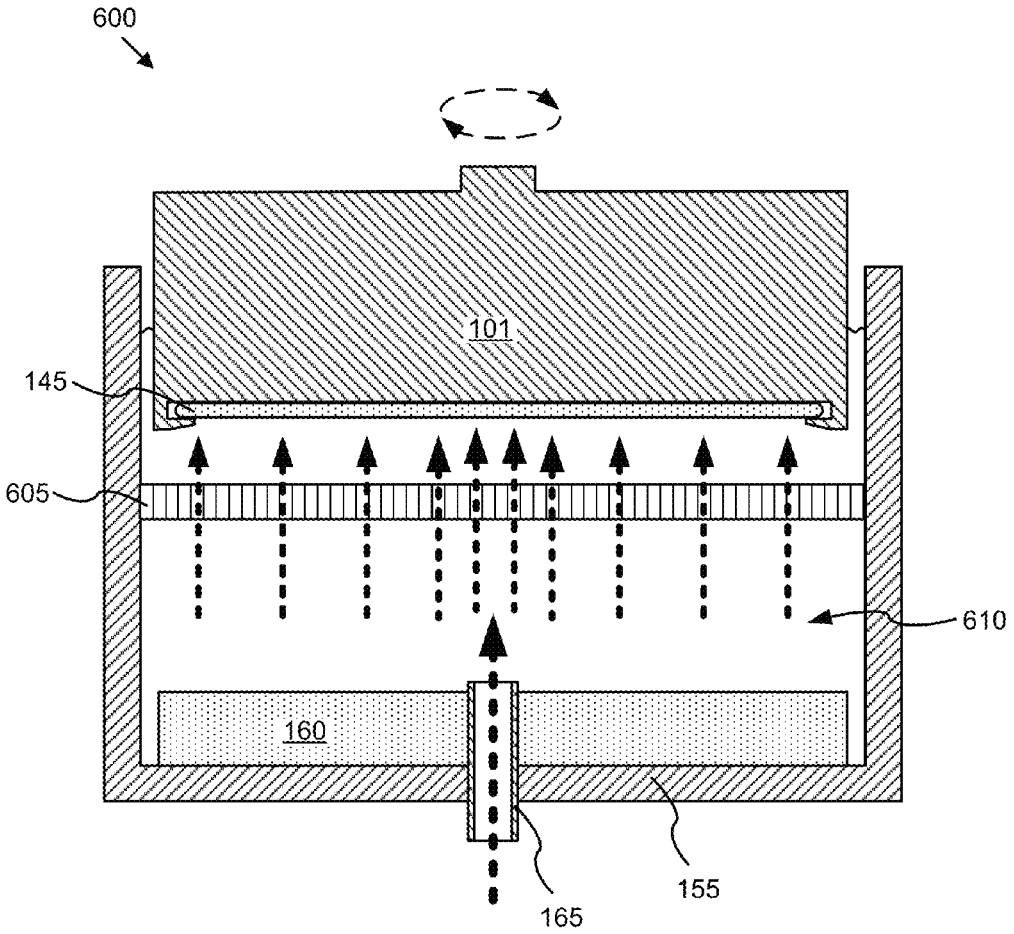
FIG. 6 is a cross-section of a flow shaping plate having variable flow through properties in order to compensate for lower plating rate near the center of the wafer as observed when using conventional flow shaping plate through holes.

Non-uniform through hole patterns can include other than spiral forms. And in certain embodiments, flow diverters are not used in combination with flow shaping plates with hole non-uniformity. For example, FIG. 6 depicts an assembly, 600, illustrating one configuration to address the center slow plating issue. Plating apparatus 600 has a plating bath, 155, which has an anode, 160, and an electrolyte inlet, 165. In this example, a flow shaping plate, 605, produces non-uniform impinging flow across the wafer. Specifically as shown, there is greater flow at the center of the wafer than in the outer regions due to a non-uniform distribution of holes in the flow shaping plate, e.g., a variance in the radial distribution of holes size and density. As indicated by the heavy dotted arrows, in this example, greater flow is created near the center of the wafer to compensate for the insufficient mass transfer and resultant lower plating rates seen at the center of the wafer (for example refer to FIG. 1D).

While not wishing to be bound by theory, it is believed that insufficient fluid shearing and hence non-uniform mass transfer across the surface of the wafer in conventional plating regimes as described above. By increasing the flow rate at the center of the wafer relative to the other areas of the wafer (as depicted by the higher density of dashed arrows near the center of the cathode chamber versus the outer regions), lower plating rates nearer the center of the wafer can be avoided. This result can be achieved by, for example, increasing the number of holes in, and/or the angle of orientation with respect to the wafer, for example, a flow shaping plate in order to increase the number of impinging flow jets and the amount of resultant shearing in the center region.

In general, the hole density, size, and/or distribution (e.g., uniform or random) is changed near the center of the flow shaping plate. In some embodiments, the hole density increases near the center. Alternatively or in addition, the holes assume a somewhat random distribution in their pattern near the center, which the hole distribution may be provided in a regular or periodic arrangement elsewhere on the flow shaping. In some embodiments, partial coverings may be provided to cover some holes in certain regions of a flow shaping plate. In certain embodiments, these coverings include an ionically conductive flow inhibitive member. This will allow the end user to customize the hole density and/or distribution to meet particular electroplating needs.

Flow Port Transverse Flow Enhancement

Figure 7A:
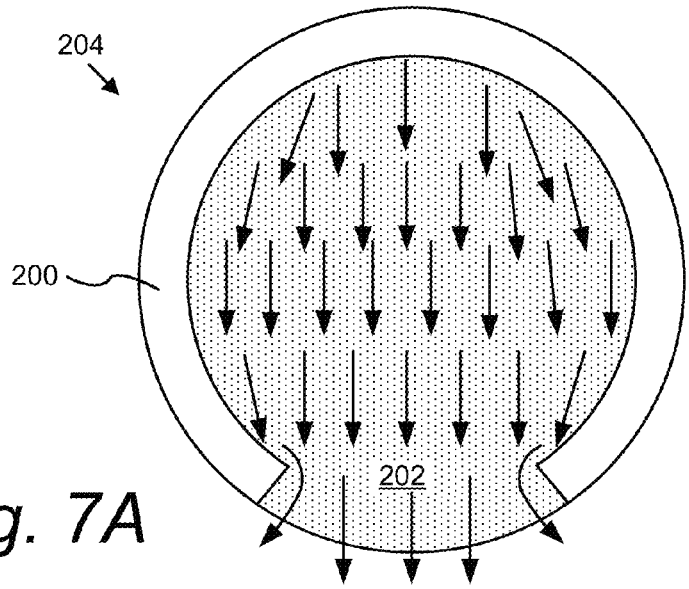
FIG. 7A is a top view of flow dynamics on the top of the flow shaping plate when a flow port transverse flow enhancement is used.

In some embodiments, electrolyte flow ports are configured to aid transverse flow, alone or in combination with a flow shaping plate and a flow diverter as described herein. Various embodiments are described below in relation to a combination with a flow shaping plate and a flow diverter, but the invention is not so limited. Note, as described in relation to FIG. 2C, in certain embodiments it is believed that the magnitude of the electrolyte flow vectors across the wafer surface are larger proximate the vent or gap and progressively smaller across the wafer surface, being smallest at the interior of the pseudo chamber furthest from the vent or gap. As depicted in FIG. 7A, by using appropriately configured electrolyte flow ports, the magnitude of these transverse flow vectors is more uniform across the wafer surface.

Figure 7B:
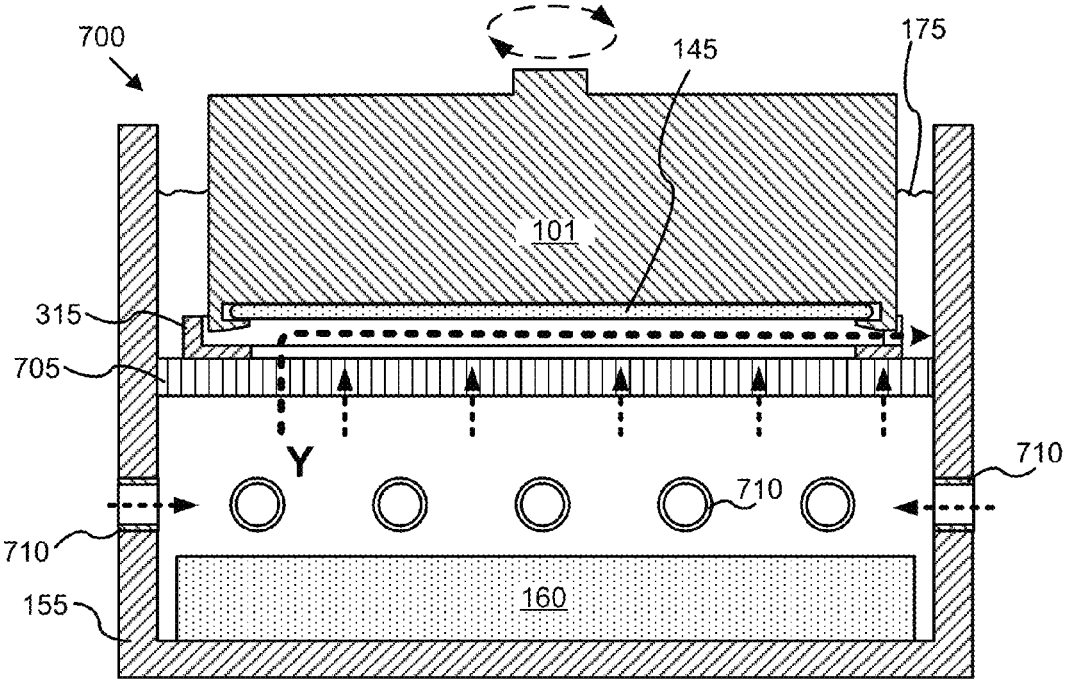
FIGS. 7B-G depict various apparatus for enhancing transverse flow across a work piece plating surface.
Figure 7C:
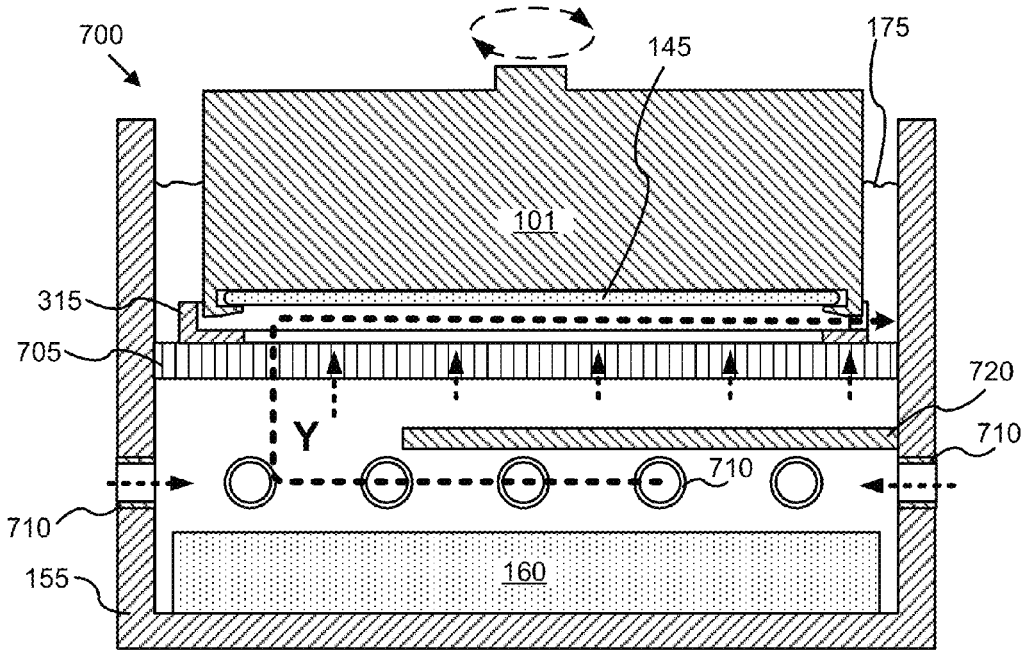

FIG. 7B depicts a simplified cross-section of a plating cell, 700, having a wafer holder, 101, which is partially immersed in an electrolyte, 175, in plating bath 155. Plating cell 700 includes a flow shaping plate, 705, such as those described herein. An anode, 160, resides below plate 705. On top of plate 705 is a flow diverter, 315, such as described in relation to FIGS. 3A and 3D. In this figure, the vent or gap in the flow diverter is on the right side of the diagram and thus imparts transverse flow from left to right as indicated by the largest dotted arrow. A series of smaller vertical arrows indicate flow through the vertically oriented through holes in plate 705. Also below plate 705 are a series of electrolyte inlet flow ports, 710, that introduce electrolyte into the chamber below plate 705. In this figure, there is no membrane separating an anolyte and catholyte chamber, but this can also be included in such plating cells without departing from the scope of this description.

In this example, flow ports 710 are distributed radially about the interior wall of cell 155. In certain embodiments, in order to enhance the transverse flow across the wafer plating surface, one or more of these flow ports is blocked, for example, flow ports on the right hand side (as drawn), proximate the vent or gap in the pseudo chamber formed between the wafer, plate 705 and flow diverter 315. In this way, although impinging flow is permitted through all the through holes in plate 705, the pressure at the left side, distal of the gap or vent in the pseudo chamber, is higher and thus the transverse flow across the wafer surface (in this example shown as left to right flow) is enhanced. In certain embodiments, the blocked flow ports are positioned about an azimuth that is at least equal to the azimuth of the segmented portion of the flow diverter. In a specific embodiment, the electrolyte flow ports on a 90° azimuthal section of the circumference of the electrolyte chamber below the flow shaping plate are blocked. In one embodiment, this 90° azimuthal section is registered with the open segment of the flow diverter annulus.

In other embodiments, the electrolyte inlet flow port or ports are configured to favor higher pressure in the area below the portion of the flow diverter distal of the vent or gap (indicated by Y in FIG. 7B). In some instances, simply physically blocking (e.g., via one or more shut off valves) selected inlet ports is more convenient and flexible than designing a cell with particularly configured electrolyte inlet ports. This is true because the configuration of the flow shaping plate and the associated flow diverter can change with different desired plating results and thus it is more flexible to be able to vary the electrolyte inlet configuration on a single plating cell.

Figure 7D:
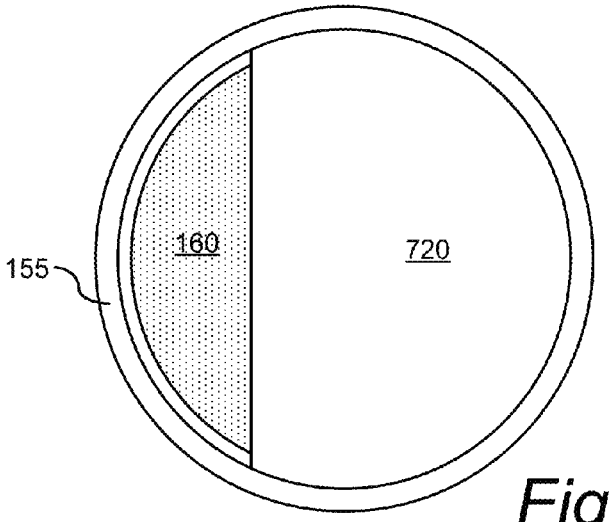

In other embodiments, with or without blocking one or more electrolyte inlet ports, a dam, baffle or other physical structure is configured to favor higher pressure in the area below the portion of the flow diverter distal of the vent or gap. For example, referring to FIG. 7C, a baffle, 720, is configured to favor higher pressure in the area below the portion of the flow diverter distal of the vent or gap (indicated by Y in FIG. 7C). FIG. 7D is a top view of plating cell 155, without wafer holder 101, flow diverter 315 or flow shaping plate 705, showing that baffle 720 promotes electrolyte flow emanating from ports 720 to confluence at area Y and thus increase pressure in that area (supra). One of ordinary skill in the art would appreciate that a physical structure may be oriented in a number of different ways, e.g. having horizontal, vertical, sloped or other elements in order to channel flow of the electrolyte in order to create a higher pressure region as described and thus promote transverse flow across the wafer surface in the pseudo chamber where the shear flow vectors are substantially uniform.

Figure 7E:
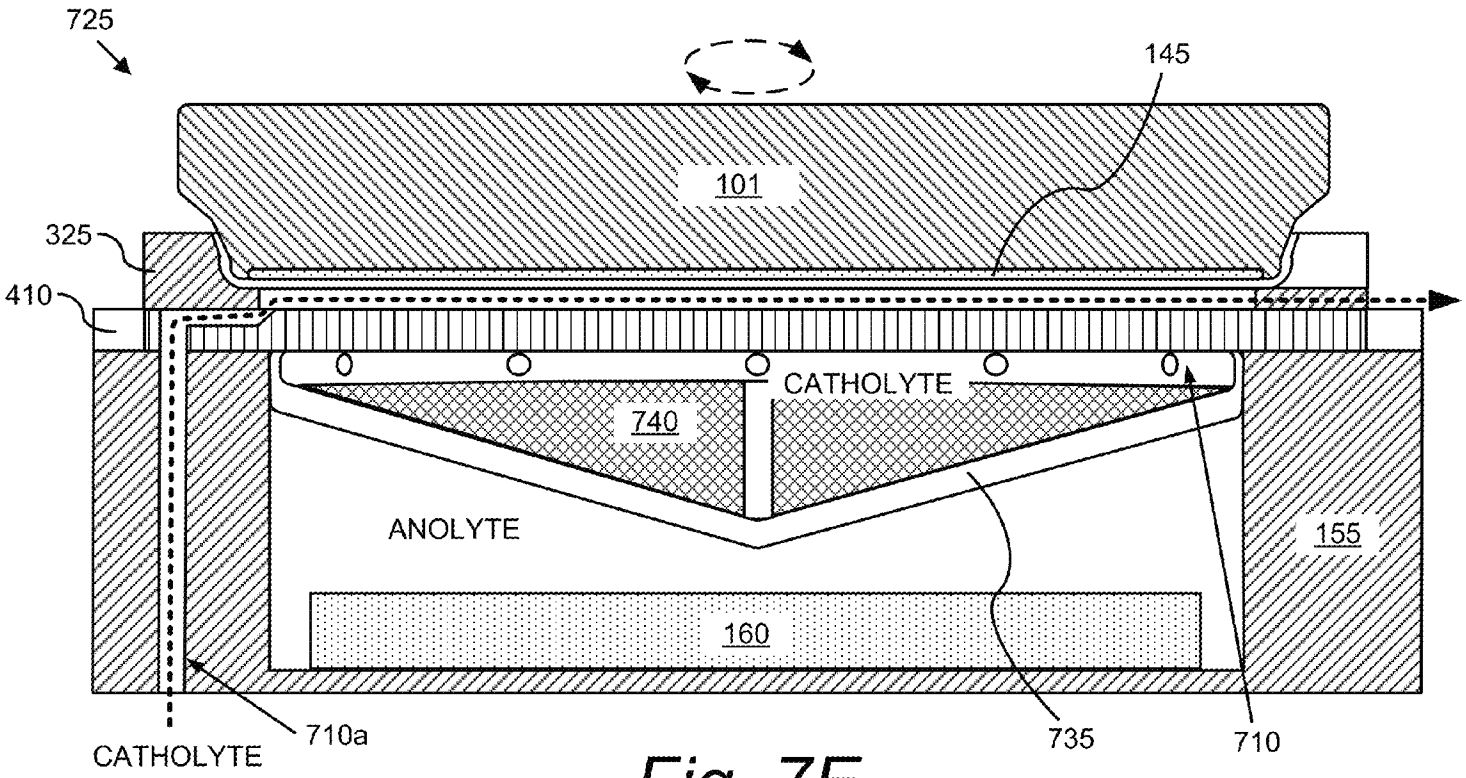

Some embodiments do include electrolyte inlet flow ports configured for transverse flow enhancement in conjunction with flow shaping plate and flow diverter assemblies. FIG. 7E depicts a cross-section of components of a plating apparatus, 725, for plating copper onto a wafer, 145, which is held, positioned and rotated by wafer holder 101. Apparatus 725 includes a plating cell, 155, which is dual chamber cell, having an anode chamber with a copper anode, 160, and anolyte. The anode chamber and cathode chamber are separated by a cationic membrane 740 which is supported by a support member 735. Plating apparatus 725 includes a flow shaping plate, 410, as described herein. A flow diverter, 325, is on top of flow shaping plate 410, and aides in creating transverse shear flow as described herein. Catholyte is introduced into the cathode chamber (above membrane 740) via flow ports 710. From flow ports 710, catholyte passes through flow plate 410 as described herein and produces impinging flow onto the plating surface of wafer 145. In addition to catholyte flow ports 710, an additional flow port, 710*a*, introduces catholyte at its exit at a position distal to the vent or gap of flow diverter 325. In this example, flow port 710*a*'s exit is formed as a channel in flow shaping plate 410. The functional result is that catholyte flow is introduced directly into the pseudo chamber formed between the flow plate and the wafer plating surface in order to enhance transverse flow across the wafer surface and thereby normalize the flow vectors across the wafer (and flow plate 410).

Figure 7F:
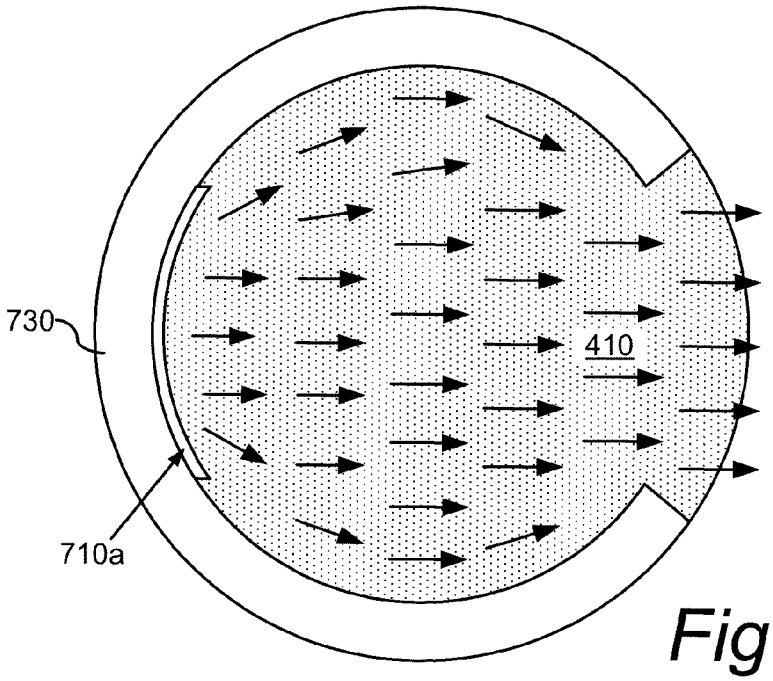
Figure 7G:
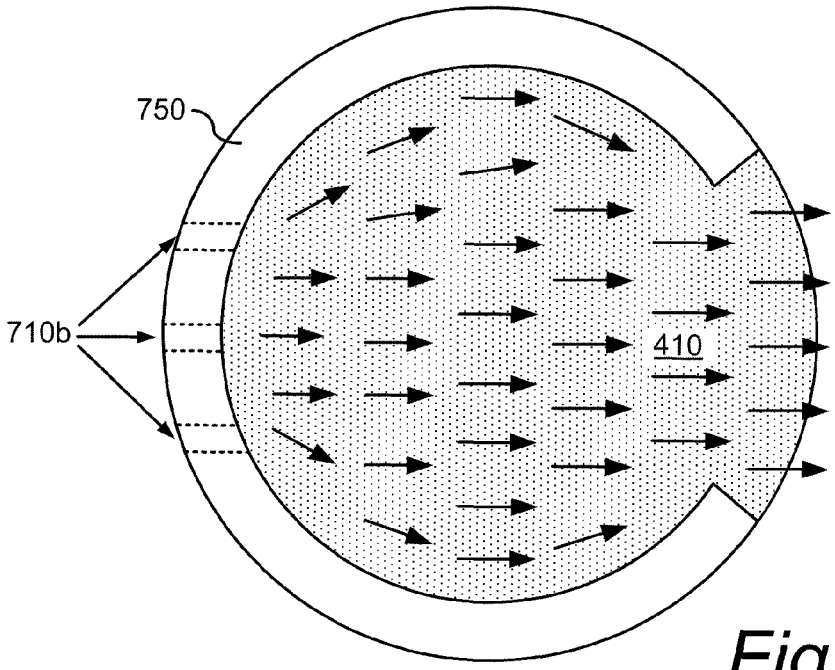

FIG. 7F depicts a flow diagram similar to that in FIG. 2C, however, in this figure, the flow port 710*a* (from FIG. 7E) is depicted. As seen in FIG. 7F, flow port 710*a*'s exit spans 90 degrees of the inner circumference of flow diverter 325. One of ordinary skill in the art would appreciate that the dimensions, configuration and location of port 710*a* may vary without escaping the scope of the invention. One of skill in the art would also appreciate that equivalent configurations would include having the catholyte exit from a port or channel in flow diverter 325 and/or in combination with a channel such as depicted in FIG. 7E (in flow plate 410). Other embodiments include one or more ports in the (lower) side wall of a flow diverter, i.e. that side wall nearest the flow shaping plate top surface, where the one or more ports are located in a portion of the flow diverter opposite the vent or gap. FIG. 7G depicts a flow diverter, 750, assembled with a flow shaping plate 410, where flow diverter 750 has catholyte flow ports, 710*b*, that supply electrolyte from the flow diverter opposite the gap of the flow diverter. Flow ports such as 710*a* and 710*b* may supply electrolyte at any angle relative to the wafer plating surface or the flow shaping plate top surface. The one or more flow ports can deliver impinging flow to the wafer surface and/or transverse (shear) flow.

In one embodiment, for example as described in relation to FIGS. 7E-G, a flow shaping plate as described herein is used in conjunction with a flow diverter such as described in relation to FIGS. 3A-3D, where a flow port configured for enhanced transverse flow (as described herein) is also used with the flow plate/flow diverter assembly. In one embodiment the flow shaping plate has non-uniform hole distribution, in one embodiment, a spiral hole pattern.

Angled Holes in Flow Shaping Plate

Figure 8A:
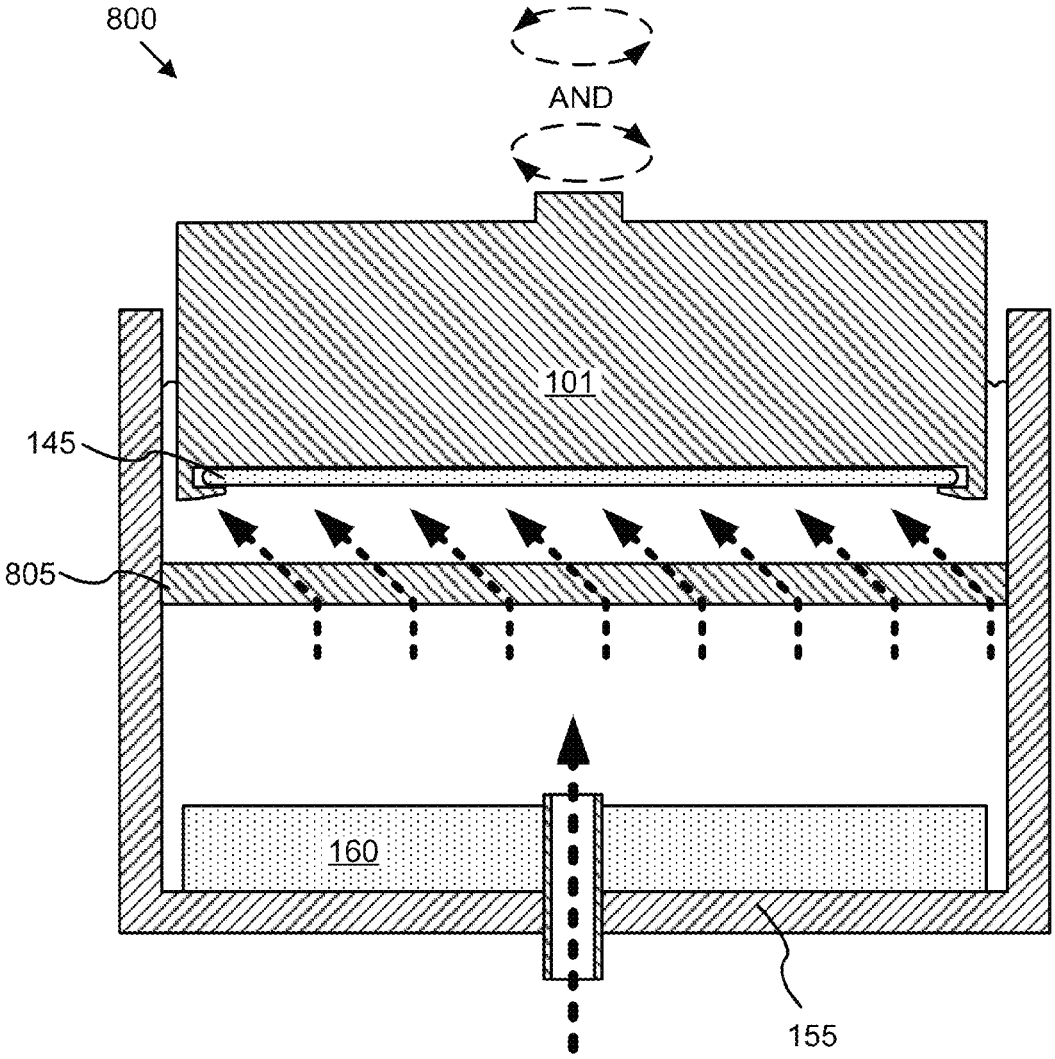
FIG. 8A is a cross-section of a flow shaping plate having angled through holes in order to compensate for lower plating rate near the center of the wafer as observed when using conventional flow shaping plate through holes.

Another way to increase transverse flow and thereby achieve more uniform plating in high-rate plating regimes is to employ an angled-hole orientation in the flow shaping plate. That is, a flow shaping plate having through-holes that are non-communicating (as described above) and with the hole dimension angled relative to top and bottom parallel surfaces through which the hole extends. This is illustrated in FIG. 8A, which depicts an assembly, 800. The through holes in the flow shaping plate, 805, are angled and thus the electrolyte flow impinging on the surface of wafer 145 strike at a non-normal angle and thus impart shearing at the center of the rotating wafer. Further details of flow shaping plates having such angled orientation are provided in provisional U.S. Patent Application No. 61/361,333 filed on Jul. 2, 2010, which is incorporated herein by reference.

Figure 8B:
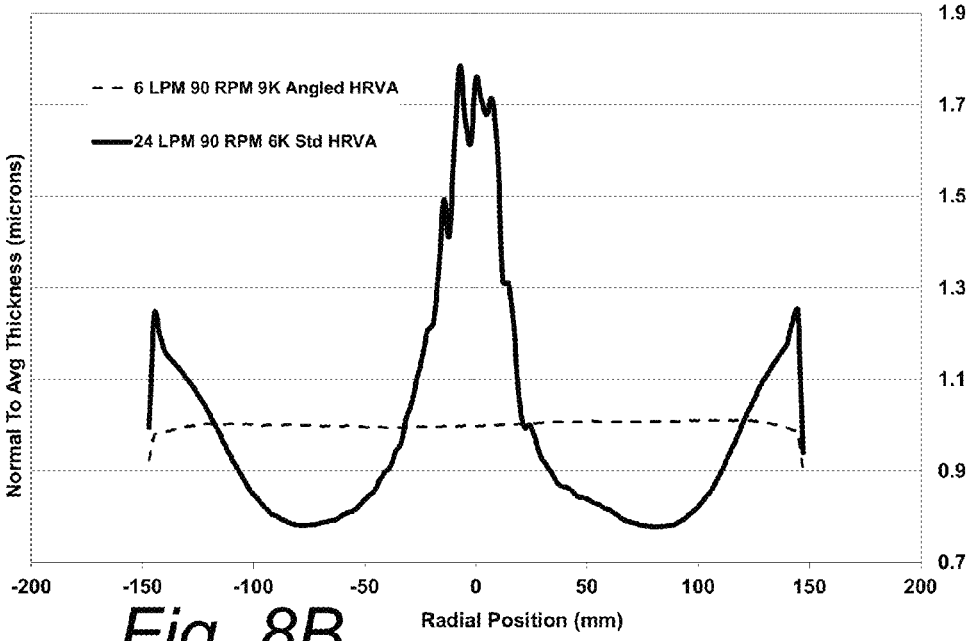
FIGS. 8B-C are graphs of plating uniformity obtained when using angled flow shaping plates.
Figure 8C:
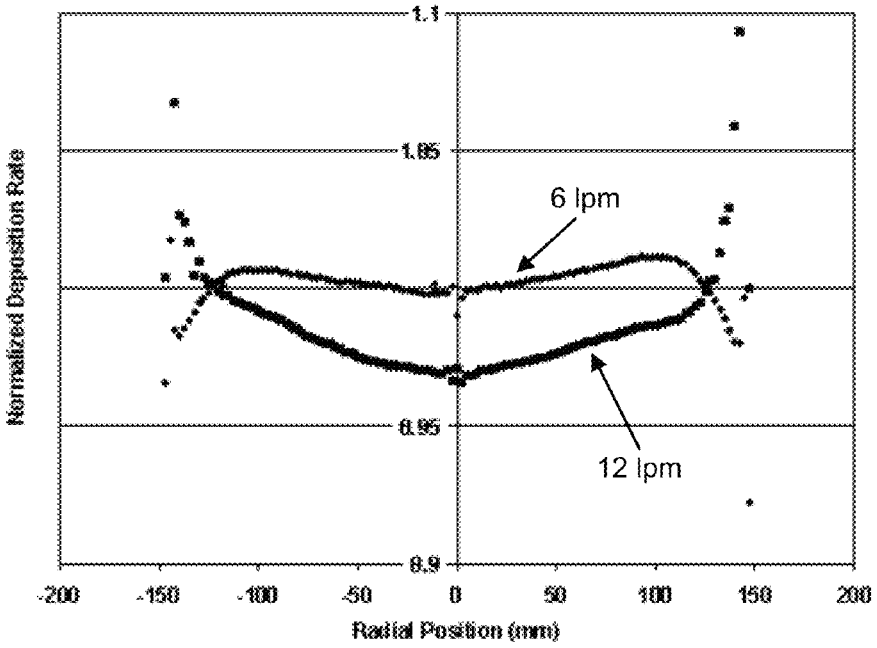

FIG. 8B is a graph showing plating thickness variation with respect to radial position on a 300 mm wafer plated with copper when using a flow shaping plate with six thousand or nine thousand angled through holes, optimizing flow rates and each with 90 rpm wafer rotation. As seen from the data, at 24 lpm using a flow plate with six thousand holes, the plating is not as uniform as, for example, when the plate has nine thousand holes at a flow rate through the plate of 6 lpm. Thus, the number of holes, flow rate, etc. can be optimized when using flow shaping plates with angled through holes to obtain sufficient shearing flow to obtain uniform plating across the wafer surface. FIG. 8C is a graph showing deposition rate vs. radial position on a 200 mm wafer when plated with copper using a flow shaping plate with angled through holes. At 6 lpm, the uniformity is greater than at 12 lpm. This demonstrates that by using flow shaping plates with angled through holes, mass transfer across the wafer can be adjusted to compensate for low plating rates at the wafer center. Angled through hole flow shaping plates result in remarkably uniform plating conditions over a wide range of boundary layer conditions.

Paddle Shearing Cell Embodiments

Figure 9A:
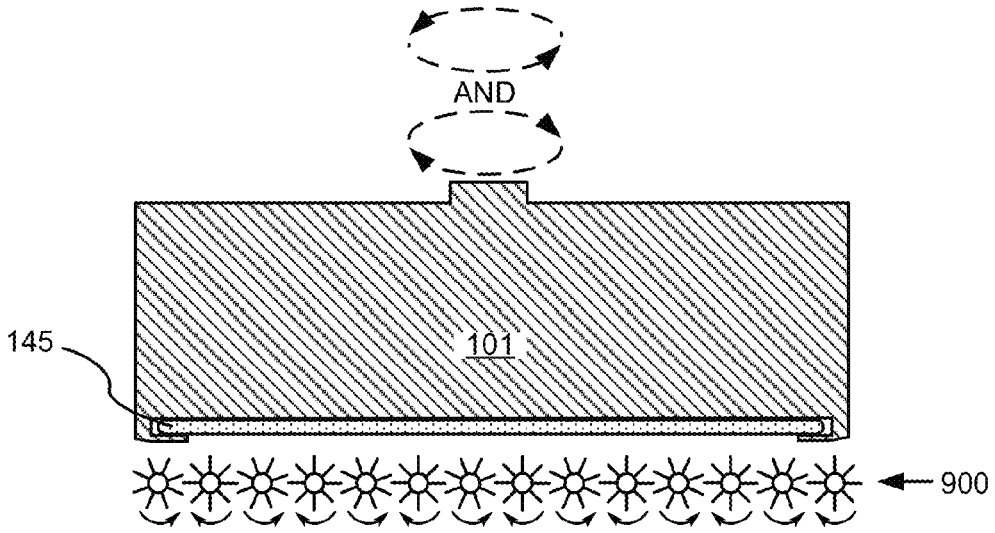
FIGS. 9A-B are cross-section and perspective, respectively, of a paddle wheel type assembly for creating turbulent transverse flow across a wafer surface during electroplating.

FIG. 9A depicts another embodiment, where rotating paddles, 900, are used to increase convection and create shearing in the electrolyte flow at the wafer surface just below a rotating wafer, thus provide improved mass transfer under high-rate plating conditions. In this embodiment, paddle wheels 900 are provided as spindles with interweaving paddles (see FIG. 9B). In this embodiment, the paddle wheels 900 are mounted on a base 905, which integrates into a plating chamber where the paddle wheels are in close proximity to the plating surface of wafer 145 during plating. This creates an increased convection, and in some cases both substantial shearing and turbulence, at the wafer surface and thus sufficient mass transfer in high-rate plating regimes. Base 905 has a number of holes, 910, for allowing electrolyte to flow through. On the lower right of base 905 is a drive mechanism for driving the spindles having paddle wheels 900. The paddle assembly includes counter rotating impellers mounted as an assembly on a base. The base with the paddle assembly is a modular unit that fits between, for example, the wafer and a cationic membrane used to delineate a cathode chamber from an anode chamber. Thus the paddle assembly is positioned in close proximity to the wafer plating surface, in the catholyte, to create shearing flow in the electrolyte at the wafer surface.

Figure 10:
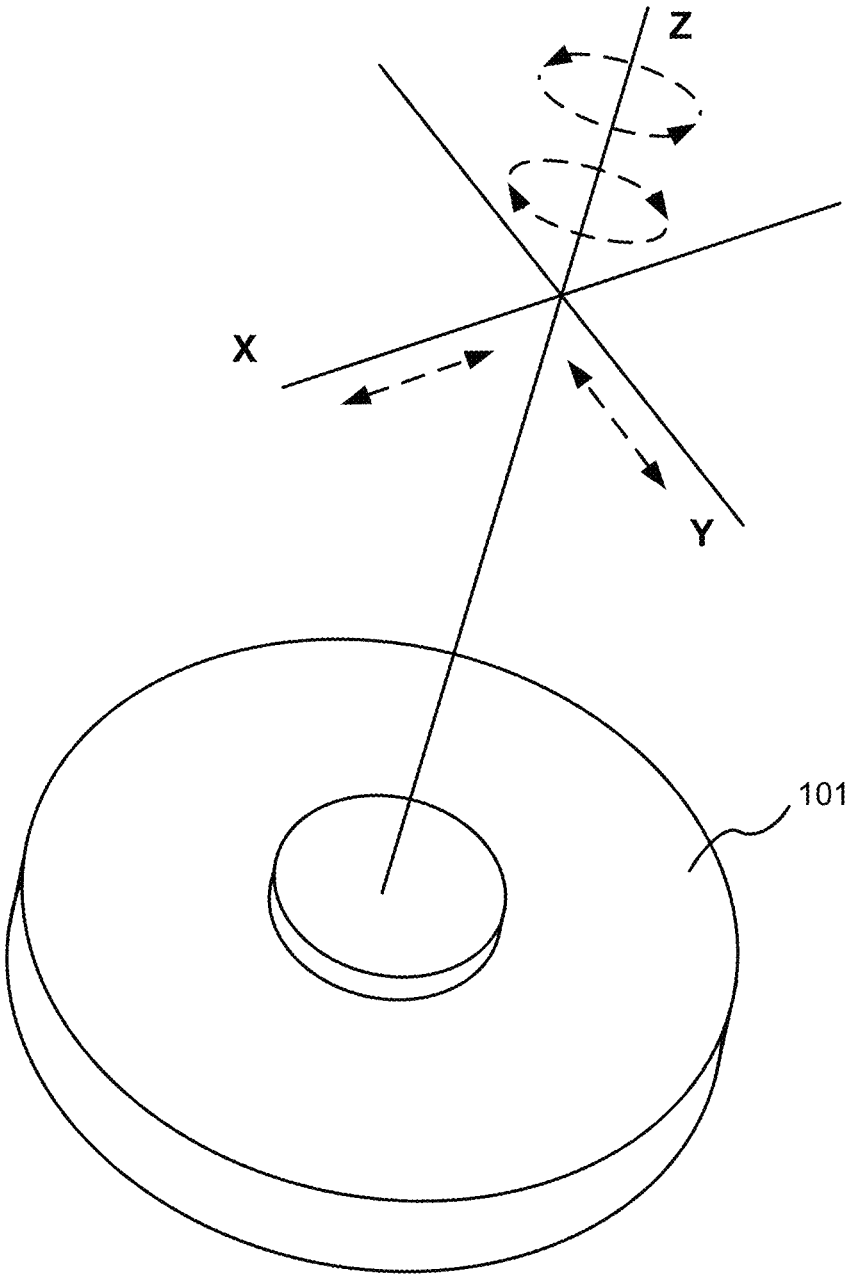
FIG. 10 is a perspective of a wafer holder showing directional vectors and rotation for orbital motion of the wafer holder.

Orbital or Translational Motion of Substrate with Respect to Flow Shaping Plate FIG. 10 depicts an embodiment where orbital motion is employed to affect improved shear flow at the center axis of the wafer surface. In this example, a plating chamber is employed where the plating chamber has sufficient diameter to accommodate wafer holder 101 when assembly 101 is orbiting in the electrolyte. That is, assembly 101, which holds the wafer during plating, not only rotates clockwise and counter clockwise along the Z axis (as depicted) but also has a translational motion along the X axis and/or the Y axis. In this way the center of the wafer does not experience a region of lesser shearing over the flow plate or turbulence relative to the rest of the wafer surface. In one embodiment, the electroplating apparatus' mechanism for applying the shearing force includes a mechanism for moving flow shaping element and/or the substrate in a direction that moves a rotational axis of the substrate plating face to a new position with respect to the flow shaping element.

As those of skill in the art will appreciate, orbital motions can be implemented in numerous ways. Chemical mechanical polishing apparatus provide a good analogy and many orbital systems employed for CMP can be employed with good effect in the present invention.

Off-Axis Rotating Element as Part of Flow Shaping Plate

Figure 11A:
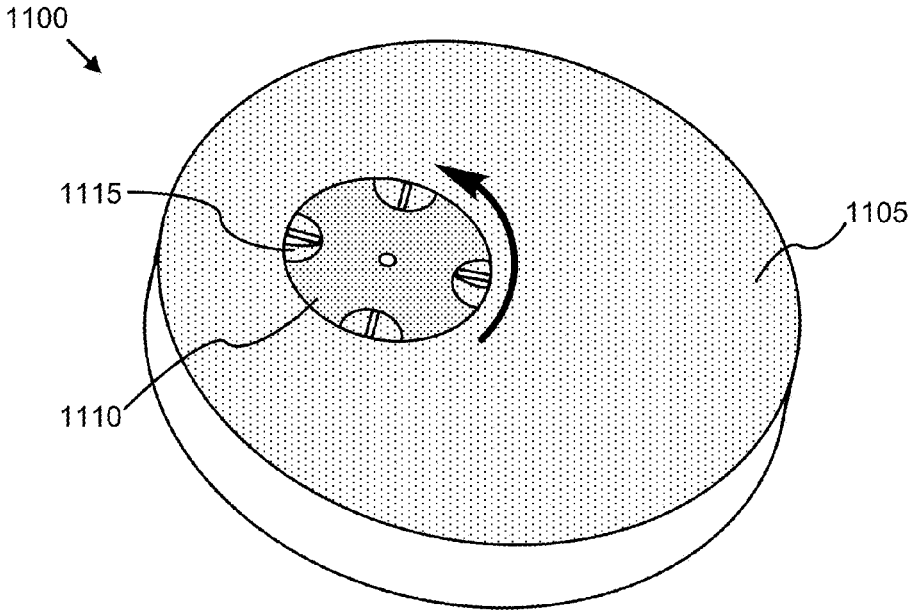
FIGS. 11A-B are perspective and perspective cross-section of a flow shaping plate having an embedded rotational element for creating transverse flow at the center of a wafer during plating.

In one embodiment, the electroplating apparatus' mechanism for applying the shearing force includes mechanism for rotating the substrate and/or the flow shaping element is configured to reverse a direction of rotation of the substrate with respect to the flow shaping element. In certain embodiments however, the electroplating apparatus' mechanism for applying the shearing force includes a mechanism for rotating an off-axis shearing plate located between the flow shaping element and the plating face of the substrate to produce a flow of electrolyte across a rotational axis of the substrate plating face. FIG. 11A depicts an embodiment, where an assembly, 1100, includes, for example, a flow shaping plate, 1105, with a rotatable disk, 1110, embedded in or attached to it. Disk 1110 can freely rotate upon a central axis, and is driven, in this example, by the angularly-rotating and moving fluid created in the gap between the flow plate and a wafer (not shown) that is rotating a few millimeters above flow plate 1105 and rotatable disk 1110. In some embodiments the rotatable disk moves (rotates) simply by coupling to the shearing of the fluid in the gap and over a rotatable disk flat surface. In other embodiments there are a set of electrolyte flow coupling fins, which in this example are situated in depressions 1115 in disk 1110 (but can also be above the plate of the flow plate) and aid in inducing the rotational motion. Hence, in this embodiment, an external mechanism of powering the rotation of the disk, other than from the rotation of the wafer above the plate and disk itself, is not required. This embodiment can be combined with that of the flow diverter, to create a larger flow shearing condition both at the wafer center and other locations, as well as minimize any upstream-downstream flow induced plating non-uniformities caused by, for example, wafer rotation alone.

In the depicted embodiment, disk 1110 is configured so that at least a portion of its surface area lies below the center region of wafer 145. Since disk 1110 rotates during plating, lateral flow is created in the region near the center of the wafer and thus improved mass transfer is achieved for uniform plating in high-rate plating regimes. While shearing at the wafer surface (other than at the wafer center) is typically created, in the absence of the rotatable disk 1110, by the motion of the rotating wafer above the flow plate 1105, in embodiments employing a disk, shearing of fluid is created at the wafer center by the relative motion of a rotatable disk or similar element with respect to a substantially locally-non-moving wafer. In this example with rotatable disk 1110, the through holes in both the flow plate and rotatable disk are normal (or substantially normal) to the plating surface of the wafer and of the same size and density, but this is not limiting. In the region of the rotating disk, in certain embodiments, the sum of the individual flow holes in the plate and in the rotating disk are equal in length to those of the holes in the plate outside of the region were the rotating disk resides. This construct ensures that the ionic resistance to current flow in these two region of the flow plate/rotating disk member are substantially equal. There is typically a small vertical separation or gap between the bottom surface of the rotatable disk and the flow plate to accommodate the presence of a small barring and/or to ensure that the rotating disk moves freely and does not rub on the flow plate surfaces. Furthermore, in some embodiments, the top surface of these two elements nearest the wafer are arranged to be substantially at the same general height or distance from the wafer. To meet these two conditions, there may be a section of additional material in the flow shaping plate that protrudes below the flow plate's lower surface.

In another embodiment, angled through holes, such as those described in relation to FIG. 4, are employed, alone or in combination with normally oriented through holes.

Figure 9B:
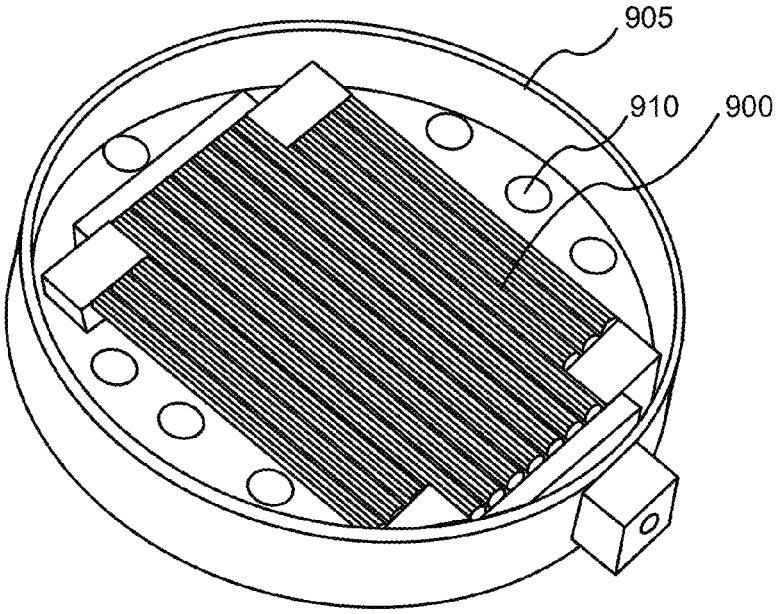
Figure 11B:
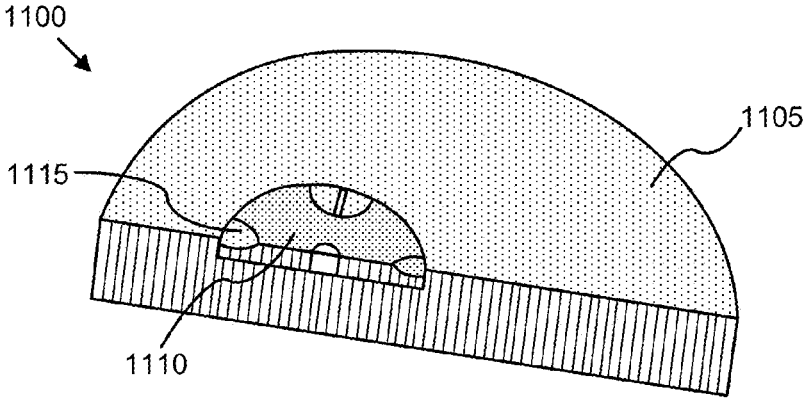

In one embodiment, disk 1110 is driven mechanically, for example, analogous to the paddles described in relation to FIGS. 9A-B. The disk also may be driven by applying a time varying magnetic or electrical field to magnets contained within or on the disk, or can be magnetically coupled to via an internal element contained in the rotating wafer holder and the rotating disk. In the later case, as a specific example, a set of equally spaced magnets in the periphery of the wafer holding and rotating clamshell create a coupling for to a corresponding set of magnets embedded in the rotating disk 1110. As the magnets in the wafer holder move/rotate about the center of the wafer and cell, they drive the disk to move in the same direction and the wafer/holder. The individual magnets eventually move further away from the individual magnet in the disk that they are most strongly couple to, but another magnetic pair in the disk and wafer holder than approach each other as they both rotate with the wafer holder/disk rotation. Also, the motion of the rotating disk can be achieved by coupling its motion to the fluid flow entering the cell, thereby eliminating the need for a separate motor or electrical components or extra moving part in a corrosive electrolyte. FIG. 11B is a cross-section of assembly 1100.

Other similar apparatus and driving mechanism that create central shearing have been envisioned and are considered within the scope of this invention, as they are readily adopted minor modification of the principles presented herein. As one further example, rather than a rotating disk, one can employ a rotating impeller or moving propeller, again either driven by the induced flow of a moving wafer, by the flow of fluid through the flow plate holes, or by other coupling external means, but also arranged to rotating in a reciprocating off-center of the axis of rotation of the wafer and cell, can be employed.

E. Plating Methods for Addressing Center Plating Non-uniformity

Figure 12:
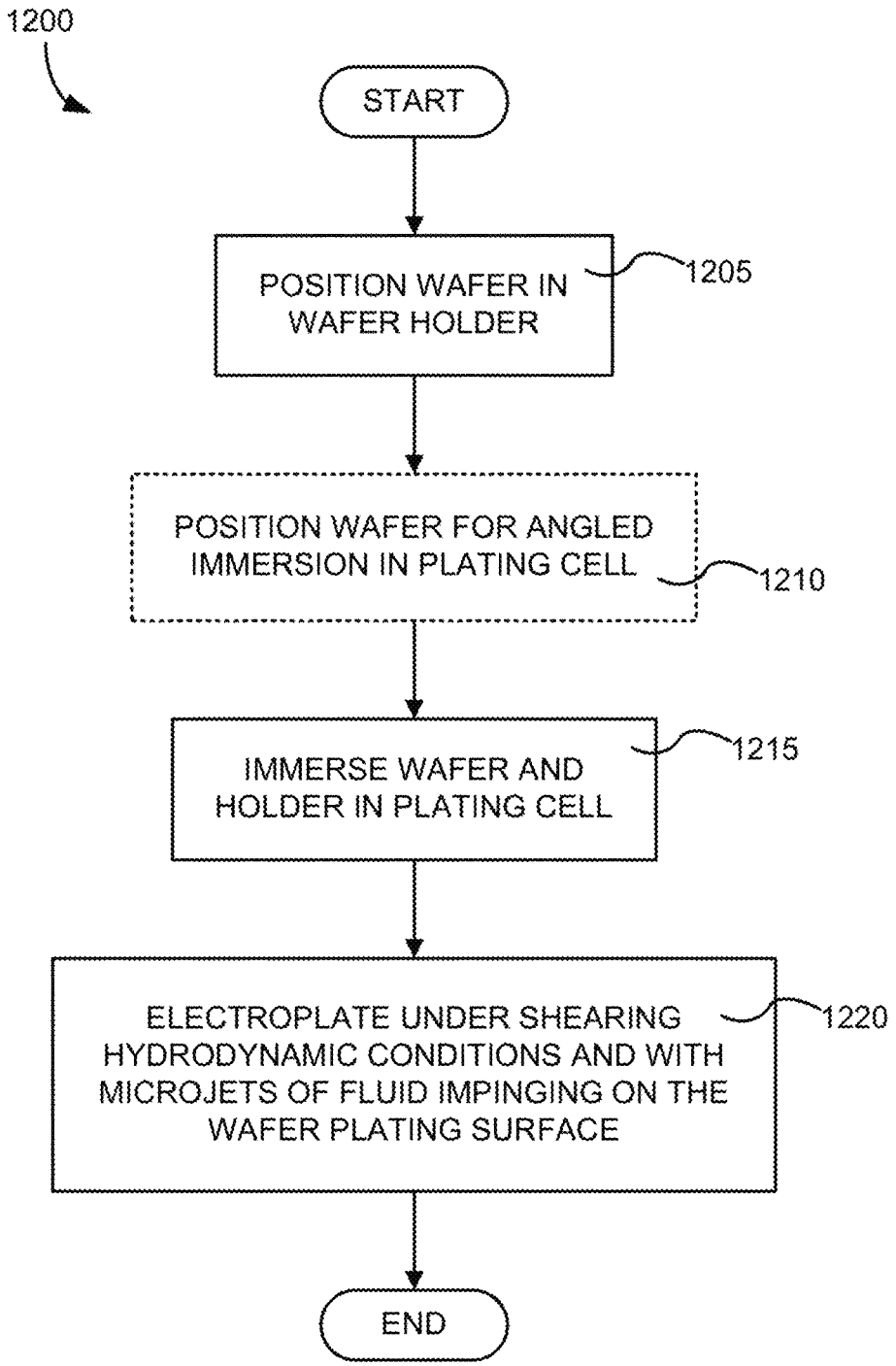
FIG. 12 is a flow diagram outlining aspects of a method described herein.

FIG. 12 depicts a process flow, 1200, according to a method of electroplating described herein. A wafer is positioned in a wafer holder, see 1205. The wafer and holder are optionally tilted for angled immersion in the plating cell electrolyte, see 1210. The wafer is then immersed in the electrolyte, see 1215. Then electroplating is commenced under shearing hydrodynamic conditions and with microjets of electrolyte impinging on the wafer plating surface, see 1220. Then the method is complete.

As described above, in one embodiment, a flow diverter has described herein is used and the wafer and holder are tilted so that the leading edge of the wafer and holder (the low side of the tilted assembly) is registered with the gap in the flow diverter (e.g. having a slotted annular structure, the slot is forms a portion of the vent or gap). In this way, the wafer holder wafer can be brought as close as possible to the final desired gap distance during immersion and thus save having to immerse at a greater distance from the flow diverter and then position closer, at the desired gap distances described herein.

Figure 13:
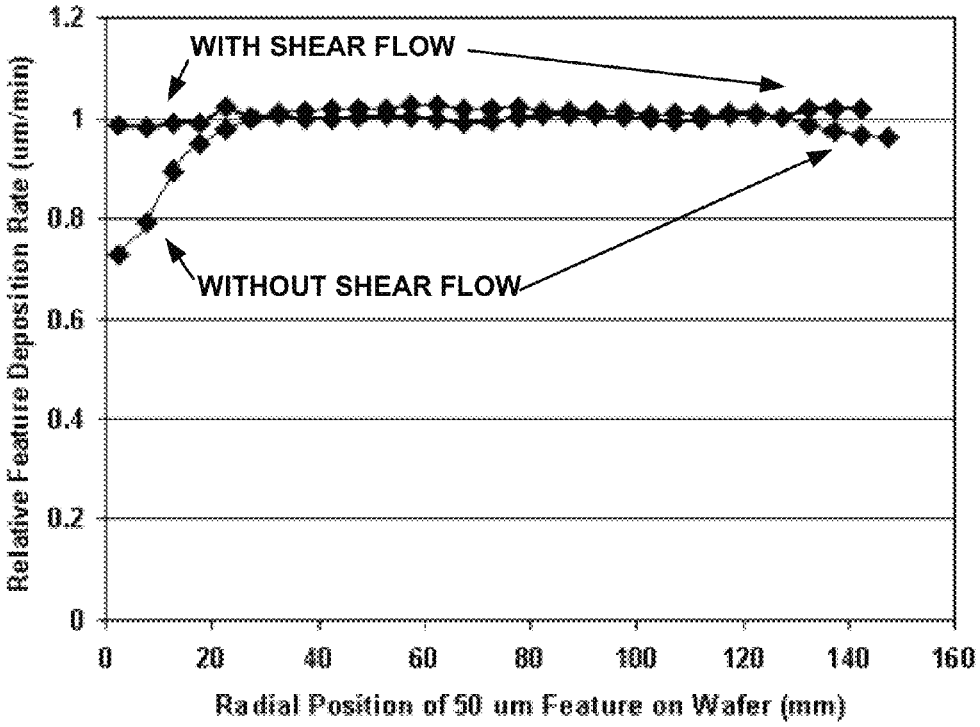
FIG. 13 is a graph showing plating uniformity obtained when transverse flow is used during plating.

FIG. 13 shows a result of plating using methods and apparatus described herein, where transverse shear flow is used for efficient mass transfer during plating. The two curves show results with and without shear flow as described herein. Without shear flow at the center of the wafer, the singularity or aberration and lack of sufficient shear flow produces a profile as described in relation to FIG. 1. But with shear flow as described herein, in this example using a slotted spacer type flow diverter as described for example in relation to FIG. 2A, plating deposition rates are substantially uniform across the plating surface of the wafer One embodiment is a method of electroplating on a substrate including features having a width and/or depth of at least about 2 micrometers, the method including: (a) providing the substrate to a plating chamber configured to contain an electrolyte and an anode while electroplating metal onto the substrate, where the plating chamber includes: (i) a substrate holder holding the substrate such that a plating face of the substrate is separated from the anode during electroplating, and (ii) a flow shaping element shaped and configured to be positioned between the substrate and the anode during electroplating, the flow shaping element having a flat surface that is substantially parallel to and separated from the plating face of the substrate by a gap of about 10 millimeters or less during electroplating, where the flow shaping element has a plurality of holes; (b) electroplating a metal onto the substrate plating surface while rotating the substrate and/or the flow shaping element and while flowing the electrolyte in the electroplating cell in the direction of the substrate plating face and under conditions that produce an average flow velocity of at least about 10 cm/s exiting the holes of the flow shaping element. In one embodiment, the electrolyte flows across the plating face of the substrate at a center point of the substrate at a rate of about 3 cm/second or greater and shearing force is applied to the electrolyte flowing at the plating face of the substrate. In one embodiment, the metal is electroplated in the features at a rate of at least about 5 micrometers/minute. In one embodiment, the thickness of the metal electroplated on the plating surface of the substrate has a uniformity of about 10% or better when plated to a thickness of at least 1 micrometer. In one embodiment, applying the shearing force includes moving the flow shaping element and/or the substrate in a direction that causes a rotational axis of the substrate plating face to move to a new position with respect to the flow shaping element. In one embodiment, applying the shearing force includes rotating an off-axis shearing plate located between the flow shaping element and the plating face of the substrate to produce a flow of electrolyte across a rotational axis of the substrate plating face. In another embodiment, applying the shearing force includes causing the electrolyte to flow laterally across the face of the substrate toward a gap in a ring structure provided around the periphery of the flow shaping element. In one embodiment, the direction of rotation of the substrate with respect to the flow shaping element is alternated during plating.

In one embodiment, the holes in the flow shaping element do not form communicating channels within the body, and where substantially all holes have a principal dimension or a diameter of the opening on the surface of the element facing the surface of the substrate of no greater than about 5 millimeters. In one embodiment, the flow shaping element is a disk having between about 6,000-12,000 holes. In one embodiment, the flow shaping element has a non-uniform density of holes, with a greater density of holes being present in a region of the flow shaping element that faces a rotational axis of the substrate plating face.

Methods described herein can be used for electroplating Damascene features, TSV features and wafer level packaging (WLP) features, such as a redistribution layer, a bump for connecting to an external wire and an under-bump metallization feature. Further discussion of WLP plating as it relates to embodiments described herein is included below.

F. WLP Plating

Embodiments described herein can be used for WLP applications. Given the relatively large amount of material to be deposited in WLP regimes, plating speed differentiates WLP and TSV applications from damascene applications, and thus efficient mass transfer of plating ions to the plating surface is important. Still further, electrochemical deposition of WLP features may involve plating various combinations of metals such as combinations or alloys of lead, tin, silver, nickel, gold, and copper as described above. Related apparatus and methods for WLP applications are described in U.S. Provisional application, Ser. No. 61/418,781, filed Dec. 1, 2010, which is incorporated by reference herein in its entirety.

Electrochemical deposition procedures may be employed at various points in the integrated circuit fabrication and packaging process. At the IC chip level, damascene features are created by electrodepositing copper within vias and trenches to form multiple interconnected metallization layers. As indicated, electrodeposition processes for this purpose are widely deployed in current integrated fabrication processes.

Above the multiple interconnection metallization layers, the "packaging" of the chip begins. Various WLP schemes and structures may be employed and a few of them are described here. In some designs, the first is a redistribution layers (also referred to "RDL"), which redistributes upper level contacts from bond pads to various under bump metallization or solder bump or ball locations. In some cases, the RDL lines help to match a convention die contacts to pin out arrays of standard packages. Such arrays may be associated with one or more defined standard formats. RDLs may also be used to balance the signal delivery times across the different lines in the package, which lines may have different resistance/capacitance/inductance (RCL) delays. Note that the RDL may be provided directly on top of damascene metallization layers or on a passivation layer formed over the top metallization layer. Various embodiments of the present invention may be employed to electroplate RDL features.

Above the RDL, the package may employ the "under bump metallization" (or UBM) structures or features. The UBM is the metal layer feature that forms base for a solder bump. The UBM may include one or more of the following: an adhesion layer, a diffusion barrier layer, and an oxidation barrier layer. Aluminum is frequently used as an adhesion layer because it provides a good glass-metal bond. In some cases, an interlayer diffusion barrier is provided between the RDL and UBM to block, e.g., copper diffusion. One interlayer material, which may be electroplated in accordance with the principles disclosed herein, is nickel for example.

Bumps are used for soldering or otherwise attaching external wires to the package. Bumps are used in flip chip designs to produce smaller chip assemblies than employed in wire bonding technology. A bump may require an underlying interlayer material to prevent diffusion of, e.g., tin from the bump from reaching copper in an underlying pad. The interlayer material may be plated in accordance with the principles of this invention.

Additionally and more recently, copper pillars may be electroplated in accordance with the methods and apparatus herein to create flip chip structures and/or to make contact between the UBM and/or the bump of another chip or device. In some cases, copper pillars are used to reduce the amount of solder material (such as reduce the amount of total lead solder in the chip), and to enable much tighter pitch control that can be achieved when using solder bumps.

Additionally, the various metals of the bumps themselves may be electroplated, with or without first forming copper pillars. Bumps may be formed from high melting point lead-tin compositions including lower melting lead-tin eutectics, and from lead-free compositions such as tin-silver alloys. Components of the under bump metallization may include films of gold or nickel-gold alloys, nickel, and palladium.

Thus, it should be apparent that WLP features or layers that may be plated using the inventions described herein are a heterogeneous group, both in terms of geometry and materials. Some examples of materials that may be electroplated in accordance with the methods and apparatus described herein to form WLP features are listed below.

1. Copper: As explained copper may be employed to form pillars, which may be used under the solder joint. Copper is also used as the RDL material.

2. Tin solder materials: Lead-tin—Various composition of this combination of elements currently includes about 90% of the market soldering in IC applications. The eutectic material typically includes about 60% atomic lead and about 40% atomic tin. It is relatively easy to plate because the potential of deposition, $E_0$s, of the two elements is nearly identical (differ by about 10 mV). Tin-silver—Typically this material is contains less than about 3% atomic silver. A challenge is to plate tin and silver together and maintain the proper concentration. Tin and silver have very different $E_0$s (differing by almost 1 V) with silver being more noble and plating in preference to tin. Hence even in solutions having very low concentration of silver, the silver preferentially plates and can be quickly depleted from the solution. This challenge suggests that it would be desirable to plate 100% tin. However, elemental tin has a hexagonal close packed lattice, which results in formation of crystal grains having different CTEs in different crystal directions. This can gives rise to mechanical failures during normal use. Tin also is known to form "tin whiskers", a phenomenon known to be able to create shorts between adjacent features.

3. Nickel: As mentioned, this element is used in UBM applications, primarily as a copper diffusion barrier.

4. Gold

In one embodiment, the aforementioned electroplated feature is a wafer level packaging feature. In one embodiment, the wafer level packaging feature is a redistribution layer, a bump for connecting to an external wire, or an under-bump metallization feature. In one embodiment, the electroplated metal is selected from the group consisting of copper, tin, a tin-lead composition, a tin-silver composition, nickel, a tin-copper composition, a tin-silver-copper composition, gold, and alloys thereof.

Although the foregoing invention has been described in some detail for purposes of clarity of understanding, it will be apparent that certain changes and modifications may be practiced within the scope of the appended claims. Therefore, the present embodiments are to be considered as illustrative and not restrictive and the invention is not to be limited to the details given herein, but may be modified within the scope and equivalents of the claims.

What is claimed is:

1. A method of electroplating on a substrate comprising features having a width and/or depth of at least about 2 micrometers, the method comprising:

(a) providing the substrate to a plating chamber, wherein the plating chamber is configured to contain an electrolyte and an anode during electroplating of metal onto the substrate, wherein the plating chamber comprises:

(i) a substrate holder holding the substrate such that a plating face of the substrate is separated from the anode during electroplating, (ii) a flow shaping element shaped and configured to be positioned between the substrate and the anode during electroplating, the flow shaping element having a flat surface that is substantially parallel to and separated from the plating face of the substrate by a distance of about 10 millimeters or less during electroplating, wherein the flow shaping element has a plurality of holes; and (iii) a flow diverter on the substrate-facing surface of the flow shaping element, the flow diverter comprising a wall structure partially following the circumference of the flow shaping element, and a vent region comprising one or more gaps;

(b) electroplating a metal onto the substrate plating surface while rotating the substrate and while flowing the electrolyte in the plating chamber in the direction of the substrate plating face and creating an impinging flow of the electrolyte in a direction substantially perpendicular to the plating face of the substrate, wherein the impinging flow of the electrolyte exits the holes of the flow shaping element and while applying a shearing force to the electrolyte flowing at the plating face of the substrate to divert the impinging flow of the electrolyte in a direction that is substantially parallel to the plating face of the substrate and to thereby create a transverse flow of the electrolyte across the center of the plating face of the substrate, wherein the shearing force is applied using the flow diverter that is configured to divert the impinging electrolyte flow into the transverse electrolyte flow flowing towards its vent region.

2. The method of claim 1, wherein the electroplated metal is selected from the group consisting of copper, tin, a tin-lead composition, a tin-silver composition, nickel, a tin-copper composition, a tin-silver-copper composition, gold, and alloys thereof.

3. The method of claim 1, wherein the average flow velocity of the electrolyte exiting the holes of the flow shaping element is at least about 10 cm/second.

4. The method of claim 1 comprising rotating the substrate at a rate of at least 30 rpm during electroplating.

5. The method of claim 1, wherein the holes of the flow shaping element are non-communicating channels.

6. The method of claim 1, wherein the wall structure of the flow diverter defines a pseudo chamber between the flow shaping element and the substrate during electroplating, and wherein the flow diverter is configured such that a top surface of the wall structure is between about 0.1 and 0.5 mm from a bottom surface of the substrate holder during electroplating and the top surface of the flow shaping element is between about 1 and 5 mm from the bottom surface of the substrate holder during electroplating.

7. The method of claim 1, wherein the electrolyte flows across the plating face of the substrate at a center point of the substrate at a transverse flow rate of about 3 cm/second or greater during electroplating.

8. The method of claim 1, wherein the flow shaping element comprises an ionically resistive material selected from the group consisting of polyethylene, polypropylene, polyvinylidene difluoride (PVDF), polytetrafluoroethylene, polysulphone, and polycarbonate.

9. The method of claim 1, wherein the flow shaping element is a disk having between about 6,000-12,000 holes.

10. The method of claim 1, wherein the flow shaping element has a non-uniform density of holes, with a greater density of holes being present in a region of the flow shaping element that faces a rotational axis of the substrate plating face.

11. The method of claim 1, wherein the flow shaping element is between about 5 mm and about 10 mm thick.

12. The method of claim 1, further comprising reversing a direction of rotation of the substrate with respect to the flow shaping element during electroplating.

13. The method of claim 1, wherein the features on the substrate are wafer level packaging features.

14. The method of claim 1, wherein the method comprises electroplating metal in the features at a rate of at least 5 micrometers per minute.

15. The method of claim 1, wherein an angle subtended by the vent region of the flow diverter is between about 20 and 120 degrees.

* * * * *